US011167343B2

(12) United States Patent
Wolf et al.

(10) Patent No.: US 11,167,343 B2
(45) Date of Patent: Nov. 9, 2021

(54) GALVANICALLY-ACTIVE IN SITU FORMED PARTICLES FOR CONTROLLED RATE DISSOLVING TOOLS

(71) Applicant: Terves, LLC, Euclid, OH (US)

(72) Inventors: David Wolf, Euclid, OH (US); Brian Doud, Euclid, OH (US); Nicholas Farkas, Euclid, OH (US); Andrew Sherman, Euclid, OH (US)

(73) Assignee: Terves, LLC, Euclid, OH (US)

( * ) Notice: Subject to any disclaimer, the term of this patent is extended or adjusted under 35 U.S.C. 154(b) by 268 days.

(21) Appl. No.: 16/149,637

(22) Filed: Oct. 2, 2018

(65) Prior Publication Data

US 2019/0054523 A1 Feb. 21, 2019

Related U.S. Application Data

(60) Continuation-in-part of application No. 15/294,957, filed on Oct. 17, 2016, now Pat. No. 10,625,336,
(Continued)

(51) Int. Cl.
*B22D 23/06* (2006.01)
*C22C 1/03* (2006.01)
(Continued)

(52) U.S. Cl.
CPC ..... *B22D 23/06* (2013.01); *B22D 19/14* (2013.01); *B22D 21/007* (2013.01); *B22D 21/04* (2013.01);
(Continued)

(58) Field of Classification Search
CPC ... C22F 1/06; C22C 23/02; C22C 1/02; C22C 23/00
See application file for complete search history.

(56) References Cited

U.S. PATENT DOCUMENTS 1,468,905 A 7/1923 Herman
1,558,066 A 10/1925 Veazey et al.
(Continued)

FOREIGN PATENT DOCUMENTS

CA 2783241 6/2011
CA 2783346 6/2011
(Continued)

OTHER PUBLICATIONS

The Declaration of Dana J. Medlin, Ph.D., P.E., FASM Under 37 C.F.R. § 1.68 In Support of Petition for Inter Partes Review of U.S. Pat. No. 9,903,010; Dated Sep. 11, 2020. (Year: 2020).*
(Continued)

*Primary Examiner* — Anthony J Zimmer
(74) *Attorney, Agent, or Firm* — Ulmer & Berne, LLP; Brian Turung

(57) ABSTRACT

A tastable, moldable, and/or extrudable structure using a metallic primary alloy. One or more additives are added to the metallic primary alloy so that in situ galvanically-active reinforcement particles are formed in the melt or on cooling from the melt. The composite contains an optimal composition and morphology to achieve a specific galvanic corrosion rate in the entire composite. The in situ formed galvanically-active particles can be used to enhance mechanical properties of the composite, such as ductility and/or tensile strength. The final casting can also be enhanced by heat treatment, as well as deformation processing such as extrusion, forging, or rolling, to further improve the strength of the final composite over the as-cast material.

23 Claims, 2 Drawing Sheets

Related U.S. Application Data which is a division of application No. 14/627,236, filed on Feb. 20, 2015, now Pat. No. 9,757,796, application No. 16/149,637, which is a continuation-in-part of application No. 15/641,439, filed on Jul. 5, 2017, now Pat. No. 10,329,653, which is a division of application No. 14/689,295, filed on Apr. 17, 2015, now Pat. No. 9,903,010.

(60) Provisional application No. 61/981,425, filed on Apr. 18, 2014, provisional application No. 62/569,004, filed on Oct. 6, 2017, provisional application No. 61/942,879, filed on Feb. 21, 2014.

(51) Int. Cl.

| | |
|---|---|
| ***B22D 27/11*** | (2006.01) |
| ***B22F 1/00*** | (2006.01) |
| ***B22D 27/08*** | (2006.01) |
| ***B22D 21/00*** | (2006.01) |
| ***B22D 21/04*** | (2006.01) |
| ***B22D 25/06*** | (2006.01) |
| ***B22D 27/00*** | (2006.01) |
| ***C22C 23/00*** | (2006.01) |
| ***C22C 23/02*** | (2006.01) |
| ***C22C 47/08*** | (2006.01) |
| ***C22C 49/04*** | (2006.01) |
| ***B22D 19/14*** | (2006.01) |
| ***B22D 27/02*** | (2006.01) |
| ***C22C 49/14*** | (2006.01) |
| ***C22C 49/02*** | (2006.01) |

(52) U.S. Cl.

CPC ..... *B22D 25/06* (2013.01); *B22D 27/00* (2013.01); *B22D 27/02* (2013.01); *B22D 27/08* (2013.01); *B22D 27/11* (2013.01); *B22F 1/004* (2013.01); *C22C 1/03* (2013.01); *C22C 23/00* (2013.01); *C22C 23/02* (2013.01); *C22C 47/08* (2013.01); *C22C 49/04* (2013.01); *C22C 49/14* (2013.01); *B22F 2202/01* (2013.01); *B22F 2301/35* (2013.01); *B22F 2304/05* (2013.01); *B22F 2999/00* (2013.01); *C22C 49/02* (2013.01)

(56) References Cited

U.S. PATENT DOCUMENTS

| | | | |
|---|---|---|---|
| 1,880,614 | A | 10/1932 | Wetherill et al. |
| 2,352,993 | A | 7/1933 | Albertson |
| 2,011,613 | A | 8/1935 | Brown et al. |
| 2,094,578 | A | 10/1937 | Blumenthal et al. |
| 2,189,697 | A | 2/1940 | Baker |
| 2,222,233 | A | 11/1940 | Mize |
| 2,225,143 | A | 12/1940 | Baker et al. |
| 2,238,895 | A | 4/1941 | Gage |
| 2,261,292 | A | 11/1941 | Salnikov |
| 2,294,648 | A | 9/1942 | Ansel et al. |
| 2,301,624 | A | 11/1942 | Holt |
| 2,394,843 | A | 2/1946 | Cook et al. |
| 2,672,199 | A | 3/1954 | McKenna |
| 2,753,941 | A | 7/1956 | Hebard et al. |
| 2,754,910 | A | 7/1956 | Derrick et al. |
| 2,933,136 | A | 4/1960 | Ayers et al. |
| 2,983,634 | A | 5/1961 | Budininkas et al. |
| 3,057,405 | A | 10/1962 | Mallinger |
| 3,066,391 | A | 12/1962 | Vordahl et al. |
| 3,106,959 | A | 10/1963 | Huitt et al. |
| 3,142,338 | A | 7/1964 | Brown |
| 3,152,009 | A | 10/1964 | DeLong |
| 3,180,728 | A | 4/1965 | Pryor et al. |
| 3,180,778 | A | 4/1965 | Rinderspacher et al. |
| 3,196,949 | A | 7/1965 | Thomas |
| 3,226,314 | A | 12/1965 | Wellington et al. |
| 3,242,988 | A | 3/1966 | McGuire, Jr. et al. |
| 3,295,935 | A | 1/1967 | Pflumm et al. |
| 3,298,440 | A | 1/1967 | Current |
| 3,316,748 | A | 5/1967 | Lang et al. |
| 3,326,291 | A | 6/1967 | Zandemer |
| 3,347,714 | A | 10/1967 | Broverman et al. |
| 3,385,696 | A | 5/1968 | Hitchcock et al. |
| 3,390,724 | A | 7/1968 | Caldwell |
| 3,395,758 | A | 8/1968 | Kelly et al. |
| 3,406,101 | A | 10/1968 | Kilpatrick |
| 3,416,918 | A | 12/1968 | Roberts |
| 3,434,539 | A | 3/1969 | Merritt |
| 3,445,148 | A | 5/1969 | Harris et al. |
| 3,445,731 | A | 5/1969 | Saeki et al. |
| 3,465,181 | A | 9/1969 | Colby et al. |
| 3,489,218 | A | 1/1970 | Means |
| 3,513,230 | A | 5/1970 | Rhees et al. |
| 3,600,163 | A | 8/1971 | Badia et al. |
| 3,602,305 | A | 8/1971 | Kisling |
| 3,637,446 | A | 1/1972 | Elliott et al. |
| 3,645,331 | A | 2/1972 | Maurer et al. |
| 3,660,049 | A | 5/1972 | Benjamin |
| 3,765,484 | A | 10/1973 | Hamby, Jr. et al. |
| 3,768,563 | A | 10/1973 | Blount |
| 3,775,823 | A | 12/1973 | Adolph et al. |
| 3,816,080 | A | 6/1974 | Bomford et al. |
| 3,823,045 | A | 7/1974 | Hielema |
| 3,878,889 | A | 4/1975 | Seaboume |
| 3,894,850 | A | 7/1975 | Kovalchuk et al. |
| 3,924,677 | A | 12/1975 | Prenner et al. |
| 3,957,483 | A | 5/1976 | Suzuki |
| 4,010,583 | A | 3/1977 | Highberg |
| 4,039,717 | A | 8/1977 | Titus |
| 4,050,529 | A | 9/1977 | Tagirov et al. |
| 4,157,732 | A | 6/1979 | Fonner |
| 4,248,307 | A | 2/1981 | Silberman et al. |
| 4,264,362 | A | 4/1981 | Serveg et al. |
| 4,284,137 | A | 8/1981 | Taylor |
| 4,292,377 | A | 9/1981 | Petersen et al. |
| 4,368,788 | A | 1/1983 | Drake |
| 4,372,384 | A | 2/1983 | Kinney |
| 4,373,584 | A | 2/1983 | Silberman et al. |
| 4,373,952 | A | 2/1983 | Parent |
| 4,374,543 | A | 2/1983 | Richardson |
| 4,384,616 | A | 5/1983 | Dellinger |
| 4,395,440 | A | 7/1983 | Abe et al. |
| 4,399,871 | A | 8/1983 | Adkins et al. |
| 4,407,368 | A | 10/1983 | Erbstoesser |
| 4,422,508 | A | 12/1983 | Rutledge, Jr. et al. |
| 4,450,136 | A | 5/1984 | Dudek et al. |
| 4,452,311 | A | 6/1984 | Speegle et al. |
| 4,475,729 | A | 10/1984 | Costigan |
| 4,498,543 | A | 2/1985 | Pye et al. |
| 4,499,048 | A | 2/1985 | Hanejko |
| 4,499,049 | A | 2/1985 | Hanejko |
| 4,524,825 | A | 6/1985 | Fore |
| 4,526,840 | A | 7/1985 | Jerabek |
| 4,534,414 | A | 8/1985 | Pringle |
| 4,539,175 | A | 9/1985 | Lichti et al. |
| 4,554,986 | A | 11/1985 | Jones |
| 4,619,699 | A | 10/1986 | Petkovic-Luton et al. |
| 4,640,354 | A | 2/1987 | Boisson |
| 4,648,901 | A | 3/1987 | Murray et al. |
| 4,655,852 | A | 4/1987 | Rallis |
| 4,664,962 | A | 5/1987 | DesMarais, Jr. |
| 4,668,470 | A | 5/1987 | Gilman et al. |
| 4,673,549 | A | 6/1987 | Ecer |
| 4,674,572 | A | 6/1987 | Gallus |
| 4,678,037 | A | 7/1987 | Smith |
| 4,681,133 | A | 7/1987 | Weston |
| 4,688,641 | A | 8/1987 | Knieriemen |
| 4,690,796 | A | 9/1987 | Paliwal |
| 4,693,863 | A | 9/1987 | Del Corso et al. |
| 4,703,807 | A | 11/1987 | Weston |
| 4,706,753 | A | 11/1987 | Ohkochi et al. |
| 4,708,202 | A | 11/1987 | Sukup et al. |
| 4,708,208 | A | 11/1987 | Halbardier |

(56) References Cited

U.S. PATENT DOCUMENTS 4,709,761 A 12/1987 Setterberg, Jr.
4,714,116 A 12/1987 Brunner
4,716,964 A 1/1988 Erbstoesser et al.
4,719,971 A 1/1988 Owens
4,721,159 A 1/1988 Ohkochi et al.
4,738,599 A 4/1988 Shilling
4,741,973 A 5/1988 Condit et al.
4,768,588 A 9/1988 Kupsa
4,775,598 A 10/1988 Jaeckel
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,853,056 A 8/1989 Hoffman
4,869,324 A 9/1989 Holder
4,869,325 A 9/1989 Halbardier
4,875,948 A 10/1989 Verneker
4,880,059 A 11/1989 Branded et al.
4,889,187 A 12/1989 Terrell et al.
4,890,675 A 1/1990 Dew
4,901,794 A 2/1990 Baugh et al.
4,909,320 A 3/1990 Hebert et al.
4,917,966 A 4/1990 Wilde et al.
4,921,664 A 5/1990 Couper
4,929,415 A 5/1990 Okazaki
4,932,474 A 6/1990 Schroeder, Jr. et al.
4,934,459 A 6/1990 Baugh et al.
4,938,309 A 7/1990 Emdy
4,938,809 A 7/1990 Das et al.
4,944,351 A 7/1990 Eriksen et al.
4,949,788 A 8/1990 Szarka et al.
4,952,902 A 8/1990 Kawaguchi et al.
4,975,412 A 12/1990 Okazaki et al.
4,977,958 A 12/1990 Miller
4,981,177 A 1/1991 Carmody et al.
4,986,361 A 1/1991 Muuller et al.
4,997,622 A 3/1991 Regazzoni et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 DeLuccia
5,063,775 A 11/1991 Walker, Sr. et al.
5,073,207 A 12/1991 Faure et al.
5,074,361 A 12/1991 Brisco et al.
5,076,869 A 12/1991 Bourell et al.
5,084,088 A 1/1992 Okazaki
5,087,304 A 2/1992 Chang et al.
5,090,480 A 2/1992 Pittard et al.
5,095,988 A 3/1992 Bode
5,103,911 A 4/1992 Heijnen
5,106,702 A 4/1992 Walker et al.
5,117,915 A 6/1992 Mueller et al.
5,161,614 A 11/1992 Wu et al.
5,171,734 A 12/1992 Sanjurjo et al.
5,178,216 A 1/1993 Giroux et al.
5,181,571 A 1/1993 Mueller et al.
5,183,631 A 2/1993 Kugimiya et al.
5,188,182 A 2/1993 Echols, III et al.
5,188,183 A 2/1993 Hopmann et al.
5,204,055 A 4/1993 Sachs et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,238,646 A 8/1993 Farcy et al.
5,240,495 A 8/1993 Dieckmann et al.
5,240,742 A 8/1993 Johnson et al.
5,252,365 A 10/1993 White
5,253,714 A 10/1993 Davis et al.
5,271,468 A 12/1993 Streich et al.
5,273,569 A 12/1993 Gilman et al.
5,282,509 A 2/1994 Schurr, III
5,285,798 A 2/1994 Banerjee et al.
5,292,478 A 3/1994 Scorey
5,293,940 A 3/1994 Hromas et al.
5,304,260 A 4/1994 Aikawa et al.
5,304,588 A 4/1994 Boysen et al.
5,309,874 A 5/1994 Willermet et al.
5,310,000 A 5/1994 Arterbury et al.
5,316,598 A 5/1994 Chang et al.
5,318,746 A 6/1994 Lashmore et al.
5,336,466 A 8/1994 Iba
5,342,576 A 8/1994 Whitehead
5,352,522 A 10/1994 Kugimiya et al.
5,380,473 A 1/1995 Bogue et al.
5,387,380 A 2/1995 Cima et al.
5,392,860 A 2/1995 Ross
5,394,236 A 2/1995 Murnick
5,394,941 A 3/1995 Venditto et al.
5,398,754 A 3/1995 Dinhoble
5,407,011 A 4/1995 Layton
5,409,555 A 4/1995 Fujita et al.
5,411,082 A 5/1995 Kennedy
5,417,285 A 5/1995 Van Buskirk et al.
5,425,424 A 6/1995 Reinhardt et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,456,327 A 10/1995 Denton et al.
5,464,062 A 11/1995 Blizzard, Jr.
5,472,048 A 12/1995 Kennedy
5,474,131 A 12/1995 Jordan, Jr. et al.
5,476,632 A 12/1995 Shivanath et al.
5,477,923 A 12/1995 Jordan, Jr. et al.
5,479,986 A 1/1996 Gano et al.
5,494,538 A 2/1996 Kirillov et al.
5,506,055 A 4/1996 Dorfman et al.
5,507,439 A 4/1996 Story
5,511,620 A 4/1996 Baugh et al.
5,524,699 A 6/1996 Cook
5,526,880 A 6/1996 Jordan, Jr. et al.
5,526,881 A 6/1996 Martin et al.
5,529,746 A 6/1996 Knoss et al.
5,531,735 A 7/1996 Thompson
5,533,573 A 7/1996 Jordan, Jr. et al.
5,536,485 A 7/1996 Kume et al.
5,552,110 A 9/1996 Iba
5,558,153 A 9/1996 Holcombe et al.
5,601,924 A 2/1997 Beane et al.
5,607,017 A 3/1997 Owens et al.
5,623,993 A 4/1997 Van Buskirk et al.
5,623,994 A 4/1997 Robinson
5,641,023 A 6/1997 Ross et al.
5,636,691 A 7/1997 Hendrickson et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt
5,709,269 A 1/1998 Head
5,720,344 A 2/1998 Newman
5,722,033 A 2/1998 Carden
5,728,195 A 3/1998 Eastman et al.
5,765,639 A 6/1998 Muth
5,767,562 A 6/1998 Yamashita
5,772,735 A 6/1998 Sehgal et al.
5,782,305 A 7/1998 Hicks
5,797,454 A 8/1998 Hipp
5,820,608 A 10/1998 Luzio et al.
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,896,819 A 4/1999 Turila et al.
5,902,424 A 5/1999 Fujita et al.
5,934,372 A 8/1999 Muth

(56) References Cited

U.S. PATENT DOCUMENTS

| | | | |
|---|---|---|---|
| 5,941,309 | A | 8/1999 | Appleton |
| 5,960,881 | A | 10/1999 | Allamon et al. |
| 5,964,965 | A | 10/1999 | Schulz et al. |
| 5,894,007 | A | 11/1999 | Yuan et al. |
| 5,980,602 | A | 11/1999 | Carden |
| 5,985,466 | A | 11/1999 | Atarashi et al. |
| 5,988,287 | A | 11/1999 | Jordan, Jr. et al. |
| 5,990,051 | A | 11/1999 | Ischy et al. |
| 5,992,452 | A | 11/1999 | Nelson, II |
| 5,992,520 | A | 11/1999 | Schultz et al. |
| 6,007,314 | A | 12/1999 | Nelson, II |
| 6,024,915 | A | 2/2000 | Kume et al. |
| 6,030,637 | A | 2/2000 | Whitehead |
| 6,032,735 | A | 3/2000 | Echols |
| 6,033,622 | A | 3/2000 | Maruyama |
| 6,036,777 | A | 3/2000 | Sachs |
| 6,036,792 | A | 3/2000 | Chu et al. |
| 6,040,087 | A | 3/2000 | Kawakami |
| 6,047,773 | A | 4/2000 | Zeltmann et al. |
| 6,050,340 | A | 4/2000 | Scott |
| 6,069,313 | A | 5/2000 | Kay |
| 6,076,600 | A | 6/2000 | Vick, Jr. et al. |
| 6,079,496 | A | 6/2000 | Hirth |
| 6,085,837 | A | 7/2000 | Massinon et al. |
| 6,095,247 | A | 8/2000 | Streich et al. |
| 6,119,783 | A | 9/2000 | Parker et al. |
| 6,126,898 | A | 10/2000 | Butler |
| 6,142,237 | A | 11/2000 | Christmas et al. |
| 6,161,622 | A | 12/2000 | Robb et al. |
| 6,167,970 | B1 | 1/2001 | Stout et al. |
| 6,170,583 | B1 | 1/2001 | Boyce |
| 6,171,359 | B1 | 1/2001 | Levinski et al. |
| 6,173,779 | B1 | 1/2001 | Smith |
| 6,176,323 | B1 | 1/2001 | Weirich et al. |
| 6,189,616 | B1 | 2/2001 | Gano et al. |
| 6,189,618 | B1 | 2/2001 | Beeman et al. |
| 6,213,202 | B1 | 4/2001 | Read, Jr. |
| 6,220,349 | B1 | 4/2001 | Vargus et al. |
| 6,220,350 | B1 | 4/2001 | Brothers et al. |
| 6,220,357 | B1 | 4/2001 | Carmichael et al. |
| 6,228,904 | B1 | 5/2001 | Yadav et al. |
| 6,230,799 | B1 | 5/2001 | Slaughter et al. |
| 6,237,688 | B1 | 5/2001 | Burleson et al. |
| 6,238,280 | B1 | 5/2001 | Ritt et al. |
| 6,241,021 | B1 | 6/2001 | Bowling |
| 6,248,399 | B1 | 6/2001 | Hehmann |
| 6,250,392 | B1 | 6/2001 | Muth |
| 6,261,432 | B1 | 7/2001 | Huber et al. |
| 6,265,205 | B1 | 7/2001 | Hitchens et al. |
| 6,273,187 | B1 | 8/2001 | Voisin, Jr. et al. |
| 6,276,452 | B1 | 8/2001 | Davis et al. |
| 6,276,457 | B1 | 8/2001 | Moffatt et al. |
| 6,279,656 | B1 | 8/2001 | Sinclair et al. |
| 6,287,332 | B1 | 9/2001 | Bolz et al. |
| 6,287,445 | B1 | 9/2001 | Lashmore et al. |
| 6,302,205 | B1 | 10/2001 | Ryll |
| 6,315,041 | B1 | 11/2001 | Carlisle et al. |
| 6,315,050 | B2 | 11/2001 | Vaylnshteyn et al. |
| 6,325,148 | B1 | 12/2001 | Trahan et al. |
| 6,328,110 | B1 | 12/2001 | Joubert |
| 6,341,653 | B1 | 1/2002 | Fermaniuk et al. |
| 6,341,747 | B1 | 1/2002 | Schmidt et al. |
| 6,349,766 | B1 | 2/2002 | Bussear et al. |
| 6,354,372 | B1 | 3/2002 | Carisell et al. |
| 6,354,379 | B2 | 3/2002 | Miszewski et al. |
| 6,371,206 | B1 | 4/2002 | Mills |
| 6,372,346 | B1 | 4/2002 | Toth |
| 6,382,244 | B2 | 5/2002 | Vann |
| 6,390,195 | B1 | 5/2002 | Nguyen et al. |
| 6,390,200 | B1 | 5/2002 | Allamon et al. |
| 6,394,180 | B1 | 5/2002 | Berscheidt et al. |
| 6,394,185 | B1 | 5/2002 | Constien |
| 6,395,402 | B1 | 5/2002 | Lambert et al. |
| 6,397,950 | B1 | 6/2002 | Streich et al. |
| 6,401,547 | B1 | 6/2002 | Hatfield et al. |
| 6,403,210 | B1 | 6/2002 | Stuivinga et al. |
| 6,408,946 | B1 | 6/2002 | Marshall et al. |
| 6,419,023 | B1 | 7/2002 | George et al. |
| 6,422,314 | B1 | 7/2002 | Todd et al. |
| 6,439,313 | B1 | 8/2002 | Thomeer et al. |
| 6,444,316 | B1 | 9/2002 | Reddy et al. |
| 6,446,717 | B1 | 9/2002 | White et al. |
| 6,457,525 | B1 | 10/2002 | Scott |
| 6,467,546 | B2 | 10/2002 | Allamon et al. |
| 6,470,965 | B1 | 10/2002 | Winzer |
| 6,491,097 | B1 | 12/2002 | Oneal et al. |
| 6,491,116 | B2 | 12/2002 | Berscheidt et al. |
| 6,513,598 | B2 | 2/2003 | Moore et al. |
| 6,513,600 | B2 | 2/2003 | Ross |
| 6,527,051 | B1 | 3/2003 | Reddy et al. |
| 6,540,033 | B1 | 4/2003 | Sullivan et al. |
| 6,543,543 | B2 | 4/2003 | Muth |
| 6,554,071 | B1 | 4/2003 | Reddy et al. |
| 6,561,275 | B2 | 5/2003 | Glass et al. |
| 6,581,681 | B1 | 6/2003 | Zimmerman et al. |
| 6,588,507 | B2 | 7/2003 | Dusterhoft et al. |
| 6,591,915 | B2 | 7/2003 | Burris et al. |
| 6,601,648 | B2 | 8/2003 | Ebinger |
| 6,601,650 | B2 | 8/2003 | Sundararajan |
| 6,609,569 | B2 | 8/2003 | Howlett et al. |
| 6,612,826 | B1 | 9/2003 | Bauer et al. |
| 6,613,383 | B1 | 9/2003 | George et al. |
| 6,619,400 | B2 | 9/2003 | Brunet |
| 6,630,008 | B1 | 10/2003 | Meeks, III et al. |
| 6,634,428 | B2 | 10/2003 | Krauss et al. |
| 6,662,886 | B2 | 12/2003 | Russell |
| 6,675,889 | B1 | 1/2004 | Mullins et al. |
| 6,699,305 | B2 | 3/2004 | Myrick |
| 6,712,153 | B2 | 3/2004 | Turley et al. |
| 6,712,797 | B1 | 3/2004 | Southern, Jr. |
| 6,713,177 | B2 | 3/2004 | George et al. |
| 6,715,541 | B2 | 4/2004 | Pedersen et al. |
| 6,737,385 | B2 | 5/2004 | Todd et al. |
| 6,779,599 | B2 | 8/2004 | Mullins et al. |
| 6,799,638 | B2 | 10/2004 | Butterfield, Jr. |
| 6,810,960 | B2 | 11/2004 | Pia |
| 6,817,414 | B2 | 11/2004 | Lee |
| 6,831,044 | B2 | 12/2004 | Constien |
| 6,883,611 | B2 | 4/2005 | Smith et al. |
| 6,887,297 | B2 | 5/2005 | Winter et al. |
| 6,896,049 | B2 | 5/2005 | Moyes |
| 6,896,061 | B2 | 5/2005 | Hriscu et al. |
| 6,899,777 | B2 | 5/2005 | Vaidyanathan et al. |
| 6,908,516 | B2 | 6/2005 | Hehmann et al. |
| 6,913,827 | B2 | 7/2005 | Georget et al. |
| 6,926,086 | B2 | 8/2005 | Patterson et al. |
| 6,932,159 | B2 | 8/2005 | Hovem |
| 6,939,388 | B2 | 9/2005 | Angeliu |
| 6,945,331 | B2 | 9/2005 | Patel |
| 6,951,331 | B2 | 10/2005 | Haughom et al. |
| 6,959,759 | B2 | 11/2005 | Doane et al. |
| 6,973,970 | B2 | 12/2005 | Johnston et al. |
| 6,973,973 | B2 | 12/2005 | Howard et al. |
| 6,983,796 | B2 | 1/2006 | Bayne et al. |
| 6,986,390 | B2 | 1/2006 | Doane et al. |
| 7,013,989 | B2 | 3/2006 | Hammond et al. |
| 7,013,998 | B2 | 3/2006 | Ray et al. |
| 7,017,664 | B2 | 3/2006 | Walker et al. |
| 7,017,677 | B2 | 3/2006 | Keshavan et al. |
| 7,021,389 | B2 | 4/2006 | Bishop et al. |
| 7,025,146 | B2 | 4/2006 | King et al. |
| 7,028,778 | B2 | 4/2006 | Krywitsky |
| 7,044,230 | B2 | 5/2006 | Starr et al. |
| 7,048,812 | B2 | 5/2006 | Bettles et al. |
| 7,049,272 | B2 | 5/2006 | Sinclair et al. |
| 7,051,805 | B2 | 5/2006 | Doane et al. |
| 7,059,410 | B2 | 6/2006 | Bousche et al. |
| 7,063,748 | B2 | 6/2006 | Talton |
| 7,090,027 | B1 | 8/2006 | Williams |
| 7,093,664 | B2 | 8/2006 | Todd et al. |
| 7,096,945 | B2 | 8/2006 | Richards et al. |
| 7,096,946 | B2 | 8/2006 | Jasser et al. |
| 7,097,807 | B1 | 8/2006 | Meeks, III et al. |
| 7,097,906 | B2 | 8/2006 | Gardner |

(56) References Cited

U.S. PATENT DOCUMENTS

| | | | |
|---|---|---|---|
| 7,108,080 | B2 | 9/2006 | Tessari et al. |
| 7,111,682 | B2 | 9/2006 | Blaisdell |
| 7,128,145 | B2 | 10/2006 | Mickey |
| 7,141,207 | B2 | 11/2006 | Jandeska, Jr. et al. |
| 7,150,326 | B2 | 12/2006 | Bishop et al. |
| 7,163,066 | B2 | 1/2007 | Lehr |
| 7,165,622 | B2 | 1/2007 | Hirth et al. |
| 7,168,494 | B2 | 1/2007 | Starr et al. |
| 7,174,963 | B2 | 2/2007 | Bertelsen |
| 7,182,135 | B2 | 2/2007 | Szarka |
| 7,188,559 | B1 | 3/2007 | Vecchio |
| 7,210,527 | B2 | 5/2007 | Walker et al. |
| 7,210,533 | B2 | 5/2007 | Starr et al. |
| 7,217,311 | B2 | 5/2007 | Hong et al. |
| 7,234,530 | B2 | 6/2007 | Gass |
| 7,250,188 | B2 | 7/2007 | Dodelet et al. |
| 7,252,162 | B2 | 8/2007 | Akinlade et al. |
| 7,255,172 | B2 | 8/2007 | Johnson |
| 7,255,178 | B2 | 8/2007 | Slup et al. |
| 7,264,060 | B2 | 9/2007 | Wills |
| 7,267,172 | B2 | 9/2007 | Hofman |
| 7,267,178 | B2 | 9/2007 | Krywitsky |
| 7,270,186 | B2 | 9/2007 | Johnson |
| 7,287,592 | B2 | 10/2007 | Surjaatmadja et al. |
| 7,311,152 | B2 | 12/2007 | Howard et al. |
| 7,316,274 | B2 | 1/2008 | Xu et al. |
| 7,320,365 | B2 | 1/2008 | Pia |
| 7,322,412 | B2 | 1/2008 | Badalamenti et al. |
| 7,322,417 | B2 | 1/2008 | Rytlewski et al. |
| 7,325,617 | B2 | 2/2008 | Murray |
| 7,328,750 | B2 | 2/2008 | Swor et al. |
| 7,331,388 | B2 | 2/2008 | Vilela et al. |
| 7,337,854 | B2 | 3/2008 | Horn et al. |
| 7,346,456 | B2 | 3/2008 | Le Bemadjiel |
| 7,350,582 | B2 | 4/2008 | McKeachnie et al. |
| 7,353,867 | B2 | 4/2008 | Carter et al. |
| 7,353,879 | B2 | 4/2008 | Todd et al. |
| 7,360,593 | B2 | 4/2008 | Constien |
| 7,360,597 | B2 | 4/2008 | Blaisdell |
| 7,363,970 | B2 | 4/2008 | Corre et al. |
| 7,373,978 | B2 | 5/2008 | Barry et al. |
| 7,380,600 | B2 | 6/2008 | Willberg et al. |
| 7,384,443 | B2 | 6/2008 | Mirchandani |
| 7,387,158 | B2 | 6/2008 | Murray et al. |
| 7,387,165 | B2 | 6/2008 | Lopez de Cardenas et al. |
| 7,392,841 | B2 | 7/2008 | Murray et al. |
| 7,401,648 | B2 | 7/2008 | Richard |
| 7,416,029 | B2 | 8/2008 | Telfer et al. |
| 7,422,058 | B2 | 9/2008 | O'Malley |
| 7,426,964 | B2 | 9/2008 | Lynde et al. |
| 7,441,596 | B2 | 10/2008 | Wood et al. |
| 7,445,049 | B2 | 11/2008 | Howard et al. |
| 7,451,815 | B2 | 11/2008 | Hailey, Jr. |
| 7,451,817 | B2 | 11/2008 | Reddy et al. |
| 7,461,699 | B2 | 12/2008 | Richard et al. |
| 7,464,752 | B2 | 12/2008 | Dale et al. |
| 7,464,764 | B2 | 12/2008 | Xu |
| 7,472,750 | B2 | 1/2009 | Walker et al. |
| 7,478,676 | B2 | 1/2009 | East, Jr. et al. |
| 7,503,390 | B2 | 3/2009 | Gomez |
| 7,503,392 | B2 | 3/2009 | King et al. |
| 7,503,399 | B2 | 3/2009 | Badalamenti et al. |
| 7,509,993 | B1 | 3/2009 | Turng et al. |
| 7,510,018 | B2 | 3/2009 | Williamson et al. |
| 7,513,311 | B2 | 4/2009 | Gramstad et al. |
| 7,516,791 | B2 | 4/2009 | Bryant et al. |
| 7,527,103 | B2 | 5/2009 | Huang et al. |
| 7,531,020 | B2 | 5/2009 | Woodfield et al. |
| 7,537,825 | B1 | 5/2009 | Wardle et al. |
| 7,552,777 | B2 | 6/2009 | Murray et al. |
| 7,552,779 | B2 | 6/2009 | Murray |
| 7,559,357 | B2 | 7/2009 | Clem |
| 7,575,062 | B2 | 8/2009 | East, Jr. |
| 7,579,087 | B2 | 8/2009 | Maloney et al. |
| 7,591,318 | B2 | 9/2009 | Tilghman |
| 7,600,572 | B2 | 10/2009 | Slup et al. |
| 7,604,049 | B2 | 10/2009 | Vaidya et al. |
| 7,604,055 | B2 | 10/2009 | Richard et al. |
| 7,607,476 | B2 | 10/2009 | Tom et al. |
| 7,617,871 | B2 | 11/2009 | Surjaatmadja et al. |
| 7,635,023 | B2 | 12/2009 | Goldberg et al. |
| 7,640,988 | B2 | 1/2010 | Phi et al. |
| 7,647,964 | B2 | 1/2010 | Akbar et al. |
| 7,661,480 | B2 | 2/2010 | Al-Anazi |
| 7,661,481 | B2 | 2/2010 | Todd et al. |
| 7,665,537 | B2 | 2/2010 | Patel et al. |
| 7,686,082 | B2 | 3/2010 | Marsh |
| 7,690,436 | B2 | 4/2010 | Turley et al. |
| 7,699,101 | B2 | 4/2010 | Fripp et al. |
| 7,703,511 | B2 | 4/2010 | Buyers et al. |
| 7,708,078 | B2 | 5/2010 | Stoesz |
| 7,709,421 | B2 | 5/2010 | Jones et al. |
| 7,712,541 | B2 | 5/2010 | Loretz et al. |
| 7,723,272 | B2 | 5/2010 | Crews et al. |
| 7,726,406 | B2 | 6/2010 | Xu |
| 7,735,578 | B2 | 6/2010 | Loehr et al. |
| 7,743,836 | B2 | 6/2010 | Cook et al. |
| 7,752,971 | B2 | 7/2010 | Loehr |
| 7,757,773 | B2 | 7/2010 | Rytlewski |
| 7,762,342 | B2 | 7/2010 | Richard et al. |
| 7,770,652 | B2 | 8/2010 | Bamett |
| 7,771,289 | B2 | 8/2010 | Palumbo et al. |
| 7,771,547 | B2 | 8/2010 | Bieler et al. |
| 7,775,284 | B2 | 8/2010 | Richard et al. |
| 7,775,285 | B2 | 8/2010 | Surjaatmadja et al. |
| 7,775,286 | B2 | 8/2010 | Duphorne |
| 7,784,543 | B2 | 8/2010 | Johnson |
| 7,793,714 | B2 | 9/2010 | Johnson |
| 7,793,820 | B2 | 9/2010 | Hirano et al. |
| 7,794,520 | B2 | 9/2010 | Murty et al. |
| 7,798,225 | B2 | 9/2010 | Giroux et al. |
| 7,798,226 | B2 | 9/2010 | Themig |
| 7,798,236 | B2 | 9/2010 | McKeachnie et al. |
| 7,806,189 | B2 | 10/2010 | Frazier |
| 7,806,192 | B2 | 10/2010 | Foster et al. |
| 7,810,553 | B2 | 10/2010 | Cruickshank et al. |
| 7,810,567 | B2 | 10/2010 | Daniels et al. |
| 7,819,198 | B2 | 10/2010 | Birckhead et al. |
| 7,828,055 | B2 | 11/2010 | Willauer et al. |
| 7,833,944 | B2 | 11/2010 | Munoz et al. |
| 7,849,927 | B2 | 12/2010 | Herrera |
| 7,851,016 | B2 | 12/2010 | Arbab et al. |
| 7,855,168 | B2 | 12/2010 | Fuller et al. |
| 7,861,779 | B2 | 1/2011 | Vestavik |
| 7,861,781 | B2 | 1/2011 | D'Arcy |
| 7,874,365 | B2 | 1/2011 | East, Jr. et al. |
| 7,878,253 | B2 | 2/2011 | Stowe et al. |
| 7,879,162 | B2 | 2/2011 | Pandey |
| 7,879,367 | B2 | 2/2011 | Heublein et al. |
| 7,896,091 | B2 | 3/2011 | Williamson et al. |
| 7,897,063 | B1 | 3/2011 | Perry et al. |
| 7,900,696 | B1 | 3/2011 | Nish et al. |
| 7,900,703 | B2 | 3/2011 | Clark et al. |
| 7,909,096 | B2 | 3/2011 | Clarke et al. |
| 7,909,104 | B2 | 3/2011 | Bjorgum |
| 7,909,110 | B2 | 3/2011 | Sharma et al. |
| 7,909,115 | B2 | 3/2011 | Grove et al. |
| 7,913,765 | B2 | 3/2011 | Crow et al. |
| 7,918,275 | B2 | 4/2011 | Clem |
| 7,931,093 | B2 | 4/2011 | Foster et al. |
| 7,938,191 | B2 | 5/2011 | Vaidya |
| 7,946,335 | B2 | 5/2011 | Bewlay et al. |
| 7,946,340 | B2 | 5/2011 | Surjattmadja et al. |
| 7,958,940 | B2 | 6/2011 | Jameson |
| 7,963,331 | B2 | 6/2011 | Surjattmadja et al. |
| 7,963,340 | B2 | 6/2011 | Gramstad et al. |
| 7,963,342 | B2 | 6/2011 | George |
| 7,980,300 | B2 | 7/2011 | Roberts et al. |
| 7,987,906 | B1 | 8/2011 | Troy |
| 7,992,763 | B2 | 8/2011 | Vecchio et al. |
| 7,999,987 | B2 | 8/2011 | Dellinger et al. |
| 8,002,821 | B2 | 8/2011 | Stinson |
| 8,020,619 | B1 | 9/2011 | Robertson et al. |
| 8,020,620 | B2 | 9/2011 | Daniels et al. |

(56) References Cited

U.S. PATENT DOCUMENTS

| | | | |
|---|---|---|---|
| 8,025,104 | B2 | 9/2011 | Cooke, Jr. |
| 8,028,767 | B2 | 10/2011 | Radford et al. |
| 8,033,331 | B2 | 10/2011 | Themig |
| 8,034,152 | B2 | 10/2011 | Westin et al. |
| 8,039,422 | B1 | 10/2011 | Al-Zahrani |
| 8,056,628 | B2 | 11/2011 | Whitsitt et al. |
| 8,056,638 | B2 | 11/2011 | Clayton et al. |
| 8,109,340 | B2 | 2/2012 | Doane et al. |
| 8,114,148 | B2 | 2/2012 | Atanasoska et al. |
| 8,127,856 | B1 | 3/2012 | Nish et al. |
| 8,153,052 | B2 | 4/2012 | Jackson et al. |
| 8,163,060 | B2 | 4/2012 | Imanishi et al. |
| 8,211,247 | B2 | 7/2012 | Marya et al. |
| 8,211,248 | B2 | 7/2012 | Marya |
| 8,211,331 | B2 | 7/2012 | Jorgensen et al. |
| 8,220,554 | B2 | 7/2012 | Jordan et al. |
| 8,226,740 | B2 | 7/2012 | Chaumonnot et al. |
| 8,230,731 | B2 | 7/2012 | Dyer et al. |
| 8,231,947 | B2 | 7/2012 | Vaidya et al. |
| 8,263,178 | B2 | 9/2012 | Boulos et al. |
| 8,267,177 | B1 | 9/2012 | Vogel et al. |
| 8,276,670 | B2 | 10/2012 | Patel |
| 8,277,974 | B2 | 10/2012 | Kumar et al. |
| 8,297,364 | B2 | 10/2012 | Agrawal et al. |
| 8,327,931 | B2 | 12/2012 | Agrawal et al. |
| 8,403,037 | B2 | 3/2013 | Agrawal et al. |
| 8,413,727 | B2 | 4/2013 | Holmes |
| 8,425,651 | B2 | 4/2013 | Xu et al. |
| 8,459,347 | B2 | 6/2013 | Stout |
| RE44,385 | E | 7/2013 | Johnson |
| 8,485,265 | B2 | 7/2013 | Marya et al. |
| 8,486,329 | B2 | 7/2013 | Shikai et al. |
| 8,490,674 | B2 | 7/2013 | Stevens et al. |
| 8,490,689 | B1 | 7/2013 | McClinton et al. |
| 8,506,733 | B2 | 8/2013 | Enami et al. |
| 8,528,633 | B2 | 9/2013 | Agrawal et al. |
| 8,535,604 | B1 | 9/2013 | Baker et al. |
| 8,573,295 | B2 | 11/2013 | Johnson et al. |
| 8,579,023 | B1 | 11/2013 | Nish et al. |
| 8,613,789 | B2 | 12/2013 | Han et al. |
| 8,631,876 | B2 | 1/2014 | Xu et al. |
| 8,663,401 | B2 | 3/2014 | Marya et al. |
| 8,668,762 | B2 | 3/2014 | Kim et al. |
| 8,695,684 | B2 | 4/2014 | Chen et al. |
| 8,695,714 | B2 | 4/2014 | Xu |
| 8,714,268 | B2 | 5/2014 | Agrawal et al. |
| 8,715,339 | B2 | 5/2014 | Atanasoska et al. |
| 8,723,564 | B2 | 5/2014 | Kim et al. |
| 8,734,602 | B2 | 5/2014 | Li et al. |
| 8,746,342 | B1 | 6/2014 | Nish et al. |
| 8,770,261 | B2 | 7/2014 | Marya |
| 8,776,884 | B2 | 7/2014 | Xu |
| 8,789,610 | B2 | 7/2014 | Oxford |
| 8,808,423 | B2 | 8/2014 | Kim et al. |
| 8,852,363 | B2 | 10/2014 | Numano et al. |
| 8,905,147 | B2 | 12/2014 | Fripp et al. |
| 8,950,504 | B2 | 2/2015 | Xu et al. |
| 8,956,660 | B2 | 2/2015 | Launag et al. |
| 8,967,275 | B2 | 3/2015 | Crews |
| 8,978,734 | B2 | 3/2015 | Stevens |
| 8,998,978 | B2 | 4/2015 | Wang |
| 9,010,416 | B2 | 4/2015 | Xu et al. |
| 9,016,363 | B2 | 4/2015 | Xu et al. |
| 9,016,384 | B2 | 4/2015 | Xu |
| 9,022,107 | B2 | 5/2015 | Agrawal et al. |
| 9,027,655 | B2 | 5/2015 | Xu |
| 9,033,041 | B2 | 5/2015 | Baihly et al. |
| 9,033,060 | B2 | 5/2015 | Xu et al. |
| 9,044,397 | B2 | 6/2015 | Choi et al. |
| 9,057,117 | B2 | 6/2015 | Harrison et al. |
| 9,057,242 | B2 | 6/2015 | Mazyar et al. |
| 9,068,428 | B2 | 6/2015 | Mazyar et al. |
| 9,010,424 | B2 | 7/2015 | Xu |
| 9,079,246 | B2 | 7/2015 | Xu et al. |
| 9,080,098 | B2 | 7/2015 | Xu et al. |
| 9,080,403 | B2 | 7/2015 | Xu et al. |
| 9,080,439 | B2 | 7/2015 | O'Malley |
| 9,089,408 | B2 | 7/2015 | Xu |
| 9,090,955 | B2 | 7/2015 | Xu et al. |
| 9,090,956 | B2 | 7/2015 | Xu |
| 9,101,978 | B2 | 8/2015 | Xu |
| 9,109,429 | B2 | 8/2015 | Xu et al. |
| 9,119,906 | B2 | 9/2015 | Tomantschager et al. |
| 9,127,515 | B2 | 9/2015 | Xu et al. |
| 9,163,467 | B2 | 10/2015 | Gaudette et al. |
| 9,181,088 | B2 | 11/2015 | Sibuet et al. |
| 9,187,686 | B2 | 11/2015 | Crews |
| 9,211,586 | B1 | 12/2015 | Lavernia et al. |
| 9,217,319 | B2 | 12/2015 | Frazier et al. |
| 9,227,243 | B2 | 1/2016 | Xu et al. |
| 9,243,475 | B2 | 1/2016 | Xu |
| 9,260,935 | B2 | 2/2016 | Murphree et al. |
| 9,284,803 | B2 | 3/2016 | Stone et al. |
| 9,309,733 | B2 | 4/2016 | Xu et al. |
| 9,309,744 | B2 | 4/2016 | Frazier |
| 9,366,106 | B2 | 6/2016 | Xu et al. |
| 9,447,482 | B2 | 9/2016 | Kim et al. |
| 9,458,692 | B2 | 10/2016 | Fripp et al. |
| 9,528,343 | B2 | 12/2016 | Jordan et al. |
| 9,587,156 | B2 | 3/2017 | Crews |
| 9,605,508 | B2 | 3/2017 | Xu |
| 9,643,250 | B2 | 5/2017 | Mazyar et al. |
| 9,682,425 | B2 | 6/2017 | Xu et al. |
| 9,689,227 | B2 | 6/2017 | Fripp et al. |
| 9,689,231 | B2 | 6/2017 | Fripp et al. |
| 9,789,663 | B2 | 10/2017 | Zhang et al. |
| 9,790,763 | B2 | 10/2017 | Fripp et al. |
| 9,802,250 | B2 | 10/2017 | Xu |
| 9,803,439 | B2 | 10/2017 | Xu et al. |
| 9,833,838 | B2 | 12/2017 | Mazyar et al. |
| 9,835,016 | B2 | 12/2017 | Zhang et al. |
| 9,863,201 | B2 | 1/2018 | Fripp et al. |
| 9,925,589 | B2 | 3/2018 | Xu |
| 9,926,763 | B2 | 3/2018 | Mazyar et al. |
| 9,938,451 | B2 | 4/2018 | Crews |
| 9,970,249 | B2 | 5/2018 | Zhang et al. |
| 10,016,810 | B2 | 7/2018 | Salinas et al. |
| 10,059,092 | B2 | 8/2018 | Welch et al. |
| 10,059,867 | B2 | 8/2018 | Crews |
| 10,081,853 | B2 | 9/2018 | Wilks et al. |
| 10,082,008 | B2 | 9/2018 | Robey et al. |
| 10,092,953 | B2 | 10/2018 | Mazyar et al. |
| 10,119,358 | B2 | 11/2018 | Walton et al. |
| 10,125,565 | B2 | 11/2018 | Fripp et al. |
| 10,167,691 | B2 | 1/2019 | Zhang et al. |
| 10,174,578 | B2 | 1/2019 | Walton et al. |
| 10,202,820 | B2 | 2/2019 | Xu et al. |
| 10,221,637 | B2 | 3/2019 | Xu et al. |
| 10,221,641 | B2 | 3/2019 | Zhang et al. |
| 10,221,642 | B2 | 3/2019 | Zhang et al. |
| 10,221,643 | B2 | 3/2019 | Zhang et al. |
| 10,227,841 | B2 | 3/2019 | Fripp et al. |
| 10,253,590 | B2 | 4/2019 | Xu et al. |
| 10,266,923 | B2 | 4/2019 | Wilks et al. |
| 10,316,601 | B2 | 6/2019 | Walton et al. |
| 10,329,643 | B2 | 6/2019 | Wilks et al. |
| 10,335,855 | B2 | 7/2019 | Welch et al. |
| 10,337,086 | B2 | 7/2019 | Wilks et al. |
| 10,344,568 | B2 | 7/2019 | Murphree et al. |
| 10,364,630 | B2 | 7/2019 | Xu et al. |
| 10,364,631 | B2 | 7/2019 | Xu et al. |
| 10,364,632 | B2 | 7/2019 | Xu et al. |
| 10,450,840 | B2 | 10/2019 | Xu |
| 10,472,909 | B2 | 11/2019 | Xu et al. |
| 10,533,392 | B2 | 1/2020 | Walton et al. |
| 10,544,652 | B2 | 1/2020 | Fripp et al. |
| 10,597,965 | B2 | 3/2020 | Allen |
| 10,612,659 | B2 | 4/2020 | Xu et al. |
| 10,619,438 | B2 | 4/2020 | Fripp et al. |
| 10,619,445 | B2 | 4/2020 | Murphree et al. |
| 10,626,695 | B2 | 4/2020 | Fripp et al. |
| 10,633,947 | B2 | 4/2020 | Fripp et al. |
| 10,655,411 | B2 | 5/2020 | Fripp et al. |
| 10,669,797 | B2 | 6/2020 | Johnson et al. |

(56) References Cited

U.S. PATENT DOCUMENTS

| | | | |
|---|---|---|---|
| 10,724,321 | B2 | 7/2020 | Leonard et al. |
| 10,737,321 | B2 | 8/2020 | Xu |
| 10,781,658 | B1 | 9/2020 | Kumar et al. |
| 10,807,355 | B2 | 10/2020 | Welch et al. |
| 2002/0020527 | A1 | 2/2002 | Kilaas et al. |
| 2002/0047058 | A1 | 4/2002 | Verhoff et al. |
| 2002/0092654 | A1 | 7/2002 | Coronado et al. |
| 2002/0104616 | A1 | 8/2002 | De et al. |
| 2002/0108756 | A1 | 8/2002 | Harrall et al. |
| 2002/0121081 | A1 | 9/2002 | Cesaroni et al. |
| 2002/0139541 | A1 | 10/2002 | Sheffield et al. |
| 2002/0197181 | A1 | 12/2002 | Osawa et al. |
| 2003/0019639 | A1 | 1/2003 | Mackay |
| 2003/0060374 | A1 | 3/2003 | Cooke, Jr. |
| 2003/0104147 | A1 | 6/2003 | Bretschneider et al. |
| 2003/0111728 | A1 | 6/2003 | Thai et al. |
| 2003/0127013 | A1 | 7/2003 | Zavitsanos et al. |
| 2003/0141060 | A1 | 7/2003 | Hailey, Jr. et al. |
| 2003/0150614 | A1 | 8/2003 | Brown et al. |
| 2003/0155114 | A1 | 8/2003 | Pedersen et al. |
| 2003/1073005 | | 9/2003 | Higashi |
| 2004/0005483 | A1 | 1/2004 | Lin |
| 2004/0055758 | A1 | 3/2004 | Brezinski et al. |
| 2004/0069502 | A1 | 4/2004 | Luke |
| 2004/0089449 | A1 | 5/2004 | Walton et al. |
| 2004/0094297 | A1 | 5/2004 | Malone et al. |
| 2004/0154806 | A1 | 8/2004 | Bode et al. |
| 2004/0159446 | A1 | 8/2004 | Haugen et al. |
| 2004/0216868 | A1 | 11/2004 | Owens, Sr. |
| 2004/0231845 | A1 | 11/2004 | Cooke, Jr. |
| 2004/0244968 | A1 | 12/2004 | Cook et al. |
| 2004/0256109 | A1 | 12/2004 | Johnson |
| 2004/0261993 | A1 | 12/2004 | Nguyen |
| 2004/0261994 | A1 | 12/2004 | Nguyen et al. |
| 2005/0064247 | A1 | 3/2005 | Sane et al. |
| 2005/0074612 | A1 | 4/2005 | Eklund et al. |
| 2005/0098313 | A1 | 5/2005 | Atkins et al. |
| 2005/0102255 | A1 | 5/2005 | Bultman |
| 2005/0106316 | A1 | 5/2005 | Rigney et al. |
| 2005/0161212 | A1 | 7/2005 | Leismer et al. |
| 2005/0165149 | A1 | 7/2005 | Chanak et al. |
| 2005/0194141 | A1 | 9/2005 | Sinclair et al. |
| 2005/0235757 | A1 | 10/2005 | De Jonge et al. |
| 2005/0241824 | A1 | 11/2005 | Burris, II et al. |
| 2005/0241825 | A1 | 11/2005 | Burris, II et al. |
| 2005/0268746 | A1 | 12/2005 | Abkowitz et al. |
| 2005/0269097 | A1 | 12/2005 | Towler |
| 2005/0275143 | A1 | 12/2005 | Toth |
| 2005/0279427 | A1 | 12/2005 | Park et al. |
| 2005/0279501 | A1 | 12/2005 | Surjaatmadja et al. |
| 2006/0012087 | A1 | 1/2006 | Matsuda et al. |
| 2006/0013350 | A1 | 1/2006 | Akers |
| 2006/0057479 | A1 | 3/2006 | Niimi et al. |
| 2006/0102871 | A1 | 5/2006 | Wang et al. |
| 2006/0108114 | A1 | 5/2006 | Johnson |
| 2006/0110615 | A1 | 5/2006 | Karim et al. |
| 2006/0113077 | A1 | 6/2006 | Willberg et al. |
| 2006/0116696 | A1 | 6/2006 | Odermatt et al. |
| 2006/0131031 | A1 | 6/2006 | McKeachnie |
| 2006/0131081 | A1 | 6/2006 | Mirchandani et al. |
| 2006/0144515 | A1 | 7/2006 | Tada et al. |
| 2006/0150770 | A1 | 7/2006 | Freim, III et al. |
| 2006/0153728 | A1 | 7/2006 | Schoenung et al. |
| 2006/0169453 | A1 | 8/2006 | Savery et al. |
| 2006/0175059 | A1 | 8/2006 | Sinclair et al. |
| 2006/0186602 | A1 | 8/2006 | Martin et al. |
| 2006/0207387 | A1 | 9/2006 | Soran et al. |
| 2006/0269437 | A1 | 11/2006 | Pandey |
| 2006/0278405 | A1 | 12/2006 | Turley |
| 2006/0283592 | A1 | 12/2006 | Sierra et al. |
| 2007/0017675 | A1 | 1/2007 | Hammami et al. |
| 2007/0134496 | A1 | 1/2007 | Katagiri et al. |
| 2007/0039161 | A1 | 2/2007 | Garcia |
| 2007/0044958 | A1 | 3/2007 | Rytlewski et al. |
| 2007/0044966 | A1 | 3/2007 | Davies et al. |
| 2007/0051521 | A1 | 3/2007 | Fike et al. |
| 2007/0053785 | A1 | 3/2007 | Hetz et al. |
| 2007/0054101 | A1 | 3/2007 | Sigalas et al. |
| 2007/0057415 | A1 | 3/2007 | Katagiri et al. |
| 2007/0062644 | A1 | 3/2007 | Nakamura et al. |
| 2007/0102199 | A1 | 5/2007 | Smith et al. |
| 2007/0107899 | A1 | 5/2007 | Werner et al. |
| 2007/0108060 | A1 | 5/2007 | Park |
| 2007/0131912 | A1 | 6/2007 | Simone et al. |
| 2007/0151009 | A1 | 7/2007 | Conrad, III et al. |
| 2007/0151769 | A1 | 7/2007 | Slutz et al. |
| 2007/0181224 | A1 | 8/2007 | Marya et al. |
| 2007/0187095 | A1 | 8/2007 | Walker et al. |
| 2007/0207182 | A1 | 9/2007 | Weber et al. |
| 2007/0221373 | A1 | 9/2007 | Murray |
| 2007/0227745 | A1 | 10/2007 | Roberts et al. |
| 2007/0259994 | A1 | 11/2007 | Tour et al. |
| 2007/0270942 | A1 | 11/2007 | Thomas |
| 2007/0284112 | A1 | 12/2007 | Magne et al. |
| 2007/0299510 | A1 | 12/2007 | Venkatraman et al. |
| 2008/0011473 | A1 | 1/2008 | Wood et al. |
| 2008/0020923 | A1 | 1/2008 | Debe et al. |
| 2008/0041500 | A1 | 2/2008 | Bronfin |
| 2008/0047707 | A1 | 2/2008 | Boney et al. |
| 2008/0060810 | A9 | 3/2008 | Nguyen et al. |
| 2008/0081866 | A1 | 4/2008 | Gong et al. |
| 2008/0093073 | A1 | 4/2008 | Bustos et al. |
| 2008/0121436 | A1 | 5/2008 | Slay et al. |
| 2008/0127475 | A1 | 6/2008 | Griffo |
| 2008/0149325 | A1 | 6/2008 | Crawford |
| 2008/0149345 | A1 | 6/2008 | Marya et al. |
| 2008/0149351 | A1 | 6/2008 | Marya et al. |
| 2008/0169130 | A1 | 7/2008 | Norman et al. |
| 2008/0175744 | A1 | 7/2008 | Motegi |
| 2008/0179104 | A1 | 7/2008 | Zhang et al. |
| 2008/0196801 | A1 | 8/2008 | Zhao et al. |
| 2008/0202764 | A1 | 8/2008 | Clayton et al. |
| 2008/0202814 | A1 | 8/2008 | Lyons et al. |
| 2008/0210473 | A1 | 9/2008 | Zhang et al. |
| 2008/0216383 | A1 | 9/2008 | Pierick et al. |
| 2008/0220991 | A1 | 9/2008 | Slay et al. |
| 2008/0223587 | A1 | 9/2008 | Cherewyk |
| 2008/0236829 | A1 | 10/2008 | Lynde |
| 2008/0236842 | A1 | 10/2008 | Bhavsar et al. |
| 2008/0248205 | A1 | 10/2008 | Blanchet et al. |
| 2008/0248413 | A1 | 10/2008 | Ishii et al. |
| 2008/0264205 | A1 | 10/2008 | Zeng et al. |
| 2008/0264594 | A1 | 10/2008 | Lohmueller et al. |
| 2008/0277980 | A1 | 11/2008 | Koda et al. |
| 2008/0282924 | A1 | 11/2008 | Saenger et al. |
| 2008/0296024 | A1 | 12/2008 | Huang et al. |
| 2008/0302538 | A1 | 12/2008 | Hofman |
| 2008/0314581 | A1 | 12/2008 | Brown |
| 2008/0314588 | A1 | 12/2008 | Langlais et al. |
| 2009/0038858 | A1 | 2/2009 | Griffo et al. |
| 2009/0044946 | A1 | 2/2009 | Shasteen et al. |
| 2009/0044955 | A1 | 2/2009 | King et al. |
| 2009/0050334 | A1 | 2/2009 | Marya et al. |
| 2009/0056934 | A1 | 3/2009 | Xu |
| 2009/0065216 | A1 | 3/2009 | Frazier |
| 2009/0068051 | A1 | 3/2009 | Gross |
| 2009/0074603 | A1 | 3/2009 | Chan et al. |
| 2009/0084600 | A1 | 4/2009 | Severance |
| 2009/0090440 | A1 | 4/2009 | Kellett |
| 2009/0107684 | A1 | 4/2009 | Cooke, Jr. |
| 2009/0114381 | A1 | 5/2009 | Stroobants |
| 2009/0116992 | A1 | 5/2009 | Lee |
| 2009/0126436 | A1 | 5/2009 | Fly et al. |
| 2009/0151949 | A1 | 6/2009 | Marya et al. |
| 2009/0152009 | A1 | 6/2009 | Slay et al. |
| 2009/0155616 | A1 | 6/2009 | Thamida |
| 2009/0159289 | A1 | 6/2009 | Avant et al. |
| 2009/0194745 | A1 | 8/2009 | Tanaka |
| 2009/0205841 | A1 | 8/2009 | Kluge et al. |
| 2009/0211770 | A1 | 8/2009 | Nutley et al. |
| 2009/0226340 | A1 | 9/2009 | Marya |
| 2009/0226704 | A1 | 9/2009 | Kauppinen et al. |
| 2009/0242202 | A1 | 10/2009 | Rispler et al. |
| 2009/0242208 | A1 | 10/2009 | Bolding |

(56) References Cited

U.S. PATENT DOCUMENTS

2009/0255667 A1 10/2009 Clem et al.
2009/0255684 A1 10/2009 Bolding
2009/0255686 A1 10/2009 Richard et al.
2009/0260817 A1 10/2009 Gambier et al.
2009/0266548 A1 10/2009 Olsen et al.
2009/0272544 A1 11/2009 Giroux et al.
2009/0283270 A1 11/2009 Langeslag
2009/0293672 A1 12/2009 Mirchandani et al.
2009/0301730 A1 12/2009 Gweily
2009/0308588 A1 12/2009 Howell et al.
2009/0317556 A1 12/2009 Macary
2009/0317622 A1 12/2009 Huang et al.
2010/0003536 A1 1/2010 Smith et al.
2010/0012385 A1 1/2010 Drivdahl et al.
2010/0015002 A1 1/2010 Barrera et al.
2010/0015469 A1 1/2010 Romanowski
2010/0025255 A1 2/2010 Su et al.
2010/0038076 A1 2/2010 Spray et al.
2010/0038595 A1 2/2010 Imholt et al.
2010/0040180 A1 2/2010 Kim et al.
2010/0044041 A1 2/2010 Smith et al.
2010/0051278 A1 3/2010 Mytopher et al.
2010/0055492 A1 3/2010 Baroum et al.
2010/0089583 A1 4/2010 Xu et al.
2010/0116495 A1 5/2010 Spray
2010/0119405 A1 5/2010 Okamoto et al.
2010/0139930 A1 6/2010 Patel et al.
2010/0161031 A1 6/2010 Papirov et al.
2010/0200230 A1 8/2010 East, Jr. et al.
2010/0236793 A1 9/2010 Bjorgum
2010/0236794 A1 9/2010 Duan et al.
2010/0243254 A1 9/2010 Murphy et al.
2010/0252273 A1 10/2010 Duphorne
2010/0252280 A1 10/2010 Swor et al.
2010/0270031 A1 10/2010 Patel
2010/0276136 A1 11/2010 Evans et al.
2010/0276159 A1 11/2010 Mailand et al.
2010/0282338 A1 11/2010 Gerrard et al.
2010/0282469 A1 11/2010 Richard et al.
2010/0297432 A1 11/2010 Sherman et al.
2010/0304178 A1 12/2010 Dirscherl
2010/0304182 A1 12/2010 Facchini et al.
2010/0314105 A1 12/2010 Rose
2010/0314127 A1 12/2010 Swor et al.
2010/0319427 A1 12/2010 Lohbeck et al.
2010/0326650 A1 12/2010 Tran et al.
2011/0005773 A1 1/2011 Dusterhoft et al.
2011/0036592 A1 2/2011 Fay
2011/0048743 A1 3/2011 Stafford et al.
2011/0052805 A1 3/2011 Bordere et al.
2011/0067872 A1 3/2011 Agrawal
2011/0067889 A1 3/2011 Marya et al.
2011/0091660 A1 4/2011 Dirscherl
2011/0094406 A1 4/2011 Marya et al.
2011/0135530 A1 6/2011 Xu et al.
2011/0135805 A1 6/2011 Doucet et al.
2011/0139465 A1 6/2011 Tibbles et al.
2011/0147014 A1 6/2011 Chen et al.
2011/0186306 A1 8/2011 Marya et al.
2011/0192613 A1 8/2011 Garcia et al.
2011/0214881 A1 9/2011 Newton et al.
2011/0221137 A1 9/2011 Obi et al.
2011/0236249 A1 9/2011 Kim et al.
2011/0247833 A1 10/2011 Todd et al.
2011/0253387 A1 10/2011 Ervin
2011/0259610 A1 10/2011 Shkurti et al.
2011/0277987 A1 11/2011 Frazier
2011/0277989 A1 11/2011 Frazier
2011/0277996 A1 11/2011 Cullick et al.
2011/0284232 A1 11/2011 Huang
2011/0284240 A1 11/2011 Chen et al.
2011/0284243 A1 11/2011 Frazier
2011/0300403 A1 12/2011 Vecchio et al.
2011/0314881 A1 12/2011 Hatcher et al.
2012/0046732 A1 2/2012 Sillekens et al.
2012/0067426 A1 3/2012 Soni et al.
2012/0080189 A1 4/2012 Marya et al.
2012/0090839 A1 4/2012 Rudic
2012/0097384 A1 4/2012 Valencia et al.
2012/0103135 A1 5/2012 Xu et al.
2012/0125642 A1 5/2012 Chenault
2012/0130470 A1 5/2012 Agnew et al.
2012/0145378 A1 6/2012 Frazier
2012/0145389 A1 6/2012 Fitzpatrick, Jr.
2012/0156087 A1 6/2012 Kawabata
2012/0168152 A1 7/2012 Casciaro
2012/0177905 A1 7/2012 Seals et al.
2012/0190593 A1 7/2012 Soane et al.
2012/0205120 A1 8/2012 Howell
2012/0205872 A1 8/2012 Reinhardt et al.
2012/0211239 A1 8/2012 Kritzler et al.
2012/0234546 A1 9/2012 Xu
2012/0234547 A1 9/2012 O'Malley et al.
2012/0247765 A1 10/2012 Agrawal et al.
2012/0267101 A1 10/2012 Cooke, Jr.
2012/0269673 A1 10/2012 Koo et al.
2012/0273229 A1 11/2012 Xu et al.
2012/0318513 A1 12/2012 Mazyar et al.
2013/0000985 A1 1/2013 Agrawal et al.
2013/0008671 A1 1/2013 Booth
2013/0017610 A1 1/2013 Roberts et al.
2013/0022816 A1 1/2013 Smith et al.
2013/0029886 A1 1/2013 Mazyar et al.
2013/0032357 A1 2/2013 Mazyar et al.
2013/0043041 A1 2/2013 McCoy et al.
2013/0047785 A1 2/2013 Xu
2013/0052472 A1 2/2013 Xu
2013/0056215 A1 3/2013 Crews
2013/0068411 A1 3/2013 Forde et al.
2013/0068461 A1 3/2013 Maerz et al.
2013/0084643 A1 4/2013 Commarieu et al.
2013/0105159 A1 5/2013 Alvarez et al.
2013/0112429 A1 5/2013 Crews
2013/0126190 A1 5/2013 Mazyar et al.
2013/0133897 A1 5/2013 Bailhly et al.
2013/0144290 A1 6/2013 Schiffl et al.
2013/0146144 A1 6/2013 Joseph et al.
2013/0160992 A1 6/2013 Agrawal et al.
2013/0167502 A1 7/2013 Wilson et al.
2013/0168257 A1 7/2013 Mazyar et al.
2013/0186626 A1 7/2013 Aitken et al.
2013/0199800 A1 8/2013 Kellner et al.
2013/0209308 A1 8/2013 Mazyar et al.
2013/2200496 8/2013 Bang
2013/0240200 A1 9/2013 Frazier
2013/0240203 A1 9/2013 Frazier
2013/0261735 A1 10/2013 Pacetti et al.
2013/0277044 A1 10/2013 King et al.
2013/0310961 A1 11/2013 Intriago Velez
2013/0048289 A1 12/2013 Mazyar
2013/0319668 A1 12/2013 Tschetter et al.
2013/0327540 A1 12/2013 Hamid et al.
2014/0018489 A1 1/2014 Johnson
2014/0020712 A1 1/2014 Benson
2014/0027128 A1 1/2014 Johnson
2014/0060834 A1 3/2014 Quintero
2014/0093417 A1 4/2014 Liu
2014/0110112 A1 4/2014 Jordan, Jr.
2014/0116711 A1 5/2014 Tang
2014/0124216 A1 5/2014 Fripp et al.
2014/0154341 A1 6/2014 Manuel et al.
2014/0186207 A1 7/2014 Bae et al.
2014/0190705 A1 7/2014 Fripp
2014/0196889 A1 7/2014 Jordan et al.
2014/0202284 A1 7/2014 Kim
2014/0202708 A1 7/2014 Jacob et al.
2014/0219861 A1 8/2014 Han
2014/0224477 A1 8/2014 Wiese et al.
2014/0236284 A1 8/2014 Stinson
2014/0271333 A1 9/2014 Kim et al.
2014/0286810 A1 9/2014 Marya
2014/0305627 A1 10/2014 Manke
2014/0311731 A1 10/2014 Smith
2014/0311752 A1 10/2014 Streich et al.

(56) References Cited

U.S. PATENT DOCUMENTS

| | | | |
|---|---|---|---|
| 2014/0360728 | A1 | 12/2014 | Tashiro et al. |
| 2014/0374086 | A1 | 12/2014 | Agrawal et al. |
| 2015/0060085 | A1 | 3/2015 | Xu |
| 2015/0065401 | A1 | 3/2015 | Xu et al. |
| 2015/0102179 | A1 | 4/2015 | McHenry et al. |
| 2015/0184485 | A1 | 7/2015 | Xu et al. |
| 2015/0240337 | A1 | 8/2015 | Sherman et al. |
| 2015/0247376 | A1 | 9/2015 | Tolman et al. |
| 2015/0299838 | A1 | 10/2015 | Doud |
| 2015/0354311 | A1 | 12/2015 | Okura et al. |
| 2016/0024619 | A1 | 1/2016 | Wilkes et al. |
| 2016/0128849 | A1 | 5/2016 | Yan et al. |
| 2016/0201425 | A1 | 7/2016 | Walton |
| 2016/0201427 | A1 | 7/2016 | Fripp |
| 2016/0201435 | A1 | 7/2016 | Fripp et al. |
| 2016/0209391 | A1 | 7/2016 | Zhang et al. |
| 2016/0230494 | A1 | 8/2016 | Fripp et al. |
| 2016/0251934 | A1 | 9/2016 | Walton et al. |
| 2016/0258242 | A1 | 9/2016 | Hayter et al. |
| 2016/0265091 | A1 | 9/2016 | Walton et al. |
| 2016/0272882 | A1 | 9/2016 | Stray et al. |
| 2016/0279709 | A1 | 9/2016 | Xu et al. |
| 2017/0050159 | A1 | 2/2017 | Xu et al. |
| 2017/0266923 | A1 | 9/2017 | Guest et al. |
| 2017/0356266 | A1 | 12/2017 | Arackakudiyil et al. |
| 2018/0010217 | A1 | 1/2018 | Wilks et al. |
| 2018/0023359 | A1 | 1/2018 | Xu |
| 2018/0178289 | A1 | 6/2018 | Xu et al. |
| 2018/0187510 | A1 | 7/2018 | Xu et al. |
| 2018/0216431 | A1 | 8/2018 | Walton et al. |
| 2018/0274317 | A1 | 9/2018 | Hall |
| 2019/0054523 | A1 | 2/2019 | Wolf et al. |
| 2019/0093450 | A1 | 3/2019 | Walton et al. |
| 2019/0203563 | A1 | 7/2019 | Gano et al. |
| 2019/0249510 | A1 | 8/2019 | Deng et al. |

FOREIGN PATENT DOCUMENTS

| | | | |
|---|---|---|---|
| CA | 2886988 | | 10/2015 |
| CN | 1076968 | | 10/1993 |
| CN | 1079234 | | 12/1993 |
| CN | 1255879 | | 6/2000 |
| CN | 1668545 | | 9/2005 |
| CN | 1882759 | | 12/2006 |
| CN | 101050417 | | 10/2007 |
| CN | 101351523 | | 1/2009 |
| CN | 101381829 | | 3/2009 |
| CN | 101392345 | | 3/2009 |
| CN | 101454074 | | 6/2009 |
| CN | 101457321 | | 6/2009 |
| CN | 101605963 | | 12/2009 |
| CN | 101720378 | | 6/2010 |
| CN | 102517489 | | 6/2012 |
| CN | 102796928 | | 11/2012 |
| CN | 103343271 | | 10/2013 |
| CN | 103343271 | A * | 10/2013 |
| CN | 103602865 | | 2/2014 |
| CN | 103898384 | | 7/2014 |
| CN | 104004950 | | 8/2014 |
| CN | 104152775 | | 11/2014 |
| CN | 104480354 | | 4/2015 |
| CN | 201532089 | | 4/2015 |
| CN | 104651691 | | 5/2015 |
| CN | 10577976 | | 7/2016 |
| CN | 106086559 | | 11/2016 |
| EA | 200600343 | | 6/2006 |
| EA | 200870227 | | 2/2009 |
| EP | 0033625 | | 8/1981 |
| EP | 0400574 | | 5/1990 |
| EP | 0470599 | | 2/1998 |
| EP | 1006258 | | 1/2000 |
| EP | 1174385 | | 1/2002 |
| EP | 1412175 | | 4/2004 |
| EP | 1493517 | | 1/2005 |
| EP | 1798301 | | 6/2007 |
| EP | 1857570 | | 11/2007 |
| EP | 2088217 | | 8/2009 |
| GB | 912956 | | 12/1962 |
| GB | 1046330 | | 10/1966 |
| GB | 1280833 | | 7/1972 |
| GB | 1357065 | | 6/1974 |
| GB | 2095288 | | 9/1982 |
| GB | 2529062 | | 2/2016 |
| JP | H10147830 | | 6/1998 |
| JP | 2000073152 | | 3/2000 |
| JP | 2000185725 | | 7/2000 |
| JP | 2002053902 | | 2/2002 |
| JP | 2004154837 | | 6/2004 |
| JP | 2004225084 | | 8/2004 |
| JP | 2004225765 | | 8/2004 |
| JP | 2005076052 | | 3/2005 |
| JP | 2008266734 | | 11/2008 |
| JP | 2008280565 | | 11/2008 |
| JP | 2009144207 | | 7/2009 |
| JP | 2010502840 | | 1/2010 |
| JP | 2012197491 | | 10/2012 |
| JP | 2013019030 | | 1/2013 |
| JP | 2014043601 | | 3/2014 |
| KR | 20130023707 | | 3/2013 |
| RU | 2373375 | | 7/2006 |
| WO | 9111587 | | 8/1881 |
| WO | 1990002655 | | 3/1990 |
| WO | 1992013978 | | 8/1992 |
| WO | 9857347 | | 12/1998 |
| WO | 9909227 | | 2/1999 |
| WO | 1999027146 | | 6/1999 |
| WO | 9947726 | | 9/1999 |
| WO | 2001001087 | | 1/2001 |
| WO | 2004001087 | | 12/2003 |
| WO | 2004073889 | | 9/2004 |
| WO | 2005065281 | | 7/2005 |
| WO | 2007044635 | | 4/2007 |
| WO | 2007095376 | | 8/2007 |
| WO | 2008017156 | | 2/2008 |
| WO | 2008034042 | | 3/2008 |
| WO | 2008057045 | | 5/2008 |
| WO | 2008079485 | | 7/2008 |
| WO | 2008079777 | | 7/2008 |
| WO | 2008142129 | | 11/2008 |
| WO | 2009055354 | | 4/2009 |
| WO | 2009079745 | | 7/2009 |
| WO | 2009093420 | | 7/2009 |
| WO | 2010012184 | | 2/2010 |
| WO | 2010038016 | | 4/2010 |
| WO | 2010083826 | | 7/2010 |
| WO | 2010110505 | | 9/2010 |
| WO | 2011071902 | | 6/2011 |
| WO | 2011071907 | | 6/2011 |
| WO | 2011071910 | | 6/2011 |
| WO | 2011130063 | | 10/2011 |
| WO | 2012015567 | | 2/2012 |
| WO | 2012071449 | | 5/2012 |
| WO | 2012091984 | | 7/2012 |
| WO | 2012149007 | | 11/2012 |
| WO | 2012164236 | | 12/2012 |
| WO | 2012174101 | | 12/2012 |
| WO | 2012175665 | | 12/2012 |
| WO | 2013019410 | | 2/2013 |
| WO | 2013019421 | | 2/2013 |
| WO | 2013053057 | | 4/2013 |
| WO | 2013078031 | | 5/2013 |
| WO | 2013109287 | | 7/2013 |
| WO | 2013122712 | | 8/2013 |
| WO | 201354634 | | 10/2013 |
| WO | 2014100141 | | 6/2014 |
| WO | 2014113058 | | 7/2014 |
| WO | 2014121384 | | 8/2014 |
| WO | 2014210283 | | 12/2014 |
| WO | 2015142862 | | 9/2015 |
| WO | 2015171126 | | 11/2015 |
| WO | 2015171585 | | 11/2015 |
| WO | 2016024974 | | 2/2016 |
| WO | 2016032490 | | 3/2016 |
| WO | 2016032493 | | 3/2016 |

(56) References Cited

FOREIGN PATENT DOCUMENTS

| | | |
|---|---|---|
| WO | 2016032620 | 3/2016 |
| WO | 2016032621 | 3/2016 |
| WO | 2016032758 | 3/2016 |
| WO | 2016032761 | 3/2016 |
| WO | 2016036371 | 3/2016 |
| WO | 2016085798 | 6/2016 |
| WO | 2016165041 | 10/2016 |
| WO | 2020018110 | 1/2020 |
| WO | 2020109770 | 6/2020 |

OTHER PUBLICATIONS

Saravanan et al., "Fabrication and characterization of pure magnesium-30 vol. SiCP particle composite", Material Science and Eng., vol. 276, pp. 108-116 (2000).
Song et al., Texture evolution and mechanical properties of AZ31B magnesium alloy sheets processed by repeated unidirectional bending, Journal of Alloys and Compounds, vol. 489, pp. 475-481 (2010).
Blawert et al., "Magnesium secondary alloys: Alloy design for magnesium alloys with improved tolerance limits against impurities", Corrosion Science, vol. 52, No. 7, pp. 2452-2468 (Jul. 1, 2010).
Wang et al., "Effect of Ni on microstructures and mechanical properties of AZ1 02 magnesium alloys" Zhuzao Foundry, Shenyang Zhuzao Yanjiusuo, vol. 62, No. 1, pp. 315-318 (Jan. 1, 2013).
Kim et al., "Effect of aluminum on the corrosions characteristics of Mg—4Ni—xAl alloys", Corrosion, vol. 59, No. 3, pp. 228-237 (Jan. 1, 2003).
Unsworth et al., "A new magnesium alloy system", Light Metal Age, vol. 37, No. 7-8., pp. 29-32 (Jan. 1, 1979).
Geng et al., "Enhanced age-hardening response of Mg—Zn alloys via Co additions", Scripta Materialia, vol. 64, No. 6, pp. 506-509 (Mar. 1, 2011).
Zhu et al., "Microstructure and mechanical properties of Mg6ZnCuO. 6Zr (wt.%) alloys", Journal of Alloys and Compounds, vol. 509, No. 8, pp. 3526-3531 (Dec. 22, 2010).
International Search Authority, International Search Report and Written Opinion for PCT/GB2015/052169 (dated Feb. 17, 2016).
Search and Examination Report for GB 1413327.6 (dated Jan. 21, 2015).
Magnesium Elektron Test Report (Mar. 8, 2005).
New England Fishery Management Counsel, "Fishery Management Plan for American Lobster Amendment 3" (Jul. 1989).
Emly, E.F., "Principles of Magnesium Technology" Pergamon Press, Oxford (1966).
Shaw, "Corrosion Resistance of Magnesium Alloys", ASM Handbook, vol. 13A, pp. 692-696 (2003).
Hanawalt et al., "Corrosion studies of magnesium and its alloys", Metals Technology, Technical Paper 1353 (1941).
The American Foundry Society, Magnesium alloys, casting source directory 8208, available at www.afsinc.org/files/magnes.pdf.
Rokhlin, "Magnesium alloys containing rare earth metals structure and properties", Advances in Metallic Alloys, vol. 3, Taylor & Francis (2003).
Ghali, "Corrosion Resistance of Aluminum and Magnesium Alloys" pp. 382-389, Wiley Publishing (2010).
Kim et al., "High Mechanical Strengths of Mg—Ni—Y and MG—Cu Amorphous Alloys with Significant Supercooled Liquid Region", Materials Transactions, vol. 31, No. 11, pp. 929-934 (1990).
Tekumalla et al., "Mehcanical Properties of Magnesium-Rare Earth Alloy Systems", Metals, vol. 5, pp. 1-39 (2014).
Corrected (Non-Truncated) Machine Translation of CN103898384 (originally submitted in Information Disclosure Statement filed Aug. 19, 2020).
Corrected (Non-Truncated) Machine Translation of KR 20130023707 (originally cited in Information Disclosure Statement filed Aug. 19, 2020).
Corrected (Non-Truncated) Machine Translation of CN 103602865 (originally cited in Information Disclosure Statement filed Aug. 19, 2020).
Corrected (Non-Truncated) Machine Translation of CN101381829 (originally cited in Information Disclosure Statement filed Aug. 19, 2020).
Corrected (Non-Truncated) Machine Translation of CN102518489 (originally cited in Information Disclosure Statement filed Aug. 19, 2020).
Corrected (Non-Truncated) Machine Translation of CN 103343271 (originally cited in Information Disclosure Statement filed Aug. 19, 2020).
Corrected (Non-Truncated) Machine Translation of CN 102796928 (originally cited in Information Disclosure Statement filed Aug. 19, 2020).
Corrected (Non-Truncated) Machine Translation of JP2008266734 (originally cited in Information Disclosure Statement filed Aug. 19, 2020 ).
Corrected (Non-Truncated) Machine Translation of JP2012197491 (originally cited in Information Disclosure Statement filed Aug. 19, 2020).
Corrected (Non-Truncated) Machine Translation of JP2013019030 (originally cited in Information Disclosure Statement filed Aug. 19, 2020).
Corrected (Non-Truncated) Machine Translation of JP2014043601 (originally cited in Information Disclosure Statement filed Aug. 19, 2020).
Corrected (Non-Truncated) Machine Translation of CN104004950 (originally cited in Information Disclosure Statement filed Aug. 19, 2020).
Corrected (Non-Truncated) Machine Translation of CN104651691 (originally cited in Information Disclosure Statement filed Aug. 19, 2020).
Ye et al., "Review of recent studies in magnesium matrix composites", Journal of Material Science, vol. 39, pp. 6153-6171 (2004).
Hassan et al., "Development of a novel magnesium-copper based composite with improved mechanical properties", Materials Research Bulletin, vol. 37, pp. 377-389 (2002).
Ye et al., "Microstructure and tensile properties of Ti6A14V/AM60B magnesium matrix composite", Journal of Alloys and Composites, vol. 402, pp. 162-169 (2005).
Kumar et al., "Mechanical and Tribological Behavior of Particulate Reinforced Aluminum metal Matrix Composite", Journal of Minerals & Materials Characterization and Engineering, vol. 10, pp. 59-91 (2011).
Majumdar, "Micromechanics of Discontinuously Reinforced MMCs", Engineering Mechanics and Analysis of Metal-Matrix Composites, vol. 21, pp. 395-406.
Machine Translation of CN103898384 (originally cited in Information Disclosure Statement filed Jun. 24, 2020).
Machine Translation of KR 20130023707 (originally cited in Information Disclosure Statement filed Jun. 24, 2020).
Machine Translation of CN103602865 (originally cited in Information Disclosure Statement filed Jun. 24, 2020).
Machine Translation of CN101381829 (originally cited in Information Disclosure Statement filed Jun. 23, 2020).
Machine Translation of CN102518489 (originally cited in Information Disclosure Statement filed Jun. 23, 2020).
Machine Translation of CN 103343271 (originally cited in Information Disclosure Statement filed Jun. 23, 2020).
Machine Translation of CN102796928 (originally cited in Information Disclosure Statement filed Jun. 23, 2020).
Machine Translation of JP2008266734 (originally cited in Information Disclosure Statement filed Jun. 23, 2020).
Machine Translation of JP2012197491 (originally cited in Information Disclosure Statement filed Jun. 23, 2020).
Machine Translation of JP2013019030 (originally cited in Information Disclosure Statement filed Jun. 23, 2020).
Machine Translation of JP2014043601 (originally cited in Information Disclosure Statement filed Jun. 23, 2020).
Machine Translation of CN10465191.
Machine Translation of CN 104004950.

(56) References Cited

OTHER PUBLICATIONS

Hassan et al., "Development of high strength magnesium based composites using elemental nickel particulates as reinforcement", Journal of Materials Science, vol. 37, pp. 2467-2474 (2002).
Metals Handbook, Desk Edition, edited by J.R. Davis, published by ASM International, pp. 559-574 (1998).
Sigworth et al. "Grain Refinement of Aluminum Castings Alloys" American Foundry Society; Paper 07-67; pp. 5-7 (2007).
Momentive, "Titanium Diborid Powder" condensed product brochure; retrieved from https:/www.momentive.com/WorkArea/DownloadAsset.aspx?id+27489.; p. 1 (2012).
Durbin, "Modeling Dissolution in Aluminum Alloys" Dissertation for Georgia Institute of Technology; retrieved from https://smartech;gatech/edu/bitstream/handle/1853/6873/durbin_tracie_L_20- 0505_phd.pdf> (2005).
Pegeut et al.., "Influence of cold working on the pitting corrosion resistance of stainless steel" Corrosion Science, vol. 49, pp. 1933-1948 (2007).
Elemental Charts from chemicalelements.com; retrieved Jul. 27, 2017.
Song et al., "Corrosion Mechanisms of Magnesium Alloys" Advanced Engg Materials, vol. 1, No. 1 (1999).
Zhou et al., "Tensile Mechanical Properties and Strengthening Mechanism of Hybrid Carbon Nanotubes . . . " Journal of Nanomaterials, 2012; 2012:851862 (doi: 10.1155/2012/851862) Figs. 6 and 7.
Trojanova et al., "Mechanical and Acoustic Properties of Magnesium Alloys . . . " Light Metal Alloys Application, Chapter 8, Published Jun. 11, 2014 (doi: 10.5772/57454) p. 163, para. [0008], [0014-0015]; [0041-0043].
AZoNano "Silicon Carbide Nanoparticles-Properties, Applications" http://www.amazon.com/articles.aspx?ArticleD=3396) p. 2, Physical Properties, Thermal Properties (May 9, 2013).
AZoM "Magnesium AZ91D-F Alloy" http://www.amazon.com/articles.aspx?ArticleD=8670) p. 1, Chemical Composition; p. 2 Physical Properties (Jul. 31, 2013.
Elasser et al., "Silicon Carbide Benefits and Advantages . . . " Proceedings of the IEEE, 2002; 906(6):969-986 (doi: 10.1109/JPROC.2002.1021562) p. 970, Table 1.
Lan et al., "Microstructure and Microhardness of SiC Nanoparticles . . . " Materials Science and Engineering A; 386:284-290 (2004).
Casati et al., "Metal Matrix Composites Reinforced by Nanoparticles", vol. 4:65-83 (2014).
Scharf et al., "Corrosion of AX 91 Secondary Magnesiunm Alloy", Advanced Engineering Materials, vol. 7, No. 12, pp. 1134-1142 (2005).
Hillis et al., "High Purity Magnesium AM60 Alloy: The Critical Contaminant Limits and the Salt Water Corrosion Performance", SAE Technical Paper Series (1986).
Pawar, S.G , "Influence of Microstructure on the Corrosion Behaviour of Magnesium Alloys", PhD Dissertation, University of Manchester (2011).
Czerwinski, "Magnesium Injection Molding"; Technology & Engineering; Springer Science + Media, LLC, pp. 107-108, (Dec. 2007).
National Physical Laboratory, "Bimetallic Corrosion" Crown (C) p. 1-14 (2000).
Shimizu et al., "Multi-walled carbon nanotube-reinforced magnesium alloy composites", Scripta Materialia, vol. 58, pp. 267-270 (2008).
Zhan et al., "Single-wall carbon nanotubes as attractive toughening agents in alumina-based nanocomposites", Mature Materials, vol. 2, pp. 38-42 (Jan. 2003).
Curtin et al., "CNT-reinforced ceramics and metals", Materials Today, vol. 7, pp. 44-49 (2004).
Pardo et al., "Corrosion behavior of magnesium/aluminum alloys in 3.5 wt.% NaCl", Corrosion Science, vol. 50, pp. 823-834 (2008).
Song et L., "Influence of microstructure on the corrosion of diecast AZ91D", Corrosion Science, vol. 41, pp. 249-273 (1999).
Watarai, "Trend of Research and Development for Magnesium Alloys—Reducing the Weight of Structural Materials in Motor Vehicles", Science & Technology Trends, Quarterly Review, No. 18, pp. 84-97 (Jan. 2006).
Saravanan et al., "Mechanically Alloyed Carbon Nanotubes (CNT) Reinforced Nanocrystalline AA 4032: Synthesis and Characterization", Journal of Minerals & Materials Characterization & Engineering, vol. 9, No. 11, pp. 1027-1035 (2010).
Tsipas et al., "Effect of high energy ball milling on titanium-hydroxyapatite powders", Powder Metallurgy, vol. 46, No. 1 pp. 73-77 (2003).
Xie et al., "TEM Observation of Interfaces between Particles in Al—Mg Powder Compacts Prepared by Pulse Electric Current Sintering", Materials Transactions, vol. 43, No. 9, pp. 2177-2180 (2002).
Elsayed et al., "Effect of Consolidation and Extrusion Temperatures on Tensile Properties of Hot Extruded ZK61 Magnesium Alloy Gas Atomized Powders via Spark Plasma Sintering", Tranasctions of JWRI, vol. 38, No. 2, p. 31.
Shigematsu et al., "Surface treatment of AZ91D magnesium alloy by aluminum diffusion coating", Journal of Materials Science Letters, vol. 19, pp. 473-475 (2000).
Spencer et al., "Fluidized Bed Polymer Particle ALD Process for Producing HDPE/Alumina Nanocomposites", 12th International Conference on Fluidization, vol. RP4 (2007).
Maisano, "Cryomilling of Aluminum-Based and Magnesium-Based Metal Powders", Thesis, Virginia Tech (Jan. 2006).
Walters et al., "A Study of Jets from Unsintered-Powder Metal Lined Nonprecision Small-Caliber Shaped Charges", Army Research Laboratory, Aberdeen Proving Group, MC 21005-5066 (Feb. 2001).
Ashby, "Teach Yourself Phase Diagrams and Phase Transformations", Cambridge, 5th Edition, pp: unknown (Mar. 2009).
Callister, Materials Science and Engineering An Introduction:, 6th Edition, New York, pp: unknown (2003).
Hanson et al. Constitution of Binary Alloys:, McGraw-Hill Book Co. Inc., pp: unknown (1958).
MSE 2090: Introduction to Materials Science, Chapter 9, pp: unknown (date unknown).
Metals Handbook, "Metallography, Structures and Phase Diagrams", Aluminum-Magnesium, American Society For Metals, 8th Edition, vol. 8, pp: unknown (1973).
Metals Handbook, "Metallography, Structures and Phase Diagrams", Magnesium-Nickel, American Society For Metals, 8th Edition, vol. 8, pp: unknown (1973).
Principles and Prevention of Corrosion, "Volts versus saturated calomel reference electrobe", D.A. Jones, p. 170 (1996).
Medlin, "Mass Balance", handwritten notes (Nov. 2020).
Metals Handbook, "Metallography, Structures and Phase Diagrams", Aluminum-Iron, American Society For Metals, 8th Edition, vol. 8, p. 260 (1973).
Metals Handbook, "Metallography, Structures and Phase Diagrams", Aluminum-Nickel, American Society For Metals, 8th Edition, vol. 8, p. 261 (1973).
Metals Handbook, "Metallography, Structures and Phase Diagrams", Aluminum-Copper, American Society For Metals, 8th Edition, vol. 8, p. 259 (1973).
Metals Handbook, "Metallography, Structures and Phase Diagrams", Silver-Aluminum, American Society For Metals, 8th Edition, vol. 8, p. 252 (1973).
Medlin, Declaration of Dona J. Medlin Ph.D., P.E., FASM Under 37 CFR Section 1.68 in Support of Petition For Inter Partes Review of U.S. Pat. No. 9,903,010 (Sep. 2020).
Li, Qiang, "Translation Declaration and Translation of China Patent Publication No. 103343271" (Jun. 2020).
Ho et al., The mechanical behavior of magnesium alloy AZ91 reinforced with fine copper particulates:, Materials Science and Engineering A369, pp. 302-308 (2004).
Trojanova et al., "Mechanical and fracture properties of an AZ91 Magnesium alloy reinforced by Si and SiC particles", Composites Science and Technology, vol. 69, pp. 2256-2264 (2009).
Lin et al., "Formation of Magnesium Metal Matrix Composites Al2O3p/AZ91D and Their Mechanical Properties After Heat Treatment" Acta Metallurgica Slovaca, vol. 16, pp. 237-245 (2010).

(56) References Cited

OTHER PUBLICATIONS

United States District Court/Northern District of Ohio/Eastern Division, *Supplemental Declaration of Dana J. Medlin, Ph.D.* in Support of Opposition to *Terves LLC'S* Motion for Preliminary Injunction in related Case 1:19-CV-1611 (filedOct. 15, 2020).
United States District Court/Northern District of Ohio/Eastern Division, Declaration of Andrew Sherman in Support of Terves' Preliminary Injunction Motion in related Case 1:19-CV-1611 (filed May 1, 2020).
Hemanth, "Fracture Behavior of Cryogenically solidifed aluminum-alloy reinforced with Nano-ZrO2 Metal Matrix Composites (CNMMCs)", Journal of Chemical Engineering and Materials Science, vol. 2(8), pp. 110-121 (Aug. 2011).
United States District Court/Northern District of Ohio/Eastern Division, Memorandum Opinion and Order in related Case 1:19-CV-1611 (issued Mar. 29, 2021).
United States District Court/Northern District of Ohio/Eastern Division, Second Rebuttal Rule 26 Report of Lee A. Swanger, Ph D., P.E. in related Case 1:19-CV-1611 (filed Nov. 24, 2020).
U.S. Patent and Trademark Office, Declaration of Dana J. Medlin in Support of Request for Ex Parte Reexamination of U.S. Appl. No. 10/329,653 (filed Jul. 6, 2021).

* cited by examiner

Highlighted In Situ Formed Particles

GALVANICALLY-ACTIVE IN SITU FORMED PARTICLES FOR CONTROLLED RATE DISSOLVING TOOLS

The present invention claims priority on U.S. Provisional Application Ser. No. 62/569,004 filed Oct. 6, 2017, which is incorporated herein by reference The present invention is a continuation-in-part of U.S. application Ser. No. 15/294,957 filed Oct. 17, 2016, which is a divisional of U.S. application Ser. No. 14/627,236 filed Feb. 20, 2015 (now U.S. Pat. No. 9,757,796 issued Sep. 12, 2017), which in turn claims priority on U.S. Provisional Application Ser. No. 61/942,879 filed Feb. 21, 2014, which are incorporated herein by reference.

The present invention is also a continuation-in-part of U.S. application Ser. No. 15/641,439 filed Jul. 5, 2017, which is a divisional of U.S. patent application Ser. No. 14/689,295 filed Apr. 17, 2015 (now U.S. Pat. No. 9,903,010 issued Feb. 27, 2018), which in turn claims priority on U.S. Provisional Patent Application Ser. No. 61/981,425 filed Apr. 18, 2014, which are incorporated herein by reference.

FIELD OF THE INVENTION

The invention is directed to a novel material for use as a dissolvable structure in oil drilling. Specifically, the invention is directed to a ball or other structure in a well drilling or completion operation, such as a structure that is seated in a hydraulic operation, that can be dissolved away after use so that that no drilling or removal of the structure is necessary. Primarily, dissolution is measured as the time the ball removes itself from the seat or can become free floating in the system. Secondarily, dissolution is measured in the time the ball is substantially or fully dissolved into submicron particles. Furthermore, the novel material of the present invention can be used in other well structures that also desire the function of dissolving after a period of time. The material is machinable and can be used in place of existing metallic or plastic structures in oil and gas drilling rigs including, but not limited to, water injection and hydraulic fracturing.

BACKGROUND OF THE INVENTION

The ability to control the dissolution of a downhole well component in a variety of solutions is important to the utilization of non-drillable completion tools, such as sleeves, frac balls, hydraulic actuating tooling, and the like. Reactive materials for this application, which dissolve or or corrode when exposed to acid, salt, and/or other wellbore conditions, have been proposed for some time. Generally, these components consist of materials that are engineered to dissolve or corrode.

While the prior art well drill components have enjoyed modest success in reducing well completion costs, their consistency and ability to specifically control dissolution rates in specific solutions, as well as other drawbacks such as limited strength and poor reliability, have impacted their widespread adoption. Ideally, these components would be manufactured by a process that is low cost, scalable, and produces a controlled corrosion rate having similar or increased strength as compared to traditional engineering alloys such as aluminum, magnesium, and iron. Ideally, traditional heat treatments, deformation processing, and machining techniques could be used on the components without impacting the dissolution rate and reliability of such components.

Prior art articles regarding calcium use in magnesium are set for in Koltygin et al., "Effect of calcium on the process of production and structure of magnesium melted by flux-free method" *Magnesium and Its Alloys* (2013): 540-544; Koltygin et al., "Development of a magnesium alloy with good casting characteristics on the basis of Mg—Al—Ca—Mn system, having Mg—Al2Ca structure." *Journal of Magnesium and Alloys* 1 (2013): 224-229; Li et al., "Development of non-flammable high strength AZ91+Ca alloys via liquid forging and extrusion." *Materials and Design* (2016): 37-43; Cheng et al. "Effect of Ca and Y additions on oxidation behavior of AZ91 alloy at elevated temperatures." *Transactions of Nonferrous Metals Society of China* (2009): 299-304; and Qudong et al., "Effects of Ca addition on the microstructure and mechanical properties of AZ91 magnesium alloy." *Journal of Materials Science* (2001): 3035-3040.

SUMMARY OF THE INVENTION

The present invention is directed to a novel magnesium composite for use as a dissolvable component in oil drilling and will be described with particular reference to such application. As can be appreciated, the novel magnesium composite of the present invention can be used in other applications (e.g., non-oil wells, etc.). In one non-limiting embodiment, the present invention is directed to a ball or other tool component in a well drilling or completion operation such as, but not limited to, a component that is seated in a hydraulic operation that can be dissolved away after use so that no drilling or removal of the component is necessary. Tubes, valves, valve components, plugs, frac balls, sleeve, hydraulic actuating tooling, mandrels, slips, grips, balls, darts, carriers, valve components, other downhole well components and other shapes of components can also be formed of the novel magnesium composite of the present invention. For purposes of this invention, primary dissolution is measured for valve components and plugs as the time the part removes itself from the seat of a valve or plug arrangement or can become free floating in the system. For example, when the part is a plug in a plug system, primary dissolution occurs when the plug has degraded or dissolved to a point that it can no long function as a plug and thereby allows fluid to flow about the plug. For purposes of this invention, secondary dissolution is measured in the time the part is fully dissolved into submicron particles. As can be appreciated, the novel magnesium composite of the present invention can be used in other well components that also desire the function of dissolving after a period of time. In one non-limiting aspect of the present invention, a galvanically-active phase is precipitated from the novel magnesium composite composition and is used to control the dissolution rate of the component; however, this is not required. The novel magnesium composite is generally castable and/or machinable and can be used in place of existing metallic or plastic components in oil and gas drilling rigs including, but not limited to, water injection and hydraulic fracturing. The novel magnesium composite can be heat treated as well as extruded and/or forged.

In one non-limiting aspect of the present invention, the novel magnesium composite is used to form a castable, moldable, or extrudable component. Non-limiting magnesium composites in accordance with the present invention include at least 50 wt. % magnesium. One or more additives are added to a magnesium or magnesium alloy to form the novel magnesium composite of the present invention. The one or more additives can be selected and used in quantities so that galvanically-active intermetallic or insoluble precipitates form in the magnesium or magnesium alloy while the magnesium or magnesium alloy is in a molten state and/or during the cooling of the melt; however, this is not required. The one or more additives can be in the form of a pure or nearly nearly pure additive element (e.g., at least 98% pure), or can be added as an alloy of two or more additive elements or an alloy of magnesium and one or more additive elements. The one or more additives typically are added in a weight percent that is less than a weight percent of said magnesium or magnesium alloy. Typically, the magnesium or magnesium alloy constitutes about 50.1-99.9 wt. % of the magnesium composite and all values and ranges therebetween. In one non-limiting aspect of the invention, the magnesium or magnesium alloy constitutes about 60-95 wt. % of the magnesium composite, and typically the magnesium or magnesium alloy constitutes about 70-90 wt. % of the magnesium composite. The one or more additives can be added to the molten magnesium or magnesium alloy at a temperature that is less than the melting point of the one or more additives; however, this is not required. The one or more additives generally have an average particle diameter size of at least about 0.1 microns, typically no more than about 500 microns (e.g., 0.1 microns, 0.1001 microns, 0.1002 microns . . . 499.9998 microns, 499.9999 microns, 500 microns) and include any value or range therebetween, more typically about 0.1-400 microns, and still more typically about 10-50 microns. In one non-limiting configuration, the particles can be less than 1 micron. During the process of mixing the one or more additives in the molten magnesium or magnesium alloy, the one or more additives do not typically fully melt in the molten magnesium or magnesium alloy; however, the one or more additives can form a single-phase liquid with the magnesium while the mixture is in the molten state. As can be appreciated, the one or more additives can be added to the molten magnesium or magnesium alloy at a temperature that is greater than the melting point of the one or more additives. The one or more additives can be added individually as pure or substantially pure additive elements or can be added as an alloy that is formed of a plurality of additive elements and/or an alloy that includes one or more additive elements and magnesium. When one or more additive elements are added as an alloy, the melting point of the alloy may be less than the melting point of one or more of the additive elements that are used to form the alloy; however, this is not required. As such, the addition of an alloy of the one or more additive elements could be caused to melt when added to the molten magnesium at a certain temperature, whereas if the same additive elements were individually added to the molten magnesium at the same temperature, such individual additive elements would not fully melt in the molten magnesium.

The one or more additives are selected such that as the molten magnesium cools, newly formed metallic alloys and/or additives begin to precipitate out of the molten metal and form the in situ phase to the matrix phase in the cooled and solid magnesium composite. After the mixing process is completed, the molten magnesium or magnesium alloy and the one or more additives that are mixed in the molten magnesium or magnesium alloy are cooled to form a solid component. In one non-limiting embodiment, the temperature of the molten magnesium or magnesium alloy is at least about 10° C. less than the melting point of the additive that is added to the molten magnesium or magnesium alloy during the addition and mixing process, typically at least about 100° C. less than the melting point of the additive that is added to the molten magnesium or magnesium alloy during the addition and mixing process, more typically about 100-1000° C. (and any value or range therebetween) less than the melting point of the additive that is added to the molten magnesium or magnesium alloy during the addition and mixing process; however, this is not required. As can be appreciated, one or more additives in the form of an alloy or a pure or substantially pure additive element can be added to the magnesium that have a melting point that is less than the melting point of magnesium, but still at least partially precipitate out of the magnesium as the magnesium cools from its molten state to a solid state. Generally, such one or more additives and/or one or more components of the additives form an alloy with the magnesium and/or one or more other additives in the molten magnesium. The formed alloy has a melting point that is greater than a melting point of magnesium, thereby results in the precipitation of such formed alloy during the cooling of the magnesium from the molten state to the solid state. The never melted additive(s) and/or the newly formed alloys that include one or more additives are referred to as in situ particle formation in the molten magnesium composite. Such a process can be used to achieve a specific galvanic corrosion rate in the entire magnesium composite and/or along the grain boundaries of the magnesium composite.

The invention adopts a feature that is usually a negative in traditional casting practices wherein a particle is formed during the melt processing that corrodes the alloy when exposed to conductive fluids and is imbedded in eutectic phases, the grain boundaries, and/or even within grains with precipitation hardening. This feature results in the ability to control where the galvanically-active phases are located in the final casting, as well as the surface area ratio of the in situ phase to the matrix phase, which enables the use of lower cathode phase loadings as compared to a powder metallurgical or alloyed composite to achieve the same dissolution rates. The in situ formed galvanic additives can be used to enhance mechanical properties of the magnesium composite such as ductility, tensile strength, and/or shear strength. The final magnesium composite can also be enhanced by heat treatment as well as deformation processing (such as extrusion, forging, or rolling) to further improve the strength of the final composite over the as-cast material; however, this is not required. The deformation processing can be used to achieve strengthening of the magnesium composite by reducing the grain size of the magnesium composite. Further enhancements, such as traditional alloy heat treatments (such as solutionizing, aging and/or cold working) can be used to enable control of dissolution rates through precipitation of more or less galvanically-active phases within the alloy microstructure while improving mechanical properties; however, this is not required. Because galvanic corrosion is driven by both the electro potential between the anode and cathode phase, as well as the exposed surface area of the two phases, the rate of corrosion can also be controlled through adjustment of the in situ formed particle size, while not increasing or decreasing the volume or weight fraction of the addition, and/or by changing the volume/weight fraction without changing the particle size. Achievement of in situ particle size control can be achieved by mechanical agitation of the melt, ultrasonic processing of the melt, controlling cooling rates, and/or by performing heat treatments. In situ particle size can also or alternatively be modified by secondary processing such as rolling, forging, extrusion and/or other deformation techniques.

In another non-limiting aspect of the invention, a cast structure can be made into almost any shape. During formation, the active galvanically-active in situ phases can be uniformly dispersed throughout the component and the grain or the grain boundary composition can be modified to achieve the desired dissolution rate. The galvanic corrosion can be engineered to affect only the grain boundaries and/or can affect the grains as well (based on composition); however, this is not required. This feature can be used to enable fast dissolutions of high-strength lightweight alloy composites with significantly less active (cathode) in situ phases as compared to other processes.

In still another and/or alternative non-limiting aspect of the invention, ultrasonic processing can be used to control the size of the in situ formed galvanically-active phases; however, this is not required. Ultrasonic energy is used to degass and grain refine alloys, particularly when applied in the solidification region. Ultrasonic and stirring can be used to refine the grain size in the alloy, thereby creating a high strength alloy and also reducing dispersoid size and creating more equiaxed (uniform) grains. Finer grains in the alloy have been found to reduce the degradation rate with equal amounts of additives.

In yet another and/or alternative non-limiting aspect of the invention, the in situ formed particles can act as matrix strengtheners to further increase the tensile strength of the material compared to the base alloy without the one or more additives; however, this is not required. For example, tin can be added to form a nanoscale precipitate (can be heat treated, e.g., solutionized and then precipitated to form precipitates inside the primary magnesium grains). The particles can be used to increase the strength of the alloy by at least 10%, and as much as greater than 100%, depending on other strengthening mechanisms (second phase, grain refinement, solid solution) strengthening present.

In still yet another and/or alternative non-limiting aspect of the invention, there is provided a method of controlling the dissolution properties of a metal selected from the class of magnesium and/or magnesium alloy comprising of the steps of a) melting the magnesium or magnesium alloy to a point above its solidus, b) introducing one or more additives to the magnesium or magnesium alloy in order to achieve in situ precipitation of galvanically-active intermetallic phases, and c) cooling the melt to a solid form. The one or more additives are generally added to the magnesium or magnesium alloy when the magnesium or magnesium alloy is in a molten state and at a temperature that is less than the melting point of one or more additive materials. As can be appreciated, one or more additives can be added to the molten magnesium or magnesium alloy at a temperature that is greater than the melting point of the one or more additives. The one or more additives can be added as individual additive elements to the magnesium or magnesium alloy, or be added in alloy form as an alloy of two or more additives, or an alloy of one or more additives and magnesium or magnesium alloy. The galvanically-active intermetallic phases can be used to enhance the yield strength of the alloy; however, this is not required. The size of the in situ precipitated intermetallic phase can be controlled by a melt mixing technique and/or cooling rate; however, this is not required. It has been found that the addition of the one or more additives (SM) to the molten magnesium or magnesium alloy can result in the formation of $MgSM_x$, MgxSM, and LPSO and other phases with two, three, or even four components that include one or more galvanically-active additives that result in the controlled degradation of the formed magnesium composite when exposed to certain environments (e.g., salt water, brine, fracking liquids, etc.). The method can include the additional step of subjecting the magnesium composite to intermetallic precipitates to solutionizing of at least about 300° C. to improve tensile strength and/or improve ductility; however, this is not required. The solutionizing temperature is less than the melting point of the magnesium composite. Generally, the solutionizing temperature is less than 50-200° C. of the melting point of the magnesium composite and the time period of solutionizing is at least 0.1 hours. In one non-limiting aspect of the invention, the magnesium composite can be subjected to a solutionizing temperature for about 0.5-50 hours (and all values and ranges therebetween) (e.g., 1-15 hours, etc.) at a temperature of 300-620° C. (and all values and ranges therebetween) (e.g., 300-500° C., etc.). The method can include the additional step of subjecting the magnesium composite to intermetallic precipitates and to artificially age the magnesium composite at a temperature at least about 90° C. to improve the tensile strength; however, this is not required. The artificial aging process temperature is typically less than the solutionizing temperature and the time period of the artificial aging process temperature is typically at least 0.1 hours. Generally, the artificial aging process at is less than 50-400° C. (the solutionizing temperature). In one non-limiting aspect of the invention, the magnesium composite can be subjected to the artificial aging process for about 0.5-50 hours (and all values and ranges therebetween) (e.g., 1-16 hours, etc.) at a temperature of 90-300° C. (and all values and ranges therebetween) (e.g., 100-200° C.).

In still yet another and/or alternative non-limiting aspect of the invention, there is provided a magnesium composite that is over 50 wt. % magnesium and about 0.5-49.5 wt. % of additive (SM) (e.g., aluminum, zinc, tin, beryllium, boron carbide, copper, nickel, bismuth, cobalt, titanium, manganese, potassium, sodium, antimony, indium, strontium, barium, silicon, lithium, silver, gold, cesium, gallium, calcium, iron, lead, mercury, arsenic, rare earth metals (e.g., yttrium, lanthanum, samarium, europium, gadolinium, terbium, dysprosium, holmium, ytterbium, etc.) and zirconium) (and all values and ranges therebetween) is added to the magnesium or magnesium alloy to form a galvanically-active intermetallic particle. The one or more additives can be added to the magnesium or magnesium alloy while the temperature of the molten magnesium or magnesium alloy is less than or greater than the melting point of the one or more additives. In one non-limiting embodiment, throughout the mixing process, the temperature of the molten magnesium or magnesium alloy can be less than the melting point of the one or more additives. In another non-limiting embodiment, throughout the mixing process, the temperature of the molten magnesium or magnesium alloy can be greater than the melting point of the one or more additives. In another non-limiting embodiment, throughout the mixing process, the temperature of the molten magnesium or magnesium alloy can be greater than the melting point of the one or more additives and less than the melting point of one or more other additives. In another non-limiting embodiment, throughout the mixing process, the temperature of the molten magnesium or magnesium alloy can be greater than the melting point of the alloy that includes one or more additives. In another non-limiting embodiment, throughout the mixing process, the temperature of the molten magnesium or magnesium alloy can be less than the melting point of the alloy that includes one or more additives. During the mixing process, solid particles of $SMMg_x$, SMxMg can be formed. Once the mixing process is complete, the mixture of molten magnesium or magnesium alloy, $SMMg_x$, $SM_xMg$, and/or any unalloyed additive is cooled and an in situ precipitate is formed in the solid magnesium composite.

In another and/or alternative non-limiting aspect of the invention, there is provided a magnesium composite that is over 50 wt. % magnesium and about 0.05-49.5 wt. % nickel (and all values or ranges therebetween) is added to the magnesium or magnesium alloy to form intermetallic $Mg_2Ni$ as a galvanically-active in situ precipitate. In one non-limiting arrangement, the magnesium composite includes about 0.05-23.5 wt. % nickel, 0.01-5 wt. % nickel, 3-7 wt. % nickel, 7-10 wt. % nickel, or 10-24.5 wt. % nickel. The nickel is added to the magnesium or magnesium alloy while the temperature of the molten magnesium or magnesium alloy is less than the melting point of the nickel; however, this is not required. In one non-limiting embodiment, throughout the mixing process, the temperature of the molten magnesium or magnesium alloy is less than the melting point of the nickel. During the mixing process, solid particles of $Mg_2Ni$ can be formed; but is not required. Once the mixing process is complete, the mixture of molten magnesium or magnesium alloy, any solid particles of $Mg_2Ni$, and any unalloyed nickel particles are cooled and an in situ precipitate of any solid particles of $Mg_2Ni$ and any unalloyed nickel particles is formed in the solid magnesium composite. Generally, the temperature of the molten magnesium or magnesium alloy is at least about 200° C. less than the melting point of the nickel added to the molten magnesium or magnesium alloy during the addition and mixing process; however, this is not required.

In still another and/or alternative non-limiting aspect of the invention, there is provided a magnesium composite that is over 50 wt. % magnesium and about 0.05-49.5 wt. % copper (and all values or ranges therebetween) is added to the magnesium or magnesium alloy to form galvanically-active in situ precipitate that includes copper and/or copper alloy. In one non-limiting arrangement, the magnesium composite includes about 0.01-5 wt. % copper, about 0.5-15 wt. % copper, about 15-35 wt. % copper, or about 0.01-20 wt. % copper. The copper is added to the magnesium or magnesium alloy while the temperature of the molten magnesium or magnesium alloy is less than the melting point of the copper; however, this is not required. In one non-limiting embodiment, throughout the mixing process, the temperature of the molten magnesium or magnesium alloy is less than the melting point of the copper; however, this is not required. During the mixing process, solid particles of $CuMg_2$ can be formed; but is not required. Once the mixing process is complete, the mixture of molten magnesium or magnesium alloy, any solid particles of $CuMg_2$, and any unalloyed copper particles are cooled and an in situ precipitate of any solid particles of $CuMg_2$ and any unalloyed copper particles is formed in the solid magnesium composite. Generally, the temperature of the molten magnesium or magnesium alloy is at least about 200° C. less than the melting point of the copper added to the molten magnesium or magnesium alloy; however, this is not required.

In yet another and/or alternative non-limiting aspect of the invention, there is provided a magnesium composite that is over 50 wt. % magnesium and about 0.05-49.5% by weight cobalt (and all values and ranges therebetween) is added to the magnesium or magnesium alloy to form galvanically active in situ precipitate that includes cobalt and/or cobalt alloy. In one non-limiting arrangement, the magnesium composite includes about 0.01-5 wt. %© cobalt, about 0.5-15 wt. % cobalt, about 15-35 wt. % cobalt, or about 0.01-20 wt. % cobalt. The cobalt is added to the magnesium or magnesium alloy while the temperature of the molten magnesium or magnesium alloy is less than the melting point of the cobalt; however, this is not required. In one non-limiting embodiment, throughout the mixing process, the temperature of the molten magnesium or magnesium alloy is less than the melting point of the cobalt; however, this is not required. During the mixing process, solid particles of $CoMg_2$ and/or $Mg_xCo$ can be formed; but is not required. Once the mixing process is complete, the mixture of molten magnesium or magnesium alloy, any solid particles of $CoMg_2$, $Mg_xCo$, any solid particles of any unalloyed cobalt particles are cooled and an in situ precipitate of any solid particles of $CoMg_2$, $Mg_xCo$, any solid particles of unalloyed cobalt particles is formed in the solid magnesium composite. Generally, the temperature of the molten magnesium or magnesium alloy is at least about 200° C. less than the melting point of the cobalt added to the molten magnesium or magnesium alloy; however, this is not required.

In another and/or alternative non-limiting aspect of the invention, there is provided a magnesium composite that is over 50 wt. % magnesium and up to about 49.5% by weight bismuth (and all values and ranges therebetween) is added to the magnesium or magnesium alloy to form galvanically-active in situ precipitate that includes bismuth and/or bismuth alloy. Bismuth intermetallics are formed above roughly 0.1 wt. % bismuth, and bismuth is typically useful up to its eutectic point of roughly 11 wt. % bismuth. Beyond the eutectic point, a bismuth intermetallic is formed in the melt. This is typical of additions, in that the magnesium-rich side of the eutectic forms flowable, castable materials with active precipitates or intermetallics formed at the solidus (in the eutectic mixture), rather than being the primary, or initial, phase solidified. In desirable alloy formulations, alpha magnesium (may be in solid solution with alloying elements) should be the initial/primary phase formed upon initial cooling. In one non-limiting embodiment, bismuth is added to the magnesium composite at an amount of greater than 11 wt. %, and typically about 11.1-30 wt. % (and all values and ranges therebetween).

In another and/or alternative non-limiting aspect of the invention, there is provided a magnesium composite that is over 50 wt. % magnesium and up to about 49.5% by weight tin (and all values and ranges therebetween) is added to the magnesium or magnesium alloy to form galvanically-active in situ precipitate that includes tin and/or tin alloy. Tin additions have a significant solubility in solid magnesium at elevated temperatures, forming both a eutectic (at grain boundaries), as well as in the primary magnesium (dispersed). Dispersed precipitates, which can be controlled by heat treatment, lead to large strengthening, while eutectic phases are particularly effective at initiating accelerated corrosion rates. In one non-limiting embodiment, tin is added to the magnesium composite at an amount of at least 0.5 wt. %, typically about 1-30 wt. % (and all values and ranges therebetween), and more typically about 1-10 wt. %.

In another and/or alternative non-limiting aspect of the invention, there is provided a magnesium composite that is over 50 wt. % magnesium and up to about 49.5% by weight gallium (and all values and ranges therebetween) is added to the magnesium or magnesium alloy to form galvanically active in situ precipitate that includes gallium and/or gallium alloy. Gallium additions are particularly effective at initiating accelerated corrosion, in concentrations that form up to 3-5 wt. % $Mg_5Ga_2$. Gallium alloys are heat treatable forming corrodible high strength alloys. Gallium is fairly unique, in that it has high solubility in solid magnesium, and forms highly corrosive particles during solidification which are located inside the primary magnesium (when below the solid solubility limit), such that both grain boundary and primary (strengthening precipitates) are formed in the magnesium-gallium systems and also in magnesium-indium systems. At gallium concentrations of less than about 3 wt. %, additional superheat (higher melt temperatures) is typically used to form the precipitate in the magnesium alloy. To place $Mg_5Ga_2$ particles at the grain boundaries, gallium concentrations above the solid solubility limit at the pouring temperature are used such that $Mg_5Ga_2$ phase is formed from the eutectic liquid. In one non-limiting embodiment, gallium is added to the magnesium composite at an amount of at least 1 wt. %, and typically about 1-10 wt. % (and all values and ranges therebetween), typically 2-8 wt. %, and more typically 3.01-5 wt. %.

In another and/or alternative non-limiting aspect of the invention, there is provided a magnesium composite that is over 50 wt. % magnesium and up to about 49.5% by weight indium (and all values and ranges therebetween) is added to the magnesium or magnesium alloy to form galvanically-active in situ precipitate that includes indium and/or indium alloy. Indium additions have also been found effective at initiating corrosion. In one non-limiting embodiment, indium is added to the magnesium composite at an amount of at least 1 wt. %, and typically about 1-30 wt. % (and all values and ranges therebetween).

In general, precipitates having an electronegativity greater than 1.4-1.5 act as corrosion acceleration points, and are more effective if formed from the eutectic liquid during solidification, than precipitation from a solid solution. Alloying additions added below their solid solubility limit which precipitate in the primary magnesium phase during solidification (as opposed to along grain boundaries), and which can be solutionized are more effective in creating higher strength, particularly in as-cast alloys.

In another and/or alternative non-limiting aspect of the invention, the molten magnesium or magnesium alloy that includes the one or more additives can be controllably cooled to form the in situ precipitate in the solid magnesium composite. In one non-limiting embodiment, the molten magnesium or magnesium alloy that includes the one or more additives is cooled at a rate of greater than 1° C. per minute. In one non-limiting embodiment, the molten magnesium or magnesium alloy that includes the one or more additives is cooled at a rate of less than 1° C. per minute. In one non-limiting embodiment, the molten magnesium or magnesium alloy that includes the one or more additives is cooled at a rate of greater than 0.01° C. per min and slower than 1° C. per minute. In one non-limiting embodiment, the molten magnesium or magnesium alloy that includes the one or more additives is cooled at a rate of greater than 10° C. per minute and less than 100° C. per minute. In one non-limiting embodiment, the molten magnesium or magnesium alloy that includes the one or more additives is cooled at a rate of less than 10° C. per minute. In another non-limiting embodiment, the molten magnesium or magnesium alloy that includes the one or more additives is cooled at a rate 10-100° C./min (and all values and ranges therebetween) through the solidus temperature of the alloy to form fine grains in the alloy.

In another and/or alternative non-limiting aspect of the invention, there is provided a magnesium alloy that includes over 50 wt. % magnesium (e.g., 50.01-99.99 wt. % and all values and ranges therebetween) and includes at least one metal selected from the group consisting of aluminum, boron, bismuth, zinc, zirconium, and manganese. As can be appreciated, the magnesium alloy can include one or more additional metals. In one non-limiting embodiment, the magnesium alloy includes over 50 wt. % magnesium and includes at least one metal selected from the group consisting of aluminum in an amount of about 0.05-10 wt. % (and all values and ranges therebetween), zinc in amount of about 0.05-6 wt. % (and all values and ranges therebetween), zirconium in an amount of about 0.01-3 wt. % (and all values and ranges therebetween), and/or manganese in an amount of about 0.015-2 wt. % (and all values and ranges therebetween). In another non-limiting formulation, the magnesium alloy includes over 50 wt. % magnesium and includes at least one metal selected from the group consisting of zinc in amount of about 0.05-6 wt. %, zirconium in an amount of about 0.05-3 wt. %©, manganese in an amount of about 0.05-0.25 wt. %, boron (optionally) in an amount of about 0.0002-0.04 wt. %, and bismuth (optionally) in an amount of about 0.4-0.7 wt. %. In still another and/or alternative non-limiting aspect of the invention, there is provided a magnesium alloy that is over 50 wt. % magnesium and at least one metal selected from the group consisting of aluminum in an amount of about 0.05-10 wt. % (and all values and ranges therebetween), zinc in an amount of about 0.05-6 wt. % (and all values and ranges therebetween), calcium in an amount of about 0.5-8 wt. %% (and all values and ranges therebetween), zirconium in amount of about 0.05-3 wt. % (and all values and ranges therebetween), manganese in an amount of about 0.05-0.25 wt. % (and all values and ranges therebetween), boron in an amount of about 0.0002-0.04 wt. % (and all values and ranges therebetween), and/or bismuth in an amount of about 0.04-0.7 wt. % (and all values and ranges therebetween).

In still another and/or alternative non-limiting aspect of the invention, there is provided a magnesium composite that is over 50 wt. % magnesium and includes one or more additives in the form of a first additive that has an electronegativity that is greater than 1.5, and typically greater than 1.8. The electronegativity of magnesium is 1.31. As such, the first additive has a higher electronegativity than magnesium. The first additive can include one or more metals selected from the group consisting of nickel (1.91), cobalt (1.88), copper (1.90), bismuth (2.02), lead (1.87), tin (1.96), antimony (2.05), indium (1.78), silver (1.93), gold (2.54), and gallium (1.81). It has been found that by adding one or more first additives to a molten magnesium or molten magnesium alloy, galvanically-active phases can be formed in the solid magnesium composite having desired dissolution rates in salt water, fracking liquid or brine environments. The one or more first additives are added to the molten magnesium or molten magnesium alloy such that the final magnesium composite includes 0.05-49.55% by weight of the one or more first additives (and all values and ranges therebetween), and typically 0.5-35% by weight of the one or more first additives. The one or more first additives having an electronegativity that is greater than 1.5 have been found to form galvanically-active phases in the solid magnesium composite to enhance the dissolution rate of the magnesium composite in salt water, fracking liquid or brine environments.

In yet another and/or alternative non-limiting aspect of the invention, it has been found that in addition to the adding of one or more first additives having an electronegativity that is greater than 1.5 to the molten magnesium or molten magnesium alloy to enhance the dissolution rates of the magnesium composite in salt water, fracking liquid or brine environments, one or more second additives that have an electronegativity of 1.25 or less can also be added to the molten magnesium or molten magnesium alloy to further enhance the dissolution rates of the solid magnesium composite. The one or more second additives can optionally be added to the molten magnesium or molten magnesium alloy such that the final magnesium composite includes 0.05-35% by weight of the one or more second additives (and all values and ranges therebetween), and typically 0.5-30% by weight of the one or more second additives. The second additive can include one or more metals selected from the group consisting of calcium (1.0), strontium (0.95), barium (0.89), potassium (0.82), sodium (0.93), lithium (0.98), cesium (0.79), and the rare earth metals such as yttrium (1.22), lanthanum (1.1), samarium (1.17), europium (1.2), gadolinium (1.2), terbium (1.1), dysprosium (1.22), holmium (1.23), and ytterbium (1.1).

Secondary additives are usually added at 0.5-10 wt. %, and generally 0.1-3 wt. %. In one non-limiting embodiment, the amount of secondary additive is less than the primary additive; however, this is not required. For example, calcium can be added up to 10 wt. %, but is added normally at 0.5-3 wt. %. In most cases, the strengthening alloying additions or modifying materials are added in concentrations which can be greater than the high electronegativity corrosive phase forming element. The secondary additions are generally designed to have high solubility, and are added below their solid solubility limit in magnesium at the melting point, but above their solid solubility limit at some lower temperature. These form precipitates that strengthen the magnesium, and may or may not be galvanically active. They may form a precipitate by reacting preferentially with the high electronegativity addition (e.g., binary, ternary, or even quaternary intermetallics), with magnesium, or with other alloying additions.

The one or more secondary additives that have an electronegativity that is 1.25 or less have been found to form galvanically-active phases in the solid magnesium composite to enhance the dissolution rate of the magnesium composite in salt water, fracking liquid or brine environments are. The inclusion of the one or more second additives with the one or more first additives in the molten magnesium or magnesium alloy has been found to enhance the dissolution rate of the magnesium composite by 1) alloying with inhibiting aluminum, zinc, magnesium, alloying additions and increasing the EMF driving force with the gavanically-active phase, and/or 2) reducing the electronegativity of the magnesium (e.g., $\alpha$-magnesium) phase when placed in solid solution or magnesium-EPE (electropositive element) intermetallics. The addition of materials with an electronegativity that is less than magnesium, such as rare earths, group 1, and group II, and group III elements on the periodic table, can enhance the degradability of the alloy when a high electronegativity addition is also present by reducing the electronegativity (increasing the driving force) in solid solution in magnesium, and/or by forming lower electronegativity precipitates that interact with the higher electronegativity precipitates. This technique/additions is particularly effective at reducing the sensitivity of the corrosion rates to temperature or salt content of the corroding or downhole fluid.

The addition of both electropositive (1.5 or greater) first additives and electronegative (1.25 or less) second additives to the molten magnesium or magnesium alloy can result in higher melting phases being formed in the magnesium composite. These higher melting phases can create high melt viscosities and can dramatically increase the temperature (and therefore the energy input) required to form the low viscosity melts suitable for casting. By dramatically increasing the casting temperature to above 700-780° C., or utilizing pressure to drive mold filling (e.g., squeeze casting), such processes can be used to produce a high quality, low-inclusion and low-porosity magnesium composite casting.

In yet another and/or alternative non-limiting aspect of the invention, there is provided a magnesium composite that is subjected to heat treatments such as solutionizing, aging and/or cold working to be used to control dissolution rates through precipitation of more or less galvanically-active phases within the alloy microstructure while improving mechanical properties. The artificial aging process (when used) can be for at least about 1 hour, for about 1-50 hours (and all values and ranges therebetween), for about 1-20 hours, or for about 8-20 hours. The solutionizing (when used) can be for at least about 1 hour, for about 1-50 hours (and all values and ranges therebetween), for about 1-20 hours, or for about 8-20 hours. When an alloy with a galvanically-active phase (higher and/or lower electronegativity than Mg) with significant solid solubility is solutionized, substantial differences in corrosion/degradation rates can be achieved through mechanisms of oswald ripening or grain growth (coarsening of the active phases), which increases corrosion rates by 10-100% (and all values and ranges therebewteen). When the solutionizing removes active phase and places it in solid solution, or creates finer precipitates (refined grain sizes), corrosion rates are decreased by 10-50%, up to about 75%.

In still yet another and/or alternative non-limiting aspect of the invention, there is provided a method for controlling the dissolution rate of the magnesium composite wherein the magnesium content is at least about 75% and at least about 0.05 wt. % nickel is added to form in situ precipitation in the magnesium or magnesium alloy and solutionizing the resultant metal at a temperature within a range of 100-500° C. (and all values and ranges therebetween) for a period of 0.25-50 hours (and all values and ranges therebetween), the magnesium composite being characterized by higher dissolution rates than metal without nickel additions subjected to the said artificial aging process.

In another and/or alternative non-limiting aspect of the invention, there is provided a method for improving the physical properties of the magnesium composite wherein the magnesium content is at least about 85% and at least about 0.05 wt. % nickel is added to form in situ precipitation in the magnesium or magnesium alloy and solutionizing the resultant metal at a temperature at about 100-500° C. (and all values and ranges therebetween) for a period of 0.25-50 hours, the magnesium composite being characterized by higher tensile and yield strengths than magnesium base alloys of the same composition, not including the amount of nickel.

In still another and/or alternative non-limiting aspect of the invention, there is provided a method for controlling the dissolution rate of the magnesium composite wherein the magnesium content in the alloy is at least about 75% and at least about 0.05 wt. % copper is added to form in situ precipitation in the magnesium or magnesium alloy and solutionizing the resultant metal at a temperature within a range of 100-500° C. for a period of 0.25-50 hours, the magnesium composite being characterized by higher dissolution rates than metal without copper additions subjected to the said artificial aging process.

In still yet another and/or alternative non-limiting aspect of the invention, there is provided a magnesium composite that includes the addition of calcium to galvanically-active magnesium-aluminum-(X) alloys with X being a galvanically-active intermetallic forming phase such as, but not limited to, nickel, copper, or cobalt to further control the degradation rate of the alloys, further increase the use and extrusion temperature of the magnesium composite, and/or reduce the potential for flammability during formation of the magnesium composite, thereby increasing safety. Calcium has a higher standard electrode potential than magnesium at −2.87V as compared to −2.37V for magnesium relative to standard hydrogen electrode (SHE). This electrode potential of calcium makes the galvanic potential between other metallic ions significantly higher, such as nickel (−0.25V), copper (+0.52V) and iron (−0.44V). The difference in galvanic potential also depends on other alloying elements with respect to microstructural location. In alloys where only magnesium and calcium are present, the difference in galvanic potential can change the degradation behavior of the alloy by leading to a greater rate of degradation in the alloy. However, the mechanism for dissolution speed change in the galvanically-active alloys created by intermetallic phases such as magnesium-nickel, magnesium-copper, and magnesium-cobalt is actually different. In the case of the magnesium-aluminum-calcium-(X) with X being a galvanically-active intermetallic forming phase such as nickel, copper, or cobalt with aluminum in the alloy, the calcium typically bonds with the aluminum (−1.66V), and this phase precipitates next to the magnesium matrix. The $Mg_{17}Al_{12}$ phase that is normally precipitated in a magnesium-aluminum-(X) with X being a galvanically-active intermetallic forming phase such as nickel, copper, or cobalt alloy is the primary contributor to a reduced and controlled degradation of the alloy.

By introducing calcium into the alloy, the amount of $Mg_{17}Al_{12}$ is reduced in the alloy, thus increasing the ratio of magnesium-(X) phase to the pure magnesium alloy and thereby reducing the galvanic corrosion resistance of the $Mg_{17}Al_{12}$ phase, which result in the further increase of the degradation rate of the magnesium-aluminum-calcium-(X) alloy as compared to magnesium-aluminum-(X) alloys. This feature of the alloy is new and unexpected because it is not just the addition of a higher standard electrode potential that is causing the degradation, but is also the reduction of a corrosion inhibitor by causing the formation of a different phase in the alloy. The calcium addition within the magnesium alloy forms an alternative phase with aluminum alloying elements. The calcium bonds with aluminum within the alloy to form lamellar $Al_2Ca$ precipitates along the grain boundary of the magnesium matrix. These precipitates act as nucleation sites during cooling (due to their low energy barrier for nucleation) leading to decreased grain size and thereby higher strength for the magnesium alloy. However, the lamellar precipitates on a microscopic level tend to shear or cut into the alloy matrix and lead to crack propagation and can offset the beneficial strengthening of the grain refinement if an excessive amount of the $Al_2Ca$ phase is formed. The offsetting grain structure effects typically lead to a minimal improvement on tensile strength of the magnesium-aluminum-calcium alloy, if any. This seems to lead to no significant reduction in tensile strength of the alloy. The significant advantage for the addition of calcium in a magnesium-aluminum alloy is in the improved incipient melting temperature when the $Al_2Ca$ phase is formed as opposed to $Mg_{17}Al_{12}$. $Al_2Ca$ has a melting temperature of approximately 1080° C. as opposed to 460° C. for the magnesium-aluminum phase, which means a higher incipient melting point for the alloy. This solution leads to a larger hot deformation processing window or, more specifically, greater speeds during extrusion or rolling. These greater speeds can lead to lower cost production and a safer overall product. Another benefit of the calcium addition into the alloy is reduced oxidation of the melt. This feature is a result of the CaO layer which forms on the surface of the melt. In melt protection, the thickness and density of the calcium layer benefits the melt through formation of a reinforced CaO—MgO oxide layer when no other elements are present. This layer reduces the potential for "burning" in the foundry, thus allows for higher casting temperatures, reduced cover gas, reduced flux use and improved safety and throughput. The oxide layer also significantly increases the ignition temperature by eliminating the magnesium oxide layer typically found on the surface and replacing it with the much more stable CaO. The calcium addition in the magnesium alloy is generally at least 0.05 wt. % and generally up to about 30 wt. % (and all values and ranges therebetween), and typically 0.1-15 wt. %.

The developed alloys can be degraded in solutions with salt contents as low as 0.01% at a rate of 1-100 mg/cm$^2$-hr. (and all values and ranges therebetween) at a temperature of 20-100° C. (and all values and ranges therebetween). The calcium additions work to enhance degradation in this alloy system, not by traditional means of adding a higher standard electrode potential material as would be common practice, but by actually reducing the corrosion inhibiting phase of $Mg_{17}Al_{12}$ by the precipitation of $Al_2Ca$ phases that are mechanically just as strong, but do not inhibit the corrosion. As such, alloys can be created with higher corrosion rates just as alloys can be created by reducing aluminum content, but without strength degradation and the added benefit of higher use temperature, higher incipient melting temperatures and/or lower flammability. The alloy is a candidate for use in all degradation applications such as downhole tools, temporary structures, etc. where strength and high use temperature are a necessity and it is desirable to have a greater rate of dissolving or degradation rates in low-salt concentration solutions.

In yet another and/or alternative non-limiting aspect of the invention, there is provided a method for improving the physical properties of the magnesium composite wherein the total content of magnesium in the magnesium or magnesium alloy is at least about 85 wt. % and copper is added to form in situ precipitation in the magnesium or magnesium composite and solutionizing the resultant metal at a temperature of about 100-500° C. for a period of 0.25-50 hours. The magnesium composite is characterized by higher tensile and yield strengths than magnesium-based alloys of the same composition, but not including the amount of copper.

In still yet another and/or alternative non-limiting aspect of the invention, there is provided a magnesium composite for use as a dissolvable ball or frac ball in hydraulic fracturing and well drilling.

In another and/or alternative non-limiting aspect of the invention, there is provided a magnesium composite for use as a dissolvable tool for use in well drilling and hydraulic control as well as hydraulic fracturing.

In another and/or alternative non-limiting aspect of the invention, there is provided a magnesium composite that has controlled dissolution or degradation for use in temporarily isolating a wellbore.

In another and/or alternative non-limiting aspect of the invention, there is provided a magnesium composite that can be used to partially or full form a mandrel, slip, grip, ball, frac ball, dart, sleeve, carrier, or other downhole well component.

In another and/or alternative non-limiting aspect of the invention, there is provided a magnesium composite that can be used for controlling fluid flow or mechanical activation of a downhole device.

In still another and/or alternative non-limiting aspect of the invention, there is provided a magnesium composite that includes secondary in situ formed reinforcements that are not galvanically active to the magnesium or magnesium alloy matrix to increase the mechanical properties of the magnesium composite. The secondary in situ formed reinforcements can optionally include a $Mg_2Si$ phase as the in situ formed reinforcement.

In yet another and/or alternative non-limiting aspect of the invention, there is provided a magnesium composite that is subjected to a greater rate of cooling from the liquidus to the solidus point to create smaller in situ formed particles.

In still yet another and/or alternative non-limiting aspect of the invention, there is provided a magnesium composite that is subjected to a slower rate of cooling from the liquidus to the solidus point to create larger in situ formed particles.

In yet another and/or alternative non-limiting aspect of the invention, there is provided a magnesium composite that is subjected to heat treatments such as solutionizing, aging and/or cold working to be used to control dissolution rates though precipitation of more or less galvanically-active phases within the alloy microstructure while improving mechanical properties. The artificial aging process (when used) can be for at least about 1 hour, for about 1-50 hours, for about 1-20 hours, or for about 8-20 hours. The solutionizing (when used) can be for at least about 1 hour, for about 1-50 hours, for about 1-20 hours, or for about 8-20 hours.

In still yet another and/or alternative non-limiting aspect of the invention, there is provided a method for controlling the dissolution rate of the magnesium composite wherein the magnesium content is at least about 75 wt. % and at least 0.05 wt. % nickel is added to form in situ precipitation in the magnesium or magnesium alloy and solutionizing the resultant metal at a temperature within a range of 100-500° C. for a period of 0.25-50 hours, the magnesium composite being characterized by higher dissolution rates than metal without nickel additions subjected to the said artificial aging process.

In another and/or alternative non-limiting aspect of the invention, there is provided a method for improving the physical properties of the magnesium composite wherein the magnesium content is at least about 85 wt. % and at least 0.05 wt. % nickel is added to form in situ precipitation in the magnesium or magnesium alloy and solutionizing the resultant metal at a temperature at about 100-500° C. for a period of 0.25-50 hours, the magnesium composite being characterized by higher tensile and yield strengths than magnesium base alloys of the same composition, but not including the amount of nickel.

In still another and/or alternative non-limiting aspect of the invention, there is provided a method for controlling the dissolution rate of the magnesium composite wherein the magnesium content in the alloy is at least about 75 wt. % and at least 0.05 wt. % copper is added to form in situ precipitation in the magnesium or magnesium alloy and solutionizing the resultant metal at a temperature within a range of 100-500° C. for a period of 0.25-50 hours, the magnesium composite being characterized by higher dissolution rates than metal without copper additions subjected to the said artificial aging process.

In yet another and/or alternative non-limiting aspect of the invention, there is provided a method for improving the physical properties of the magnesium composite wherein the total content of magnesium in the magnesium or magnesium alloy is at least about 85 wt. % and at least 0.05 wt. % copper is added to form in situ precipitation in the magnesium or magnesium composite and solutionizing the resultant metal at a temperature of about 100-500° C. for a period of 0.25-50 hours, the magnesium composite being characterized by higher tensile and yield strengths than magnesium base alloys of the same composition, but not including the amount of copper.

In still another and/or alternative non-limiting aspect of the invention, the additive generally has a solubility in the molten magnesium or magnesium alloy of less than about 10% (e.g., 0.01-9.99% and all values and ranges therebetween), typically less than about 5%, more typically less than about 1%, and even more typically less than about 0.5%.

In still another and/or alternative non-limiting aspect of the invention, the additive can optionally have a surface area of 0.001-200 $m^2/g$ (and all values and ranges therebetween). The additive in the magnesium composite can optionally be less than about 1 μm in size (e.g., 0.001-0.999 μm and all values and ranges therebetween), typically less than about 0.5 μm, more typically less than about 0.1 μm, and more typically less than about 0.05 μm. The additive can optionally be dispersed throughout the molten magnesium or magnesium alloy using ultrasonic means, electrowetting of the insoluble particles, and/or mechanical agitation. In one non-limiting embodiment, the molten magnesium or magnesium alloy is subjected to ultrasonic vibration and/or waves to facilitate in the dispersion of the additive in the molten magnesium or magnesium alloy.

In still yet another and/or alternative non-limiting aspect of the invention, a plurality of additives in the magnesium composite are located in grain boundary layers of the magnesium composite.

In still yet another and/or alternative non-limiting aspect of the invention, there is provided a method for forming a magnesium composite that includes a) providing magnesium or a magnesium alloy, b) providing one or more additives that have a low solubility when added to magnesium or a magnesium alloy when in a molten state; c) mixing the magnesium or a magnesium alloy and the one or more additives to form a mixture and to cause the one or more additives to disperse in the mixture; and d) cooling the mixture to form the magnesium composite. The step of mixing optionally includes mixing using one or more processes selected from the group consisting of thixomolding, stir casting, mechanical agitation, electrowetting and ultrasonic dispersion. The method optionally includes the step of heat treating the magnesium composite to improve the tensile strength, elongation, or combinations thereof of the magnesium composite without significantly affecting a dissolution rate of the magnesium composite. The method optionally includes the step of extruding or deforming the magnesium composite to improve the tensile strength, elongation, or combinations thereof of the magnesium composite without significantly affecting a dissolution rate of the magnesium composite. The method optionally includes the step of forming the magnesium composite into a device that a) facilitates in separating hydraulic fracturing systems and zones for oil and gas drilling, b) provides structural support or component isolation in oil and gas drilling and completion systems, or c) is in the form of a frac ball, valve, or degradable component of a well composition tool or other tool. Other types of structures that the magnesium composite can be partially or fully formed into include, but are not limited to, sleeves, valves, hydraulic actuating tooling and the like. Such non-limiting structures or additional non-limiting structure are illustrated in U.S. Pat. Nos. 8,905,147; 8,717,268; 8,663,401; 8,631,876; 8,573,295; 8,528,633; 8,485,265; 8,403,037; 8,413,727; 8,211,331; 7,647,964; US Publication Nos. 2013/0199800; 2013/0032357; 2013/

0029886; 2007/0181224; and WO 2013/122712, all of which are incorporated herein by reference.

In still yet another and/or alternative non-limiting aspect of the invention, there is provided a magnesium composite for use as a dissolvable ball or frac ball in hydraulic fracturing and well drilling.

In another and/or alternative non-limiting aspect of the invention, there is provided a magnesium composite for use as a dissolvable tool for use in well drilling and hydraulic control as well as hydraulic fracturing.

In still another and/or alternative non-limiting aspect of the invention, there is provided a magnesium composite that includes secondary in situ formed reinforcements that are not galvanically active to the magnesium or magnesium alloy matrix to increase the mechanical properties of the magnesium composite. The secondary in situ formed reinforcements include a $Mg_2Si$ phase or silicon particle phase as the in situ formed reinforcement.

In yet another and/or alternative non-limiting aspect of the invention, there is provided a magnesium composite that is subjected to a greater rate of cooling from the liquidus to the solidus point to create smaller in situ formed particles.

In still yet another and/or alternative non-limiting aspect of the invention, there is provided a magnesium composite that is subjected to a slower cooling rate from the liquidus to the solidus point to create larger in situ formed particles.

In yet another and/or alternative non-limiting aspect of the invention, there is provided a magnesium composite that is subjected to heat treatments such as solutionizing, aging and/or cold working to be used to control dissolution rates through precipitation of more or less galvanically-active phases within the alloy microstructure while improving mechanical properties. The artificial aging process (when used) can be for at least about 1 hour, for about 1-50 hours (and all values and ranges therebetween), for about 1-20 hours, or for about 8-20 hours. Solutionizing (when used) can be for at least about 1 hour, for about 1-50 hours (and all values and ranges therebetween), for about 1-20 hours, or for about 8-20 hours.

In another and/or alternative non-limiting aspect of the invention, there is provided a magnesium composite that is subjected to mechanical agitation during the cooling rate from the liquidus to the solidus point to create smaller in situ formed particles.

In still another and/or alternative non-limiting aspect of the invention, there is provided a magnesium composite that is subjected to chemical agitation during the cooling rate from the liquidus to the solidus point to create smaller in situ formed particles.

In yet another and/or alternative non-limiting aspect of the invention, there is provided a magnesium composite that is subjected to ultrasonic agitation during the cooling rate from the liquidus to the solidus point to create smaller in situ formed particles.

In still yet another and/or alternative non-limiting aspect of the invention, there is provided a magnesium composite that is subjected to deformation or extrusion to further improve dispersion of the in situ formed particles.

In still yet another and/or alternative non-limiting aspect of the invention, there is provided a magnesium composite that has a dissolve rate or dissolution rate of at least about 30 $mg/cm^2$-hr in 3% KCl solution at 90° C., and typically 30-500 $mg/cm^2$-hr in 3% KCl solution at 90° C. (and all values and ranges therebetween).

In still yet another and/or alternative non-limiting aspect of the invention, there is provided a magnesium composite that has a dissolve rate or dissolution rate of at least about 0.2 $mg/cm^2$-min in a 3% KCl solution at 90° C., and typically 0.2-150 $mg/cm^2$-min in a 3% KCl solution at 90° C. (and all values and ranges therebetween).

In still yet another and/or alternative non-limiting aspect of the invention, there is provided a magnesium composite that has a dissolve rate or dissolution rate of at least about 0.1 $mg/cm^2$-hr in a 3% KCl solution at 21° C., and typically 0.1-5 $mg/cm^2$-hr in a 3% KCl solution at 21° C. (and all values and ranges therebetween).

In still yet another and/or alternative non-limiting aspect of the invention, there is provided a magnesium composite that has a dissolve rate or dissolution rate of at least about 0.2 mg/cm in a 3% KCl solution at 20° C.

In still yet another and/or alternative non-limiting aspect of the invention, there is provided a magnesium composite that has a dissolve rate or dissolution rate of at least about 0.1 $mg/cm^2$-hr in 3% KCl solution at 20° C., typically 0.1-5 $mg/cm^2$-hr in a 3% KCl solution at 20° C. (and all values and ranges therebetween).

In another and/or alternative non-limiting aspect of the invention, there is provided a method for forming a novel magnesium composite including the steps of a) selecting an AZ91D magnesium alloy having 9 wt. % aluminum, 1 wt. % zinc and 90 wt. % magnesium, b) melting the AZ91 D magnesium alloy to a temperature above 800° C., c) adding up to about 7 wt. % nickel to the melted AZ91D magnesium alloy at a temperature that is less than the melting point of nickel, d) mixing the nickel with the melted AZ91D magnesium alloy and dispersing the nickel in the melted alloy using chemical mixing agents while maintaining the temperature below the melting point of nickel, and e) cooling and casting the melted mixture in a steel mold. The cast material has a tensile strength of about 14 ksi, and an elongation of about 3% and a shear strength of 11 ksi. The cast material has a dissolve rate of about 75 $mg/cm^2$-min in a 3% KCl solution at 90° C. The cast material dissolves at a rate of 1 $mg/cm^2$-hr in a 3% KCl solution at 21° C. The cast material dissolves at a rate of 325 $mg/cm^2$-hr. in a 3% KCl solution at 90° C. The cast material can be subjected to extrusion with an 11:1 reduction area. The extruded cast material exhibits a tensile strength of 40 ksi, and an elongation to failure of 12%. The extruded cast material dissolves at a rate of 0.8 $mg/cm^2$-min in a 3% KCl solution at 20° C. The extruded cast material dissolves at a rate of 100 $mg/cm^2$-hr. in a 3% KCl solution at 90° C. The extruded cast material can be subjected to an artificial T5 age treatment of 16 hours between 100-200° C. The aged and extruded cast material exhibits a tensile strength of 48 ksi, an elongation to failure of 5%, and a shear strength of 25 ksi. The aged extruded cast material dissolves at a rate of 110 $mg/cm^2$-hr in 3% KCl solution at 90° C. and 1 $mg/cm^2$-hr in 3% KCl solution at 20° C. The cast material can be subjected to a solutionizing treatment T4 for about 18 hours between 400-500° C. and then subjected to an artificial T6 age treatment for about 16 hours between 100-200° C. The aged and solutionized cast material exhibits a tensile strength of about 34 ksi, an elongation to failure of about 11%, and a shear strength of about 18 ksi. The aged and solutionized cast material dissolves at a rate of about 84 $mg/cm^2$-hr in 3% KCl solution at 90° C., and about 0.8 $mg/cm^2$-hr in 3% KCl solution at 20° C.

In another and/or alternative non-limiting aspect of the invention, there is provided a method for forming a novel magnesium composite including the steps of a) selecting an AZ91D magnesium alloy having 9 wt. % aluminum, 1 wt. % zinc and 90 wt. % magnesium, b) melting the AZ91D magnesium alloy to a temperature above 800° C., c) adding up to about 1 wt. % nickel to the melted AZ91D magnesium alloy at a temperature that is less than the melting point of nickel, d) mixing the nickel with the melted AZ91ID magnesium alloy and dispersing the nickel in the melted alloy using chemical mixing agents while maintaining the temperature below the melting point of nickel, and e) cooling and casting the melted mixture in a steel mold. The cast material has a tensile strength of about 18 ksi, and an elongation of about 5% and a shear strength of 17 ksi. The cast material has a dissolve rate of about 45 mg/cm$^2$-min in a 3% KCl solution at 90° C. The cast material dissolves at a rate of 0.5 mg/cm$^2$-hr. in a 3% KCl solution at 21° C. The cast material dissolves at a rate of 325 mg/cm$^2$-hr. in a 3% KCl solution at 90° C. The cast material is subjected to extrusion with a 20:1 reduction area. The extruded cast material exhibits a tensile yield strength of 35 ksi, and an elongation to failure of 12%. The extruded cast material dissolves at a rate of 0.8 mg/cm$^2$-min in a 3% KCl solution at 20° C. The extruded cast material dissolves at a rate of 50 mg/cm$^2$-hr in a 3% KCl solution at 90° C. The extruded cast material can be subjected to an artificial T5 age treatment of 16 hours between 100-200° C. The aged and extruded cast material exhibits a tensile strength of 48 ksi, an elongation to failure of 5%, and a shear strength of 25 ksi.

In still another and/or alternative non-limiting aspect of the invention, there is provided a method for forming a novel magnesium composite including the steps of a) selecting an AZ9ID magnesium alloy having about 9 wt. % aluminum, 1 wt. % zinc and 90 wt. % magnesium, b) melting the AZ9ID magnesium alloy to a temperature above 800° C., c) adding about 10 wt. % copper to the melted AZ9ID magnesium alloy at a temperature that is less than the melting point of copper, d) dispersing the copper in the melted AZ9ID magnesium alloy using chemical mixing agents at a temperature that is less than the melting point of copper, and e) cooling casting the melted mixture in a steel mold. The cast material exhibits a tensile strength of about 14 ksi, an elongation of about 3%, and shear strength of 11 ksi. The cast material dissolves at a rate of about 50 mg/cm$^2$-hr. in a 3% KCl solution at 90° C. The cast material dissolves at a rate of 0.6 mg/cm$^2$-hr. in a 3% KCl solution at 21° C. The cast material can be subjected to an artificial T5 age treatment for about 16 hours at a temperature of 100-200° C. The aged cast material exhibits a tensile strength of 50 ksi, an elongation to failure of 5%, and a shear strength of 25 ksi. The aged cast material dissolved at a rate of 40 mg/cm$^2$-hr in 3% KCl solution at 90° C. and 0.5 mg/cm$^2$-hr in 3% KCl solution at 20° C.

In still another and/or alternative non-limiting aspect of the invention, there is provided a method for forming a novel magnesium composite including the steps of a) providing magnesium having a purity of at least 99.9%, b) providing antimony having a purity of at least 99.8%, c) adding the magnesium and antimony in the crucible (e.g., carbon steel crucible), d) optionally adding a flux to the top of the metals in the crucible, e) optionally heating the metals in the crucible to 250° C. for about 2-60 minutes, heating the metals in the crucible to 650-720° C. to cause the magnesium to melt, and g) cooling the molten magnesium to form a magnesium composite that includes about 7 wt. % antimony. The density of the magnesium composite is 1.69 g/cm$^3$, the hardness is 6.8 Rockwell Hardness B, and the dissolution rate in 3% solution of KCl at 90° C. is 20.09 mg/cm$^2$-hr.

In still another and/or alternative non-limiting aspect of the invention, there is provided a method for forming a novel magnesium composite including the steps of a) providing magnesium having a purity of at least 99.9%, b) providing gallium having a purity of at least 99.9%, c) adding the magnesium and gallium in the crucible (e.g., carbon steel crucible), d) optionally adding a flux to the top of the metals in the crucible, e) optionally heating the metals in the crucible to 250° C. for about 2-60 minutes, f) heating the metals in the crucible to 650-720° C. to cause the magnesium to melt, and g) cooling the molten magnesium to form a magnesium composite that includes about 5 wt. % gallium. The density of the magnesium composite is 1.80 g/cm$^3$, the hardness is 67.8 Rockwell Hardness B, and the dissolution rate in 3% solution of KCl at 90° C. is 0.93 mg/cm$^2$-hr.

In still another and/or alternative non-limiting aspect of the invention, there is provided a method for forming a novel magnesium composite including the steps of a) providing magnesium having a purity of at least 99.9%, b) providing tin having a purity of at least 99.9%, c) adding the magnesium and tin in the crucible (e.g., carbon steel crucible), d) optionally adding a flux to the top of the metals in the crucible, e) optionally heating the metals in the crucible to 250° C. for about 2-60 minutes, heating the metals in the crucible to 650-720° C. to cause the magnesium to melt, and g) cooling the molten magnesium to form a magnesium composite that includes about 13 wt. % tin. The density of the magnesium composite is 1.94 g/cm$^3$, the hardness is 75.6 Rockwell Hardness B, and the dissolution rate in 3% solution of KCl at 90° C. is 0.02 mg/cm$^2$-hr.

In still another and/or alternative non-limiting aspect of the invention, there is provided a method for forming a novel magnesium composite including the steps of a) providing magnesium having a purity of at least 99.9%, b) providing bismuth having a purity of at least 99.9%, c) adding the magnesium and bismuth in the crucible (e.g., carbon steel crucible), d) optionally adding a flux to the top of the metals in the crucible, e) optionally heating the metals in the crucible to 250° C. for about 2-60 minutes, f) heating the metals in the crucible to 650-720° C. to cause the magnesium to melt, and g) cooling the molten magnesium to form a magnesium composite that includes about 10 wt. % bismuth. The density of the magnesium composite is 1.86 g/cm$^3$, the hardness is 16.9 Rockwell Hardness B, and the dissolution rate in 3% solution of KCl at 90° C. is 26.51 mg/cm$^2$-hr.

In still another and/or alternative non-limiting aspect of the invention, there is provided a method for controlling the dissolution properties of a magnesium or a magnesium alloy comprising of the steps of: a) heating the magnesium or a magnesium alloy to a point above its solidus temperature; b) adding an additive to said magnesium or magnesium alloy while said magnesium or magnesium alloy is above said solidus temperature of magnesium or magnesium alloy to form a mixture, said additive including one or more first additives having an electronegativity of greater than 1.5, said additive constituting about 0.05-45 wt. % of said mixture; c) dispersing said additive in said mixture while said magnesium or magnesium alloy is above said solidus temperature of magnesium or magnesium alloy; and, d) cooling said mixture to form a magnesium composite, said magnesium composite including in situ precipitation of galvanically-active intermetallic phases. The first additive can optionally have an electronegativity of greater than 1.8. The step of controlling a size of said in situ precipitated intermetallic phase can optionally be by controlled selection of a mixing technique during said dispersion step, controlling a cooling rate of said mixture, or combinations thereof. The magnesium or magnesium alloy can optionally be heated to a temperature that is less than said melting point temperature of at least one of said additives. The magnesium or magnesium alloy can be heated to a temperature that is greater than said melting point temperature of at least one of said additives. The additive can optionally include one or more metals selected from the group consisting of calcium, copper, nickel, cobalt, bismuth, silver, gold, lead, tin, antimony, indium, arsenic, mercury, and gallium. The additive can optionally include one or more metals selected from the group consisting of calcium, copper, nickel, cobalt, bismuth, tin, antimony, indium, and gallium. The additive can optionally include one or more second additives that have an electronegativity of less than 1.25. The second additive can optionally include one or more metals selected from the group consisting of strontium, barium, potassium, sodium, lithium, cesium, and the rare earth metals such as yttrium, lanthanum, samarium, europium, gadolinium, terbium, dysprosium, holmium, and ytterbium. The additive can optionally be formed of a single composition, and has an average particle diameter size of about 0.1-500 microns. At least a portion of said additive can optionally remain at least partially in solution in an α-magnesium phase of said magnesium composite. The magnesium alloy can optionally include over 50 wt. % magnesium and one or more metals selected from the group consisting of aluminum, boron, bismuth, zinc, zirconium, and manganese. The magnesium alloy can optionally include over 50 wt. % magnesium and one or more metals selected from the group consisting of aluminum in an amount of about 0.5-10 wt. %, zinc in amount of about 0.1-6 wt. %, zirconium in an amount of about 0.01-3 wt. %, manganese in an amount of about 0.15-2 wt. %; boron in amount of about 0.0002-0.04 wt. %, and bismuth in amount of about 0.4-0.7 wt. %. The magnesium alloy can optionally include over 50 wt. % magnesium and one or more metals selected from the group consisting of aluminum in an amount of about 0.5-10 wt. %, zinc in amount of about 0.1-3 wt. %, zirconium in an amount of about 0.01-1 wt. %, manganese in an amount of about 0.15-2 wt. %; boron in amount of about 0.0002-0.04 wt. %, and bismuth in amount of about 0.4-0.7 wt %. The step of solutionizing said magnesium composite can optionally occur at a temperature above 300° C. and below a melting temperature of said magnesium composite to improve tensile strength, ductility, or combinations thereof of said magnesium composite. The step of forming said magnesium composite into a final shape or near net shape can optionally be by a) sand casting, permanent mold casting, investment casting, shell molding, or other pressureless casting technique at a temperature above 730° C., 2) using either pressure addition or elevated pouring temperatures above 710° C., or 3) subjecting the magnesium composite to pressures of 2000-20,000 psi through the use of squeeze casting, thixomolding, or high pressure die casting techniques. The step of aging said magnesium composite can optionally be at a temperature of above 100° C. and below 300° C. to improve tensile strength of said magnesium composite. The magnesium composite can optionally have a hardness above 14 Rockwell Harness B. The magnesium composite can optionally have a dissolution rate of at least 5 mg/cm2-hr. in 3% KCl at 90° C. The additive metal can optionally include about 0.05-35 wt. % nickel. The additive can optionally include about 0.05-35 wt. % copper. The additive can optionally include about 0.05-35 wt. % antimony. The additive can optionally include about 0.05-35 wt. % gallium. The additive can optionally include about 0.05-35 wt. % tin. The additive can optionally include about 0.05-35 wt. % bismuth. The additive can optionally include about 0.05-35 wt. % calcium. The method can optionally further include the step of rapidly solidifying said magnesium composite by atomizing the molten mixture and then subjecting the atomized molten mixture to ribbon casting, gas and water atomization, pouring into a liquid, high speed machining, saw cutting, or grinding into chips, followed by powder or chip consolidation below its liquidus temperature.

In still another and/or alternative non-limiting aspect of the invention, there is provided a magnesium composite that includes in situ precipitation of galvanically-active intermetallic phases comprising a magnesium or a magnesium alloy and an additive constituting about 0.05-45 wt. % of said magnesium composite, said magnesium having a content in said magnesium composite that is greater than 50 wt. %, said additive forming metal composite particles or precipitant in said magnesium composite, said metal composite particles or precipitant forming said in situ precipitation of said galvanically-active intermetallic phases, said additive including one or more first additives having an electronegativity of greater than 1.5. The magnesium composite can optionally further include one or more second additives having an electronegativity of less than 1.25. The first additive can optionally have an electronegativity of greater than 1.8. The first additive can optionally include one or more metals selected from the group consisting of copper, nickel, cobalt, bismuth, silver, gold, lead, tin, antimony, indium, arsenic, mercury, and gallium. The first additive can optionally include one or more metals selected from the group consisting of copper, nickel, cobalt, bismuth, tin, antimony, indium, and gallium. The second additive can optionally include one or more metals selected from the group consisting of calcium, strontium, barium, potassium, sodium, lithium, cesium, and the rare earth metals such as yttrium, lanthanum, samarium, europium, gadolinium, terbium, dysprosium, holmium, and ytterbium. The magnesium alloy can optionally include over 50 wt. % magnesium and one or more metals selected from the group consisting of aluminum, boron, bismuth, zinc, zirconium, and manganese. The magnesium alloy can optionally include over 50 wt. % magnesium and one or more metals selected from the group consisting of aluminum in an amount of about 0.5-10 wt. %, zinc in amount of about 0.1-3 wt. %, zirconium in an amount of about 0.01-1 wt. %, manganese in an amount of about 0.15-2 wt. %, boron in amount of about 0.0002-0.04 wt. %, and bismuth in amount of about 0.4-0.7 wt. %. The additive can optionally include about 0.05-45 wt. % nickel. The first additive can optionally include about 0.05-45 wt. % copper. The first additive can optionally include about 0.05-45 wt. % cobalt. The first additive can optionally include about 0.05-45 wt. % antimony. The first additive can optionally include about 0.05-45 wt. % gallium. The first additive can optionally include about 0.05-45 wt. % tin. The first additive can optionally include about 0.05-45 wt. % bismuth. The second additive can optionally include 0.05-35 wt. % calcium. The magnesium composite can optionally have a hardness above 14 Rockwell Harness B. The magnesium composite can optionally have a dissolution rate of at least 5 mg/cm2-hr. in 3% KCl at 90° C. The magnesium composite can optionally have a dissolution rate of about 5-300 mg/cm2-hr in 3 wt. % KCl water mixture at 90° C. The magnesium composite can optionally be subjected to a surface treatment to improve a surface hardness of said magnesium composite, said surface treatment including peening, heat treatment, aluminizing, or combinations thereof. A dissolution rate of said magnesium composite can optionally be controlled by an amount and size of said in situ formed galvanically-active particles whereby smaller average sized particles of said in situ formed galvanically-active particles, a greater weight percent of said in situ formed galvanically-active particles in said magnesium composite, or combinations thereof increases said dissolution rate of said magnesium composite.

In still another and/or alternative non-limiting aspect of the invention, there is provided a dissolvable component for use in downhole operations that is fully or partially formed of a magnesium composite, said dissolvable component including a component selected from the group consisting of sleeve, frac ball, hydraulic actuating tooling, mandrel, slip, grip, ball, dart, carrier, tube, valve, valve component, plug, or other downhole well component, said magnesium composite includes in situ precipitation of galvanically-active intermetallic phases comprising a magnesium or a magnesium alloy and an additive constituting about 0.05-45 wt. % of said magnesium composite, said magnesium having a content in said magnesium composite that is greater than 50 wt. %, said additive forming metal composite particles or precipitant in said magnesium composite, said metal composite particles or precipitant forming said in situ precipitation of said galvanically-active intermetallic phases, said additive including one or more first additives having an electronegativity of greater than 1.5. The dissolvable component can optionally further include one or more second additives having an electronegativity of less than 1.25. The first additive can optionally have an electronegativity of greater than 1.8. The first additive can optionally include one or more metals selected from the group consisting of copper, nickel, cobalt, bismuth, silver, gold, lead, tin, antimony, indium, arsenic, mercury, and gallium. The first additive can optionally include one or more metals selected from the group consisting of copper, nickel, cobalt, bismuth, tin, antimony, indium, and gallium. The second additive can optionally include one or more metals selected from the group consisting of calcium, strontium, barium, potassium, sodium, lithium, cesium, and the rare earth metals such as yttrium, lanthanum, samarium, europium, gadolinium, terbium, dysprosium, holmium, and ytterbium. The second additive can optionally include 0.05-35 wt. % calcium. The magnesium alloy can optionally include over 50 wt. % magnesium and one or more metals selected from the group consisting of aluminum, boron, bismuth, zinc, zirconium, and manganese. The magnesium composite can optionally have a hardness above 14 Rockwell Harness B. The magnesium composite can optionally have a dissolution rate of at least 5 mg/cm2-hr. in 3% KCl at 90° C. The magnesium composite can optionally have a dissolution rate of at least 10 mg/cm2-hr in a 3% KCl solution at 90° C. The magnesium composite can optionally have a dissolution rate of at least 20 mg/cm2-hr in a 3% KCl solution at 65° C. The magnesium composite can optionally have a dissolution rate of at least 1 mg/cm2-hr in a 3% KCl solution at 65° C. The magnesium composite can optionally have a dissolution rate of at least 100 mg/cm2-hr in a 3% KCl solution at 90° C. The magnesium composite can optionally have a dissolution rate of at least 45 mg/cm2/hr. in 3 wt. % KCl water mixture at 90° C. and up to 325 mg/cm2/hr. in 3 wt. % KCl water mixture at 90° C. The magnesium composite can optionally have a dissolution rate of up to 1 mg/cm2/hr. in 3 wt. % KCl water mixture at 21° C. The magnesium composite can optionally have a dissolution rate of at least 90 mg/cm2-hr. in 3% KCl solution at 90° C. The magnesium composite can optionally have a dissolution rate of at least a rate of 0.1 mg/cm2-hr. in 0.1% KCl solution at 90° C. The magnesium composite can optionally have a dissolution rate of a rate of <0.1 mg/cm2-hr. in 0.1% KCl solution at 75° C. The magnesium composite can optionally have a dissolution rate of, a rate of <0.1 mg/cm2-hr. in 0.1% KCl solution at 60° C. The magnesium composite can optionally have a dissolution rate of <0.1 mg/cm2-hr. in 0.1% KCl solution at 45° C. The magnesium composite can optionally have a dissolution rate of at least 30 mg/cm2-hr. in 0.1% KCl solution at 90° C. The magnesium composite can optionally have a dissolution rate of at least 20 mg/cm2-hr. in 0.1% KCl solution at 75° C. The magnesium composite can optionally have a dissolution rate of at least 10 mg/cm2-hr. in 0.1% KCl solution at 60° C. The magnesium composite can optionally have a dissolution rate of at least 2 mg/cm2-hr. in 0.1% KCl solution at 45° C. The metal composite particles or precipitant in said magnesium composite can optionally have a solubility in said magnesium of less than 5%. The magnesium alloy can optionally include over 50 wt. % magnesium and one or more metals selected from the group consisting of aluminum, boron, bismuth, zinc, zirconium, and manganese. The magnesium alloy can optionally include over 50 wt. % magnesium and one or more metals selected from the group consisting of aluminum in an amount of about 0.5-10 wt. %, zinc in an amount of about 0.1-6 wt. %, zirconium in an amount of about 0.01-3 wt. %, manganese in an amount of about 0.15-2 wt. %, boron in an amount of about 0.0002-0.04 wt. %, and bismuth in amount of about 0.4-0.7 wt. %. The magnesium alloy can optionally include over 50 wt. % magnesium and one or more metals selected from the group consisting of aluminum in an amount of about 0.5-10 wt. %, zinc in an amount of about 0.1-3 wt. %, zirconium in an amount of about 0.01-1 wt. %, manganese in an amount of about 0.15-2 wt. %, boron in an amount of about 0.0002-0.04 wt. %, and bismuth in an amount of about 0.4-0.7 wt. %. The magnesium alloy can optionally include at least 85 wt. % magnesium and one or more metals selected from the group consisting of 0.5-10 wt. % aluminum, 0.05-6 wt. % zinc, 0.01-3 wt. % zirconium, and 0.15-2 wt. % manganese. The magnesium alloy can optionally include 60-95 wt. % magnesium and 0.01-1 wt. % zirconium. The magnesium alloy can optionally include 60-95 wt. % magnesium, 0.5-10 wt. % aluminum, 0.05-6 wt. % zinc, and 0.15-2 wt. % manganese. The magnesium alloy can optionally include 60-95 wt. % magnesium, 0.05-6 wt. % zinc, and 0.01-1 wt. % zirconium. The magnesium alloy can optionally include over 50 wt. % magnesium and one or more metals selected from the group consisting of 0.5-10 wt. % aluminum, 0.1-2 wt. % zinc, 0.01-1 wt. % zirconium, and 0.15-2 wt. % manganese. The magnesium alloy can optionally include over 50 wt. % magnesium and one or more metals selected from the group consisting of 0.1-3 wt. % zinc, 0.01-1 wt. % zirconium, 0.05-1 wt. % manganese, 0.0002-0.04 wt. % boron, and 0.4-0.7 wt. % bismuth.

In still another and/or alternative non-limiting aspect of the invention, there is provided a degradable magnesium alloy including 1-15 wt. % aluminum and a dissolution enhancing intermetallic phase between magnesium and cobalt, nickel, and/or copper with the alloy composition containing 0.05-25 wt. % cobalt, nickel, and/or copper, and 0.1-15 wt. % calcium.

In still another and/or alternative non-limiting aspect of the invention, there is provided a degradable magnesium alloy including 1-15 wt. % aluminum and a dissolution enhancing intermetallic phase between magnesium and cobalt, nickel, and/or copper with the alloy composition containing 0.05-25 wt. % cobalt, nickel, and/or copper, and 0.1-15 wt. % of calcium, strontium, barium and/or scandium.

In still another and/or alternative non-limiting aspect of the invention, there is provided a degradable magnesium alloy wherein the alloy composition includes 0.5-8 wt. % calcium, 0.05-20 wt. % nickel, 3-11 wt. % aluminum, and 50-95 wt. % magnesium and the alloy degrades at a rate that is greater than 5 mg/cm2-hr. at temperatures below 90° C. in fresh water (water with less than 1000 ppm salt content).

In still another and/or alternative non-limiting aspect of the invention, there is provided a degradable magnesium alloy wherein the alloy composition includes 0-2 wt. % zinc, 0.5-8 wt. % calcium, 0.05-20 wt. % nickel, 5-11 wt. % aluminum, and 50-95 wt. % magnesium and the alloy degrades at a rate that is greater than 1 mg/cm2-hr. at temperatures below 45° C. in fresh water (water with less than 1000 ppm salt content).

In still another and/or alternative non-limiting aspect of the invention, there is provided a degradable alloy can optionally include calcium, strontium and/or barium addition that forms an aluminum-calcium phase, an aluminum-strontium phase and/or an aluminum-barium phase that leads to an alloy with a higher incipient melting point and increased corrosion rate.

In still another and/or alternative non-limiting aspect of the invention, there is provided a degradable alloy can optionally include calcium that creates an aluminum-calcium (e.g., $AlCa_2$ phase) as opposed to a magnesium-aluminum phase (e.g., $Mg_{17}Al_{12}$ phase) to thereby enhance the speed of degradation of the alloy when exposed to a conductive fluid vs. the common practice of enhancing the speed of degradation of an aluminum-containing alloy by reducing the aluminum content to reduce the amount of $Mg_{17}Al_{12}$ in the alloy.

In still another and/or alternative non-limiting aspect of the invention, there is provided a degradable alloy can optionally include calcium addition that forms an aluminum-calcium phase that increases the ratio of dissolution of intermetallic phase to the base magnesium, and thus increases the dissolution rate of the alloy.

In still another and/or alternative non-limiting aspect of the invention, there is provided a degradable alloy can optionally include calcium addition that forms an aluminum-calcium phase reduces the salinity required for the same dissolution rate by over 2× at 90° C. in a saline solution.

In still another and/or alternative non-limiting aspect of the invention, there is provided a degradable alloy can optionally include calcium addition that increases the incipient melting temperature of the degradable alloy, thus the alloy can be extruded at higher speeds and thinner walled tubes can be formed as compared to a degradable alloy without calcium additions.

In still another and/or alternative non-limiting aspect of the invention, there is provided a degradable alloy wherein the mechanical properties of tensile yield and ultimate strength are optionally not lowered by more than 10% or are enhanced as compared to an alloy without calcium addition.

In still another and/or alternative non-limiting aspect of the invention, there is provided a degradable alloy wherein the elevated mechanical properties of yield strength and ultimate strength of the alloy at temperatures above 100° C. are optionally increased by more than 5% due to the calcium addition.

In still another and/or alternative non-limiting aspect of the invention, there is provided a degradable alloy wherein the galvanically active phase is optionally present in the form of an LPSO (Long Period Stacking Fault) phase such as $Mg_{12}Zn_1$-$xNi_x$ RE (where RE is a rare earth element) and that phase is 0.05-5 wt. % of the final alloy composition.

In still another and/or alternative non-limiting aspect of the invention, there is provided a degradable alloy wherein the mechanical properties at 150° C. are optionally at least 24 ksi tensile yield strength, and are not less than 20% lower than the mechanical properties at room temperature (77° F.).

In still another and/or alternative non-limiting aspect of the invention, there is provided a degradable alloy wherein the dissolution rate at 150° C. in 3% KCl brine is optionally 10-150 mg/cm2/hr.

In still another and/or alternative non-limiting aspect of the invention, there is provided a degradable alloy that optionally can include 2-4 wt. % yttrium, 2-5 wt. % gadolinium, 03-4 wt. % nickel, and 0.05-4 wt. % zinc.

In still another and/or alternative non-limiting aspect of the invention, there is provided a degradable alloy that can optionally include 0.1-0.8 wt. % manganese and/or zirconium.

In still another and/or alternative non-limiting aspect of the invention, there is provided a degradable alloy that can optionally be use in downhole applications such as pressure segmentation, or zonal control.

In still another and/or alternative non-limiting aspect of the invention, there is provided a degradable alloy can optionally be used for zonal or pressure isolation in a downhole component or tool.

In still another and/or alternative non-limiting aspect of the invention, there is provided a method for forming a degradable alloy wherein a base dissolution of enhanced magnesium alloy is optionally melted and calcium is added as metallic calcium above the liquids of the magnesium-aluminum phase and the aluminum preferentially forms $AlCa_2$ vs. $Mg_{17}Al_{12}$ during solidification of the alloy.

In still another and/or alternative non-limiting aspect of the invention, there is provided a degradable alloy can optionally be formed by adding calcium is in the form of an oxide or salt that is reduced by the molten melt vs. adding the calcium as a metallic element.

In still another and/or alternative non-limiting aspect of the invention, there is provided a degradable alloy can optionally be formed at double the speed or higher as compared to an alloy that does not include calcium due to the rise in incipient melting temperature.

One non-limiting objective of the present invention is the provision of a castable, moldable, or extrudable magnesium composite formed of magnesium or magnesium alloy and one or more additives dispersed in the magnesium or magnesium alloy.

Another and/or alternative non-limiting objective of the present invention is the provision of selecting the type and quantity of one or more additives so that the grain boundaries of the magnesium composite have a desired composition and/or morphology to achieve a specific galvanic corrosion rate in the entire magnesium composite and/or along the grain boundaries of the magnesium composite.

Still yet another and/or alternative non-limiting objective of the present invention is the provision of forming a magnesium composite wherein the one or more additives can be used to enhance mechanical properties of the magnesium composite, such as ductility and/or tensile strength.

Another and/or alternative non-limiting objective of the present invention is the provision of forming a magnesium composite that can be enhanced by heat treatment as well as deformation processing, such as extrusion, forging, or rolling, to further improve the strength of the final magnesium composite.

Yet another and/or alternative non-limiting objective of the present invention is the provision of forming a magnesium composite that can be can be made into almost any shape.

Another and/or alternative non-limiting objective of the present invention is the provision of dispersing the one or more additives in the molten magnesium or magnesium alloy is at least partially by thixomolding, stir casting, mechanical agitation, electrowetting, ultrasonic dispersion and/or combinations of these processes.

Another and/or alternative non-limiting objective of the present invention is the provision of producing a magnesium composite with at least one insoluble phase that is at least partially formed by the additive or additive material, and wherein the one or more additives have a different galvanic potential from the magnesium or magnesium alloy.

Still yet another and/or alternative non-limiting objective of the present invention is the provision of producing a magnesium composite wherein the rate of corrosion in the magnesium composite can be controlled by the surface area via the particle size and morphology of the one or more additions.

Yet another and/or alternative non-limiting objective of the present invention is the provision of producing a magnesium composite that includes one or more additives that have a solubility in the molten magnesium or magnesium alloy of less than about 10%.

Still yet another and/or alternative non-limiting objective of the present invention, there is provided a magnesium composite that can be used as a dissolvable, degradable and/or reactive structure in oil drilling.

These and other objects, features and advantages of the present invention will become apparent in light of the following detailed description of preferred embodiments thereof, as illustrated in the accompanying drawings.

DETAILED DESCRIPTION OF THE INVENTION

Referring now to the figures wherein the showings illustrate non-limiting embodiments of the present invention, the present invention is directed to a magnesium composite that includes one or more additives dispersed in the magnesium composite. The magnesium composite of the present invention can be used as a dissolvable, degradable and/or reactive structure in oil drilling. For example, the magnesium composite can be used to form a frac ball or other structure (e.g., sleeves, valves, hydraulic actuating tooling and the like, etc.) in a well drilling or completion operation. Although the magnesium composite has advantageous applications in the drilling or completion operation field of use, it will be appreciated that the magnesium composite can be used in any other field of use wherein it is desirable to form a structure that is controllably dissolvable, degradable and/or reactive.

Figure 1:
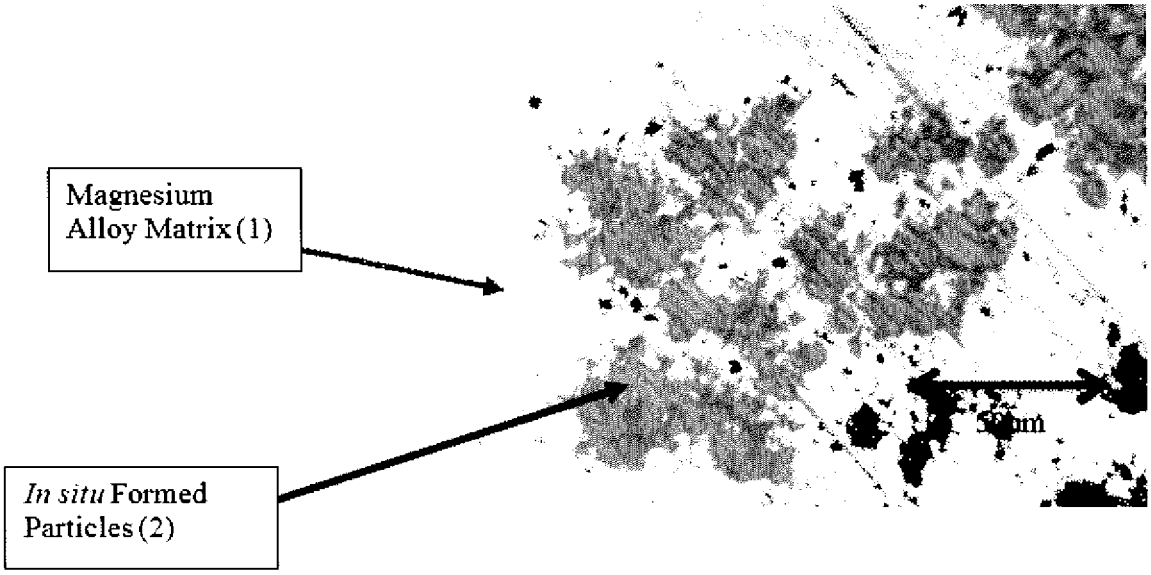
FIGS. 1-3 show a typical cast microstructure with galvanically-active in situ formed intermetallic phase wetted to the magnesium matrix; and, FIG. 4 shows a typical phase diagram to create in situ formed particles of an intermetallic $Mg_x(M)$, $Mg(M_x)$ and/or unalloyed M and/or M alloyed with another M where M is any element on the periodic table or any compound in a magnesium matrix and wherein M has a electronegativity that is greater than 1.5 or an electronegativity that is less than 1.25.
Figure 2:
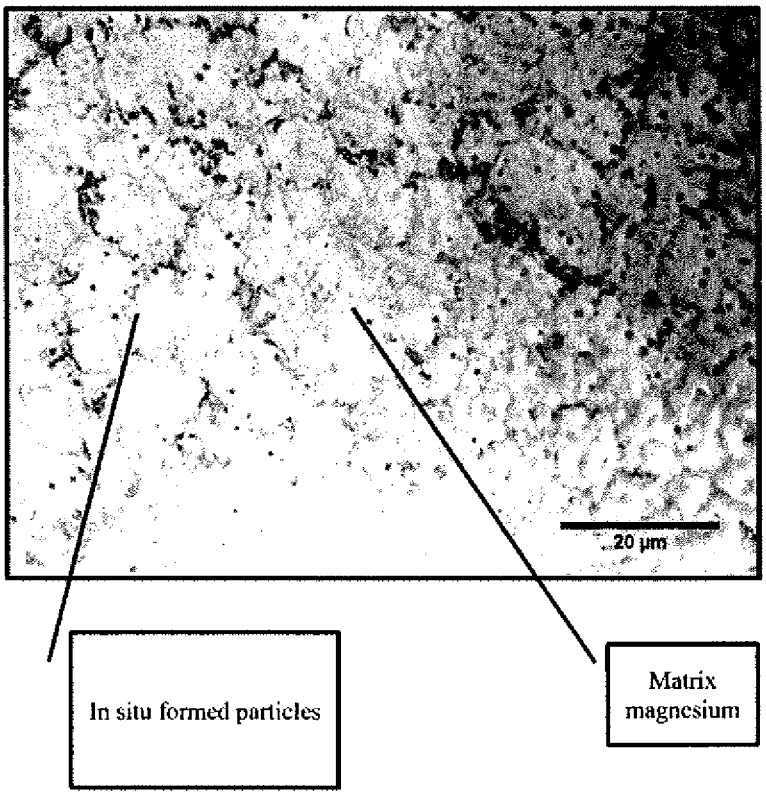
Figure 3:
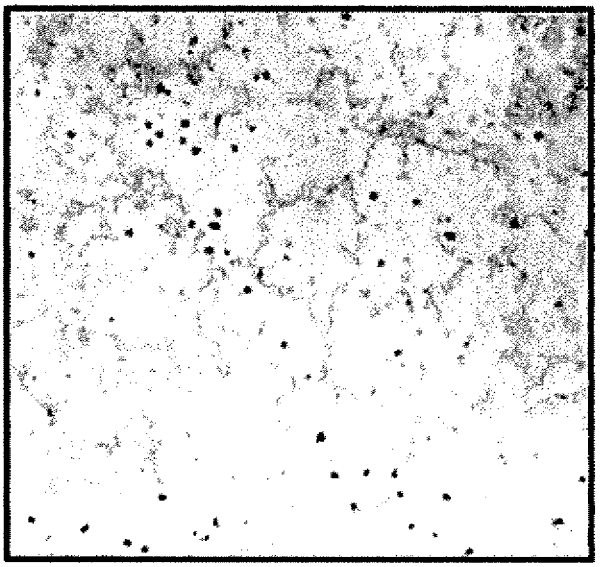
Figure 4:
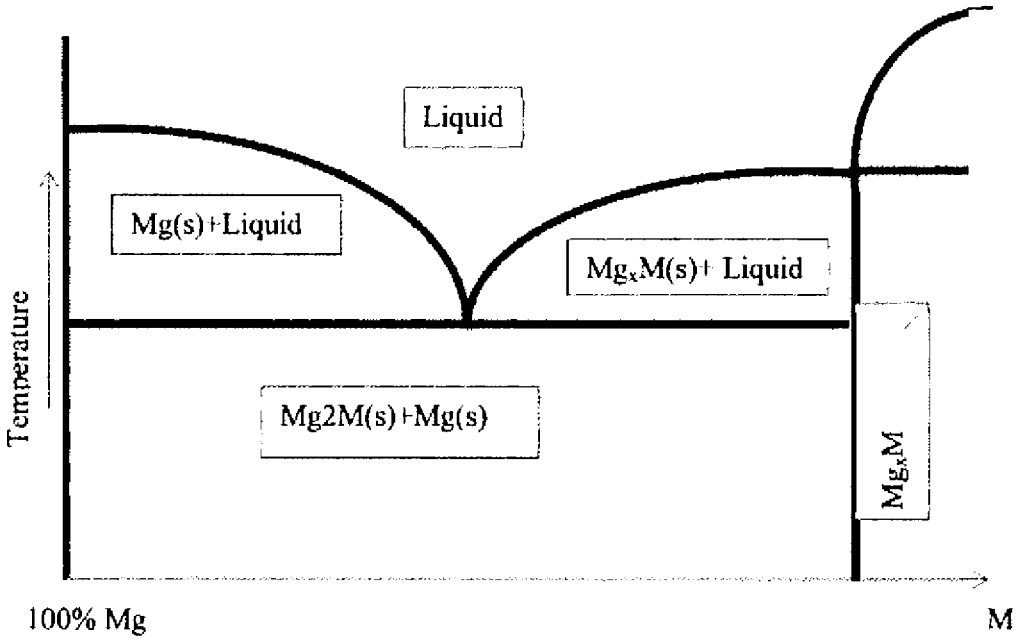

The present invention is directed to a novel magnesium composite that can be used to form a castable, moldable, or extrudable component. The magnesium composite includes at least 50 wt. % magnesium. Generally, the magnesium composite includes over 50 wt. % magnesium and less than about 99.5 wt. % magnesium and all values and ranges therebetween. One or more additives are added to a magnesium or magnesium alloy to form the novel magnesium composite of the present invention. The one or more additives can be selected and used in quantities so that galvanically-active intermetallic or insoluble precipitates form in the magnesium or magnesium alloy while the magnesium or magnesium alloy is in a molten state and/or during the cooling of the melt; however, this is not required. The one or more additives are added to the molten magnesium or magnesium alloy at a temperature that is typically less than the melting point of the one or more additives; however, this is not required. During the process of mixing the one or more additives in the molten magnesium or magnesium alloy, the one or more additives are not caused to fully melt in the molten magnesium or magnesium alloy; however, this is not required. For additives that partially or fully melt in the molten magnesium or molten magnesium alloy, these additives form alloys with magnesium and/or other additives in the melt, thereby resulting in the precipitation of such formed alloys during the cooling of the molten magnesium or molten magnesium alloy to form the galvanically-active phases in the magnesium composite. After the mixing process is completed, the molten magnesium or magnesium alloy and the one or more additives that are mixed in the molten magnesium or magnesium alloy are cooled to form a solid magnesium component that includes particles in the magnesium composite. Such a formation of particles in the melt is called in situ particle formation as illustrated in FIGS. 1-3. Such a process can be used to achieve a specific galvanic corrosion rate in the entire magnesium composite and/or along the grain boundaries of the magnesium composite. This feature results in the ability to control where the galvanically-active phases are located in the final casting, as well as the surface area ratio of the in situ phase to the matrix phase, which enables the use of lower cathode phase loadings as compared to a powder metallurgical or alloyed composite to achieve the same dissolution rates. The in situ formed galvanic additives can be used to enhance mechanical properties of the magnesium composite such as ductility, tensile strength, and/or shear strength. The final magnesium composite can also be enhanced by heat treatment as well as deformation processing (such as extrusion, forging, or rolling) to further improve the strength of the final composite over the as-cast material; however, this is not required. The deformation processing can be used to achieve strengthening of the magnesium composite by reducing the grain size of the magnesium composite. Further enhancements, such as traditional alloy heat treatments (such as solutionizing, aging and/or cold working) can be used to enable control of dissolution rates though precipitation of more or less galvanically-active phases within the alloy microstructure while improving mechanical properties; however, this is not required. Because galvanic corrosion is driven by both the electrode potential between the anode and cathode phase, as well as the exposed surface area of the two phases, the rate of corrosion can also be controlled through adjustment of the in situ formed particles size, while not increasing or decreasing the volume or weight fraction of the addition, and/or by changing the volume/weight fraction without changing the particle size. Achievement of in situ particle size control can be achieved by mechanical agitation of the melt, ultrasonic processing of the melt, controlling cooling rates, and/or by performing heat treatments. In situ particle size can also or alternatively be modified by secondary processing such as rolling, forging, extrusion and/or other deformation techniques. A smaller particle size can be used to increase the dissolution rate of the magnesium composite. An increase in the weight percent of the in situ formed particles or phases in the magnesium composite can also or alternatively be used to increase the dissolution rate of the magnesium composite. A phase diagram for forming in situ formed particles or phases in the magnesium composite is illustrated in FIG. 4.

In accordance with the present invention, a novel magnesium composite is produced by casting a magnesium metal or magnesium alloy with at least one component to form a galvanically-active phase with another component in the chemistry that forms a discrete phase that is insoluble at the use temperature of the dissolvable component. The in situ formed particles and phases have a different galvanic potential from the remaining magnesium metal or magnesium alloy. The in situ formed particles or phases are uniformly dispersed through the matrix metal or metal alloy using techniques such as thixomolding, stir casting, mechanical agitation, chemical agitation, electrowetting, ultrasonic dispersion, and/or combinations of these methods. Due to the particles being formed in situ to the melt, such particles generally have excellent wetting to the matrix phase and can be found at grain boundaries or as continuous dendritic phases throughout the component depending on alloy composition and the phase diagram. Because the alloys form galvanic intermetallic particles where the intermetallic phase is insoluble to the matrix at use temperatures, once the material is below the solidus temperature, no further dispersing or size control is necessary in the component. This feature also allows for further grain refinement of the final alloy through traditional deformation processing to increase tensile strength, elongation to failure, and other properties in the alloy system that are not achievable without the use of insoluble particle additions. Because the ratio of in situ formed phases in the material is generally constant and the grain boundary to grain surface area is typically consistent even after deformation processing and heat treatment of the composite, the corrosion rate of such composites remains very similar after mechanical processing.

Example 1

An AZ91D magnesium alloy having 9 wt. % aluminum, 1 wt. % zinc and 90 wt. % magnesium was melted to above 800° C. and at least 200° C. below the melting point of nickel. About 7 wt. % of nickel was added to the melt and dispersed. The melt was cast into a steel mold. The cast material exhibited a tensile strength of about 14 ksi, an elongation of about 3%, and shear strength of 11 ksi. The cast material dissolved at a rate of about 75 mg/cm$^2$-min in a 3% KCl solution at 90° C. The material dissolved at a rate of 1 mg/cm$^2$-hr in a 3% KCl solution at 21° C. The material dissolved at a rate of 325 mg/cm$^2$-hr. in a 3% KCl solution at 90° C.

Example 2

The composite in Example 1 was subjected to extrusion with an 11:1 reduction area. The material exhibited a tensile yield strength of 45 ksi, an Ultimate tensile strength of 50 ksi and an elongation to failure of 8%. The material has a dissolve rate of 0.8 mg/cm$^2$-min. in a 3% KCl solution at 20° C. The material dissolved at a rate of 100 mg/cm$^2$-hr. in a 3% KCl solution at 90° C.

Example 3

The alloy in Example 2 was subjected to an artificial T5 age treatment of 16 hours from 100-200° C. The alloy exhibited a tensile strength of 48 ksi and elongation to failure of 5% and a shear strength of 25 ksi. The material dissolved at a rate of 110 mg/cm$^2$-hr. in 3% KCl solution at 90° C. and 1 mg/cm$^2$-hr. in 3% KCl solution at 20° C.

Example 4

The alloy in Example 1 was subjected to a solutionizing treatment T4 of 18 hours from 400° C.-500° C. and then an artificial T6 aging process of 16 hours from 100-200 C. The alloy exhibited a tensile strength of 34 ksi and elongation to failure of 11% and a shear strength of 18 Ksi. The material dissolved at a rate of 84 mg/cm$^2$-hr. in 3% KCl solution at 90° C. and 0.8 mg/cm$^2$-hr. in 3% KCl solution at 20° C.

Example 5

An AZ91D magnesium alloy having 9 wt. % aluminum, 1 wt. % zinc, and 90 wt. % magnesium was melted to above 800° C. and at least 200° C. below the melting point of copper. About 10 wt. % of copper alloyed to the melt and dispersed. The melt was cast into a steel mold. The cast material exhibited a tensile yield strength of about 14 ksi, an elongation of about 3%, and shear strength of 11 ksi. The cast material dissolved at a rate of about 50 mg/cm$^2$-hr. in a 3% KCl solution at 90° C. The material dissolved at a rate of 0.6 mg/cm$^2$-hr. in a 3% KCl solution at 21° C.

Example 6

The alloy in Example 5 was subjected to an artificial T5 aging process of 16 hours from 100-200° C. The alloy exhibited a tensile strength of 50 ksi and elongation to failure of 5% and a shear strength of 25 ksi. The material dissolved at a rate of 40 mg/cm'-hr. in 3% KCl solution at 90° C. and 0.5 mg/cm$^2$-hr. in 3% KCl solution at 20° C.

Example 7

An AZ91D magnesium alloy having 9 wt. % aluminum, 1 wt. % zinc, and 90 wt. % magnesium was melted to above 700° C. About 16 wt. % of 75 μm iron particles were added to the melt and dispersed. The melt was cast into a steel mold. The cast material exhibited a tensile strength of about 26 ksi, and an elongation of about 3%. The cast material dissolved at a rate of about 2.5 mg/cm$^2$-min in a 3% KCl solution at 20° C. The material dissolved at a rate of 60 mg/cm$^2$-hr in a 3% KCl solution at 65° C. The material dissolved at a rate of 325 mg/cm$^2$-hr. in a 3% KCl solution at 90° C.

Example 8

An AZ91D magnesium alloy having 9 wt. % aluminum, 1 wt. % zinc, and 90 wt. % magnesium was melted to above 700° C. About 2 wt. % 75 μm iron particles were added to the melt and dispersed. The melt was cast into steel molds. The material exhibited a tensile strength of 26 ksi, and an elongation of 4%. The material dissolved at a rate of 0.2 mg/cm$^2$-min in a 3% KCl solution at 20° C. The material dissolved at a rate of 1 mg/cm$^2$-hr in a 3% KCl solution at 65° C. The material dissolved at a rate of 10 mg/cm$^2$-hr in a 3% KCl solution at 90° C.

Example 9

An AZ91D magnesium alloy having 9 wt. % aluminum, 1 wt. % zinc, and 90 wt. % magnesium was melted to above 700° C. About 2 wt. % nano iron particles and about 2 wt. % nano graphite particles were added to the composite using ultrasonic mixing. The melt was cast into steel molds. The material dissolved at a rate of 2 mg/cm2-min in a 3% KCl solution at 20° C. The material dissolved at a rate of 20 mg/cm2-hr in a 3% KCl solution at 65° C. The material dissolved at a rate of 100 mg/cm2-hr in a 3%© KCl solution at 90° C.

Example 10

The composite in Example 7 was subjected to extrusion with an 11:1 reduction area. The extruded metal cast structure exhibited a tensile strength of 38 ksi, and an elongation to failure of 12%. The extruded metal cast structure dissolved at a rate of 2 mg/cm2-min in a 3%© KCl solution at 20° C. The extruded metal cast structure dissolved at a rate of 301 mg/cm2-min in a 3% KCl solution at 90° C. The extruded metal cast structure exhibited an improvement of 58% tensile strength and an improvement of 166% elongation with less than 10% change in dissolution rate as compared to the non-extruded metal cast structure.

Example 11

Pure magnesium was melted to above 650° C. and below 750° C. About 7 wt. % of antimony was dispersed in the molten magnesium. The melt was cast into a steel mold. The cast material dissolved at a rate of about 20.09 mg/cm$^2$-hr in a 3% KCl solution at 90° C.

Example 12

Pure magnesium was melted to above 650° C. and below 750° C. About 5 wt % of gallium was dispersed in the molten magnesium. The melt was cast into a steel mold. The cast material dissolved at a rate of about 0.93 mg/cm$^2$-hr in a 3% KCl solution at 90° C.

Example 13

Pure magnesium was melted to above 650° C. and below 750° C. About 13 wt. % of tin was dispersed in the molten magnesium. The melt was cast into a steel mold. The cast material dissolved at a rate of about 0.02 mg/cm$^2$-hr in a 3% KCl solution at 90° C.

Example 14

A magnesium alloy that included 9 wt. % aluminum, 0.7 wt. % zinc, 0.3 wt. % nickel, 0.2 wt. % manganese, and the balance magnesium was heated to 157° C. (315° F.) under an $SF_6$—$CO_2$ cover gas blend to provide a protective dry atmosphere for the magnesium alloy. The magnesium alloy was then heated to 730° C. to melt the magnesium alloy and calcium was then added into the molten magnesium alloy in an amount that the calcium constituted 2 wt. % of the mixture. The mixture of molten magnesium alloy and calcium was agitated to adequately disperse the calcium within the molten magnesium alloy. The mixture was then poured into a preheated and protective gas-filled steel mold and naturally cooled to form a cast part that was a 9"×32" billet. The billet was subsequently preheated to ~350° C. and extruded into a solid and tubular extrusion profile. The extrusions were run at 12 and 7 inches/minute respectively, which is 2×-3× faster than the maximum speed the same alloy achieved without calcium alloying. It was determined that once the molten mixture was cast into a steel mold, the molten surface of the mixture in the mold did not require an additional cover gas or flux protection during solidification. This can be compared to the same magnesium-aluminum alloy without calcium that requires either an additional cover gas or flux during solidification to prevent burning.

The effect of the calcium on the corrosion rate of a magnesium-aluminum-nickel alloy was determined. Since magnesium already has a high galvanic potential with nickel, the magnesium alloy corrodes rapidly in an electrolytic solution such as a potassium chloride brine. The KCl brine was a 3% solution heated to 90° C. (194° F.). The corrosion rate was compared by submerging 1"×0.6" samples of the magnesium alloy with and without calcium additions in the solution for 6 hours and the weight loss of the alloy was calculated relative to initial exposed surface area. The magnesium alloy that did not include calcium dissolved at a rate of 48 mg/cm$^2$-hr. in the 3% KCl solution at 90° C. The magnesium alloy that included calcium dissolved at a rate of 91 mg/cm$^2$-hr. in the 3% KCl solution at 90° C. The corrosion rates were also tested in fresh water. The fresh water is water that has up to or less than 1000 ppm salt content. A KCl brine solution was used to compare the corrosion rated of the magnesium alloy with and without calcium additions. 1"×0.6" samples of the magnesium alloy with and without calcium additions were submerged in the 0.1% KCL brine solution for 6 hours and the weight loss of the alloys were calculated relative to initial exposed surface area. The magnesium alloy that did not include calcium dissolved at a rate of 0.1 mg/cm$^2$-hr. in the 0.1% KCl solution at 90° C., a rate of <0.1 mg/cm$^2$-hr. in the 0.1% KCl solution at 75° C., a rate of <0.1 mg/cm$^2$-hr. in the 0.1% KCl solution at 60° C., and a rate of <0.1 mg/cm$^2$-hr. in the 0.1% KCl solution at 45° C. The magnesium alloy that did include calcium dissolved at a rate of 34 mg/cm$^2$-hr. in the 0.1% KCl solution at 90° C., a rate of 26 mg/cm$^2$-hr. in the 0.1% KCl solution at 75° C., a rate of 14 mg/cm$^2$-hr. in the 0.1% KCl solution at 60° C., and a rate of 5 mg/cm$^2$-hr. in the 0.1% KCl solution at 45° C.

The effect of calcium on magnesium alloy revealed that the microscopic "cutting" effect of the lamellar aluminum-calcium phase slightly decreases the tensile strength at room temperature, but increased tensile strength at elevated temperatures due to the grain refinement effect of $Al_2Ca$. The comparative tensile strength and elongation to failure are shown in Table A.

TABLE A

| Test Temperature | Tensile Strength without Ca (psi) | Elongation to failure without Ca (%) | Tensile Strength with 2 wt. % Ca (psi) | Elongation to failure with 2 wt. % Ca (%) |
|---|---|---|---|---|
| 25° C. | 23.5 | 2.1 | 21.4 | 1.7 |
| 150° C. | 14.8 | 7.8 | 16.2 | 6.8 |

The effect of varying calcium concentration in a magnesium-aluminum-nickel alloy was tested. The effect on ignition temperature and maximum extrusion speed was also tested. For mechanical properties, the effect of 0-2 wt. % calcium additions to the magnesium alloy on ultimate tensile strength (UTS) and elongation to failure (Ef) is illustrated in Table B.

TABLE B

| Calcium Concentration (wt. %) | UTS at 25° C. | $E_f$ at 25° C. | UTS at 150° C. | $E_f$ at 150° C. |
|---|---|---|---|---|
| 0% | 41.6 | 10.3 | 35.5 | 24.5 |
| 0.5% | 40.3 | 10.5 | 34.1 | 24.0 |
| 1.0% | 38.5 | 10.9 | 32.6 | 23.3 |
| 2.0% | 37.7 | 11.3 | 31.2 | 22.1 |

The effect of calcium additions in the magnesium-aluminum-nickel alloy on ignition temperature was tested and found to be similar to a logarithmic function, with the ignition temperature tapering off. The ignition temperature trend is shown in Table C.

TABLE C

| | Calcium Concentration (wt. %) | | | | | |
|---|---|---|---|---|---|---|
| | 0 | 1 | 2 | 3 | 4 | 5 |
| Ignition Temperature (° C.) | 550 | 700 | 820 | 860 | 875 | 875 |

The incipient melting temperature effect on maximum extrusion speeds was also found to trend similarly to the ignition temperature since the melting temperature of the magnesium matrix is limiting. The extrusion speed for a 4" solid round extrusion from at 9" round billet trends as shown in Table D.

TABLE D

| Calcium Concentration (wt. %) | 0% | 0.5% | 1% | 2% | 4% |
|---|---|---|---|---|---|
| Extrusion Speed for 4" solid (in/min) | 4 | 6 | 9 | 12 | 14 |
| Extrusion speed for 4.425" OD × 2.645" ID tubular (in/min) | 1.5 | 2.5 | 4 | 7 | 9 |

Example 15

Pure magnesium is heated to a temperature of 680-720° C. to form a melt under a protective atmosphere of SF6+$CO_2$+air. 1.5-2 wt. % zinc and 1.5-2 wt. % nickel were added using zinc lump and pelletized nickel to form a molten solution. From 3-6 wt. % gadolinium, as well as about 3-6 wt. % yttrium was added as lumps of pure metal, and 0.5-0.8% zirconium was added as a Mg-25% zirconium master alloy to the molten magnesium, which is then stirred to distribute the added metals in the molten magnesium. The melt was then cooled to 680° C., and degassed using HCN and then poured in to a permanent A36 steel mold and solidified. After solidification of the mixture, the billet was solution treated at 500° C. for 4-8 hours and air cooled. The billet was reheated to 360° C. and aged for 12 hours, followed by extrusion at a 5:1 reduction ratio to form a rod.

It is known that LPSO phases in magnesium can add high temperature mechanical properties as well as significantly increase the tensile properties of magnesium alloys at all temperatures. The $Mg_{12}Zn_{1-x}Ni_x$ $RE_1$ LPSO (long period stacking order) phase enables the magnesium alloy to be both high strength and high temperature capable, as well as to be able to be controllably dissolved using the phase as an in situ galvanic phase for use in activities where enhanced and controllable use of degradation is desired. Such activities include use in oil and gas wells as temporary pressure diverters, balls, and other tools that utilize dissolvable metals.

The magnesium alloy was solution treated at 500° C. for 12 hours and air-cooled to allow precipitation of the 14H LPSO phase incorporating both zinc and nickel as the transition metal in the layered structure. The solution-treated alloy was then preheated at 350-400° C. for over 12 hours prior to extrusion at which point the material was extruded using a 5:1 extrusion ratio (ER) with an extrusion speed of 20 ipm (inch per minute).

At the nano-layers present between the nickel and the magnesium layers or magnesium matrix, the galvanic reaction took place. The dissolution rate in 3% KCl brine solution at 90° C. as well as the tensile properties at 150° C. of the galvanically reactive alloy are shown in Table E.

TABLE E

| Magnesium Alloy | | | |
|---|---|---|---|
| Dissolution rate ($mg/cm^2$-hr.) | Ultimate Tensile Strength at 150° C. (ksi) | Tensile Yield Strength at 150° C. (ksi) | Elongation to Failure at 150° C. (%) |
| 62-80 | 36 | 24 | 38 |

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A method of controlling the dissolution properties of a magnesium composite comprising:

heating a magnesium material above a solidus temperature of magnesium, said magnesium material including magnesium and one or more metals selected from the group consisting of aluminum, boron, bismuth, zinc, zirconium, and manganese;

adding first and second additives to said magnesium material while said magnesium material is above said solidus temperature of magnesium to form a magnesium mixture, said first additive including one or more metals selected from the group consisting of nickel, cobalt, copper, lead, antimony, indium, gold, and gallium, said second additive including one or more metals selected from the group consisting of calcium, strontium, barium, potassium, sodium, lithium, cesium, yttrium, lanthanum, samarium, europium, gadolinium, terbium, dysprosium, holmium, and ytterbium;

dispersing said first and second additives in said magnesium mixture while said magnesium mixture is above said solidus temperature of magnesium; and, cooling said magnesium mixture to form said magnesium composite, said magnesium composite including in situ precipitation of galvanically-active intermetallic phases, said magnesium composite includes 0.05-10 wt. % aluminum when aluminum is included in said magnesium composite, a combined content of said first and second additives constituting about 0.05-45 wt. % of said magnesium composite; and, wherein said magnesium composite has a dissolution rate of at least 5 mg/cm$^2$-hr. in 3% KCl at 90° C.

2. The method as defined in claim 1, wherein said magnesium material is heated during said step of heating to a temperature that is less than said melting point temperature of one of said first and/or second additives.

3. The method as defined in claim 1, wherein said first additive includes one or more metals selected from the group consisting of copper, nickel, cobalt, bismuth, silver, and gallium, and said second additive includes one or more metals selected from the group consisting of calcium, strontium, and barium.

4. The method as defined in claim 1, wherein said magnesium composite includes greater than 50 wt. %.

5. The method as defined in claim 1, including the step of forming said magnesium composite into a final shape or near net shape by a) sand casting, permanent mold casting, investment casting, shell molding, or pressureless casting technique at a temperature above 730° C., 2) using either pressure addition or elevated pouring temperatures above 710° C., or 3) subjecting said magnesium composite to pressures of 2000-20,000 psi through use of squeeze casting, thixomolding, or pressure die casting techniques.

6. The method as defined in claim 1, wherein said magnesium composite has a hardness above 14 Rockwell Harness B.

7. The method as defined in claim 1, wherein said magnesium composite includes about 0.05-35 wt. % nickel.

8. The method as defined in claim 1, wherein said magnesium composite includes about 0.05-35 wt. % copper.

9. The method as defined in claim 1, wherein said magnesium composite includes about 0.05-35 wt. % antimony.

10. The method as defined in claim 1, wherein said magnesium composite includes about 0.05-35 wt. % gallium.

11. The method as defined in claim 1, wherein said magnesium composite includes about 0.05-35 wt. % tin.

12. The method as defined in claim 1, wherein said magnesium composite includes about 0.05-35 wt. % bismuth.

13. The method as defined in claim 1, wherein said magnesium composite includes about 0.05-35 wt. % calcium.

14. A method of controlling the dissolution properties of a magnesium composite comprising:

heating magnesium material above a solidus temperature of magnesium, said magnesium material including greater than 50 wt. % magnesium and one or more metals selected from the group consisting of aluminum, boron, bismuth, zinc, zirconium, and manganese;

adding additive material to said magnesium material while said magnesium material is above said solidus temperature of magnesium to form a magnesium mixture, said additive material including first additive and second additive, said first additive including one or more metals selected from the group consisting of nickel, cobalt, copper, bismuth, silver, and gallium, said second additive including one or more metals selected from the group consisting of calcium, strontium, and barium;

dispersing said additive material in said magnesium mixture while said magnesium mixture is above said solidus temperature of magnesium; and, cooling said magnesium mixture to form said magnesium composite, said magnesium composite including in situ precipitation of galvanically-active intermetallic phases, said magnesium composite including greater than 50 wt. % magnesium and 0.05-10 wt. % aluminum when aluminum is included in said magnesium composite, said additive material constituting about 0.05-45 wt. % of said magnesium composite, and wherein said magnesium composite has a dissolution rate of at least 5 mg/cm$^2$-hr. in 3% KCl at 90° C.

15. The method as defined in claim 14, wherein said first additive includes one or more metals selected from the group consisting of copper, nickel, cobalt, and gallium.

16. The method as defined in claim 14, wherein said second additive includes calcium.

17. The method as defined in claim 15, wherein said second additive includes calcium.

18. The method as defined in claim 14, wherein said magnesium composite includes at least 85 wt. % magnesium.

19. The method as defined in claim 17, wherein said magnesium composite includes at least 85 wt. % magnesium.

20. The method as defined in claim 14, including the step of forming said magnesium composite into a final shape or near net shape by a) sand casting, permanent mold casting, investment casting, shell molding, or pressureless casting technique at a temperature above 730° C., 2) using either pressure addition or elevated pouring temperatures above 710° C., or 3) subjecting said magnesium composite to pressures of 2000-20,000 psi through use of squeeze casting, thixomolding, or pressure die casting techniques.

21. The method as defined in claim 19, including the step of forming said magnesium composite into a final shape or near net shape by a) sand casting, permanent mold casting, investment casting, shell molding, or pressureless casting technique at a temperature above 730° C., 2) using either pressure addition or elevated pouring temperatures above 710° C., or 3) subjecting said magnesium composite to pressures of 2000-20,000 psi through use of squeeze casting, thixomolding, or pressure die casting techniques.

22. The method as defined in claim 20, wherein said final shape or near net shape is in the form of a valve, a valve component, a plug, a frac ball, a sleeve, a hydraulic actuating tool, or a mandrel.

23. The method as defined in claim 21, wherein said final shape or near net shape is in the form of a valve, a valve component, a plug, a frac ball, a sleeve, a hydraulic actuating tool, or a mandrel.

* * * * *